US005728514A

United States Patent [19]

Yoshioka et al.

[11] Patent Number: 5,728,514

[45] Date of Patent: Mar. 17, 1998

[54] SILVER HALIDE COLOR PHOTOGRAPHIC MATERIAL AND METHOD FOR FORMING COLOR IMAGE

[75] Inventors: Yasuhiro Yoshioka; Hiroo Takizawa; Masakazu Morigaki, all of Kanagawa, Japan

[73] Assignee: Fuji Photo Film Co, Ltd., Ashigara, Japan

[21] Appl. No.: 877,782

[22] Filed: Jun. 17, 1997

Related U.S. Application Data

[63] Continuation of Ser. No. 567,581, Dec. 5, 1995, abandoned.

[30] Foreign Application Priority Data

Dec. 9, 1994 [JP] Japan ..... 6-331000

[51] Int. Cl.[6] ..... G03C 1/08; G03C 7/26; G03C 7/32

[52] U.S. Cl. ..... 430/557; 430/551; 430/546

[58] Field of Search ..... 430/503, 557, 430/551, 546

[56] References Cited

U.S. PATENT DOCUMENTS 5,418,121 5/1995 Yoshioka et al. ..... 430/546

5,462,845 10/1995 Yoshioka ..... 430/546

*Primary Examiner*—Geraldine Letscher

*Attorney, Agent, or Firm*—Burns, Doane, Swecker & Mathis, LLP

[57] ABSTRACT

A silver halide color photographic material is disclosed, which comprises a support having thereon at least one yellow coloring light-sensitive silver halide emulsion layer, at least one magenta coloring light-sensitive silver halide emulsion layer, and at least one cyan coloring light-sensitive silver halide emulsion layer, wherein at least one of said yellow coloring light-sensitive silver halide emulsion layer contains at least one dye-forming coupler represented by formula (Y) and at least one non-coloring compound represented by formula (A) or (B):

(Y)

(A)

(B)

with the substituents as defined herein the specification.

18 Claims, No Drawings

SILVER HALIDE COLOR PHOTOGRAPHIC MATERIAL AND METHOD FOR FORMING COLOR IMAGE

This application is a continuation of application Ser. No. 08/567,581, filed Dec. 5, 1995 now abandoned.

FIELD OF THE INVENTION

The present invention relates to a silver halide color photographic material and, specifically, relates to a silver halide color photographic material which is excellent in color forming ability, color reproducibility, image stability and further raw stock storability and processing stability are improved, and to a method for forming a color image.

BACKGROUND OF THE INVENTION

The most popular color image forming method in the silver halide color photographic material is a method of forming dyes such as an azomethine dye by reacting an oxidized product of an aromatic primary amine color developing agent with couplers making use of an exposed silver halide as an oxidizing agent. In such a system, a color image is reproduced by a subtractive color process, in general, a color image is formed by changing the quantities of dyes formed of three colors of yellow, magenta and cyan.

Of these, a pivaloyl type coupler and a benzoyl type coupler have been conventionally used as a yellow coupler. A pivaloyl type coupler is excellent in image stability but has drawbacks such that the activity of the coupler is low and the molecular extinction coefficient of the molecule of the dye formed is small. Therefore, the amount used of the coupler necessarily becomes large which is economically disadvantageous. Further, it is difficult to make the thickness of the yellow color forming layer thinner, which has been an obstacle to the speedup of the processing and the reduction of replenishment rate.

As an attempt of increasing the molecular extinction coefficient of the molecule of the dye formed, there have been proposed, for example, an acylacetanilide type coupler having a 3- to 5-membered cyclic acyl group in EP-A-447969 and a malondianilide type coupler having a cyclic structure in EP-A-482552. On the other hand, many attempts have been made to heighten the activity of couplers. One means of them is to improve the activity of couplers by increasing the hydrophilic property of couplers.

For example, couplers into which an oxazolidine-2,4-dion-3-yl group or a 1,2,4-triazolidine-3,5-dion-4-yl group is incorporated as a separable group are disclosed, for example, in JP-A-50-132926, JP-A-62-206549 and JP-A-63-291056 (the term "JP-A" as used herein refers to a "published unexamined Japanese patent application"). Examples of couplers into which an imidazolidine-2,4-dion-3-yl group is incorporated are disclosed in JP-A-3-126939, JP-A-3-126940 and JP-A-3-126941. On the other hand, for improving color reproducibility, attempts to improve the absorption characteristics of the dyes formed have been conducted. The above described acylacetanilide type coupler having a 3- to 5-membered cyclic acyl group and malondianilide type coupler having a cyclic structure are excellent couplers in the point of absorption characteristics of the dyes. For improving the hue of a pivaloyl type coupler, methods of introducing a specific group such as an alkoxyl group and the like at the ortho position of an anilide ring are disclosed, for example, in JP-A-52-115219 and JP-A-63-123047. Further, attempts for improving color forming ability of these couplers are disclosed, for example, in JP-A-3-125140, JP-A-3-125141 and JP-A-4-77214. Increasing the hydrophilic property of couplers is certainly effective in the point of improving color forming ability but, as a result, the interaction with a silver halide emulsion becomes large, and when a photographic material is used after long term storage or processed with a processing solution whose composition has been altered, new problems arise such as generation of fog or fluctuation of sensitivity and gradation. This becomes a large problem, in particular, when a processing temperature is raised, when the concentration of a developing agent is increased, when the pH of a color developing solution is raised, and when the layer thickness of a photographic material is made thinner, for the speedup of the processing.

SUMMARY OF THE INVENTION

One object of the present invention is to provide a silver halide color photographic material which is excellent in color forming ability, color reproducibility, image stability and, further, is improved in raw stock storability and processing stability, and another object is to provide a method for forming a color image.

The above objects of the present invention have been attained by a silver halide color photographic material of the following constitutions (1) to (6) and a method for forming a color image. That is:

(1) A silver halide color photographic material comprising a support having thereon at least one yellow coloring light-sensitive silver halide emulsion layer, at least one magenta coloring light-sensitive silver halide emulsion layer, and at least one cyan coloring light-sensitive silver halide emulsion layer, wherein at least one of said yellow coloring light-sensitive silver halide emulsion layer contains at least one dye forming coupler represented by formula (Y) and at least one non-coloring compound represented by formula (A) or (B):

(Y)

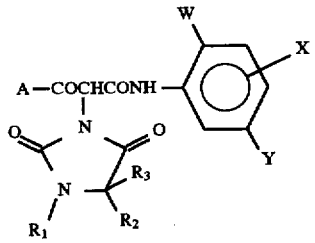

wherein A represents a tertiary alkyl group, an aryl group or an indolinyl group; W represents a halogen atom, an alkoxyl group, an aryloxy group or an alkyl group; X represents a hydrogen atom or a substituent; Y represents an acylamino group, an alkoxyl group, a sulfonamido group, a carbamoyl group, a sulfamoyl group, an alkoxycarbonyl group or a sulfonyl group; $R_1$ represents a hydrogen atom, an alkyl group, an acyl group or a sulfonyl group; $R_2$ and $R_3$ each independently represents a hydrogen atom, an alkyl group, an alkoxyl group or a sulfonyl group, and the total carbon atoms of $R_1$, $R_2$ and $R_3$ are 6 or less, provided that the compound represented by the following formula (I) is excluded from the compound represented by formula (A);

(A)

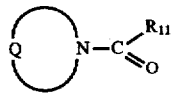

wherein Q represents a nonmetallic atom group necessary for forming a 5- to 7-membered ring together with a nitrogen atom; and $R_{11}$ represents an alkyl group, an aryl group or an alkoxyl group;

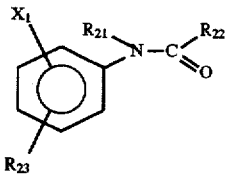

(B)

wherein $R_{21}$ represents a hydrogen atom or an alkyl group; $R_{22}$ represents an alkyl group, an aryl group or an alkoxyl group; $R_{23}$ represents a hydrogen atom, a halogen atom, an alkyl group, an alkoxyl group, an acylamino group or a sulfonamido group; and $X_1$ represents a hydrogen atom or a substituent;

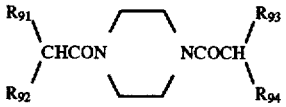

(I)

wherein $R_{91}$, $R_{92}$, $R_{93}$ and $R_{94}$ independently represents a branched and unsubstituted alkyl group having from 3 to 20 carbon atoms with the proviso that the total carbon number of $R_{91}$, $R_{92}$, $R_{93}$ and $R_{94}$ is from 16 to 60.

(2) A silver halide color photographic material as described in (1) above, wherein the compound represented by formula (A) or (B) is represented by formula (A-1) or (B-1), respectively:

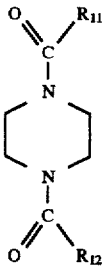

(A-1)

wherein $R_{11}$ and $R_{12}$ each independently represents the same groups as represented by $R_{11}$ in formula (A);

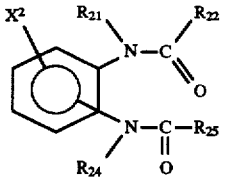

(B-1)

wherein $R_{21}$ and $R_{24}$, and $R_{22}$ and $R_{25}$ each independently represents the same groups as represented by $R_{21}$ and $R_{22}$ in formula (B); and $X_2$ represents the same groups as represented by $X_1$ in formula (B).

(3) A silver halide color photographic material as described in (1) or (2) above, wherein $R_1$ in formula (Y) represents a hydrogen atom.

(4) A silver halide color photographic material as described in (1), (2) or (3) above, wherein the coupler represented by formula (Y) is dispersed in at least one of said yellow coloring light-sensitive silver halide emulsion layer together with at least one compound represented by formula (C), (D) or (E):

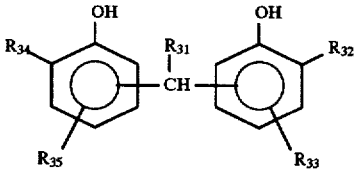

(C)

wherein $R_{31}$ represents a hydrogen atom or an alkyl group; and $R_{32}$, $R_{33}$, $R_{34}$ and $R_{35}$ each independently represents an alkyl group;

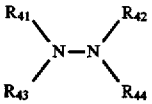

(D)

wherein $R_{41}$ and $R_{42}$ each independently represents an alkyl group or an aryl group; and $R_{43}$ and $R_{44}$ each independently represents an alkyl group; and at least any two of $R_{41}$ to $R_{44}$ may be bonded each other to form a ring;

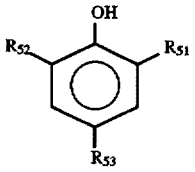

(E)

wherein $R_{51}$ and $R_{52}$ each independently represents an alkyl group or an alkoxyl group; and $R_{53}$ represents an alkyl group, an alkoxycarbonyl group, an aryloxycarbonyl group or a carbamoyl group.

(5) A silver halide color photographic material as described in (1), (2), (3) or (4) above, wherein the coupler represented by formula (Y) is contained in at least one said yellow coloring light-sensitive silver halide emulsion layer in the form of dispersion together with further at least one compound represented by formula (F), (G) or (H):

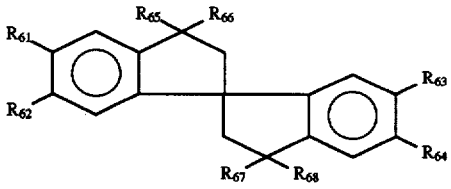

(F)

wherein $R_{61}$, $R_{62}$, $R_{63}$ and $R_{64}$ each independently represents an alkyl group, an alkoxyl group, a substituted or unsubstituted amino group (as a substituted amino group, a nitrogen-containing heterocyclic group bonded via a nitrogen atom (preferably a 5- or 6-membered ring group, specifically,

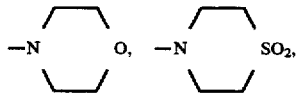

etc.) are included as well as an alkylamino group or an acylamino group), an aryloxy group, a sulfonyl group or an acyloxy group; and $R_{65}$, $R_{66}$, $R_{67}$ and $R_{68}$ each independently represents a hydrogen atom or an alkyl group; $R_{61}$ and $R_{62}$, and $R_{63}$ and $R_{64}$ may be bonded each other to close a ring;

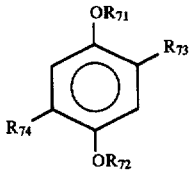

(G)

wherein $R_{71}$ and $R_{72}$ each independently represents an alkyl group, an alkenyl group, an acyl group, an aryl group or a silyl group; and $R_{73}$ and $R_{74}$ each independently represents a hydrogen atom, a halogen atom, an alkyl group, a silyl group, an acyl group or a sulfonyl group; $R_{71}$ and $R_{73}$, and $R_{72}$ and $R_{74}$ may be bonded each other to form a ring;

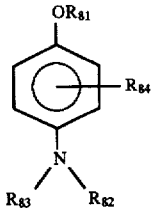

(H)

wherein $R_{81}$ represents an alkyl group, an alkenyl group, an aryl group or an acyl group; $R_{82}$ and $R_{83}$ each independently represents an alkyl group, an acyl group, an alkenyl group or an aryl group; and $R_{84}$ represents a hydrogen atom, an alkyl group, an alkoxyl group, a halogen atom or a sulfonyl group; when either of $R_{82}$ or $R_{83}$ represents an acyl group, $R_{84}$ represents an alkoxyl group, and $R_{81}$ and $R_{84}$, $R_{82}$ and $R_{83}$, or $R_{82}$ and $R_{84}$ may be bonded each other to form a ring.

(6) A method for forming a color image comprises exposing a silver halide color photographic material as described in (1), (2), (3), (4) or (5) above by a scanning exposure system in which the exposure time per pixel is less than $10^{-4}$ sec, and then color development processing.

DETAILED DESCRIPTION OF THE INVENTION

In the present invention, the hydrophilic property of the coupler can be increased and the color forming ability of the photographic material can be improved by specifying the separable group of the coupler.

Further, the light fastness and humidity and heat fastness of the image can be improved by the combined use of the compound represented by formula (A) or (B) with the coupler of the present invention.

Moreover, the combined use of the coupler of the present invention with the compound represented by formula (A) or (B) can improve not only fastness but also color forming ability of the photographic material.

Still further, the photographic material using the coupler of the present invention in combination with the compound represented by formula (A) and (B) does not generate the reduction of sensitivity which is generated when stored in high humidity condition in unexposed state.

Yet further, by the combined use of the coupler of the present invention with the compound represented by formula (A) or (B), processing stability can be improved.

Still yet further, in the present invention, by further combination of the compound represented by formula (C), (D), (E), (F), (G) or (H), image stability can be still more improved.

In the present specification, "an alkyl group (or an alkyl residue)" means not only an acyclic alkyl group but also a cycloalkyl group (a cycloalkyl residue).

Preferred range of the dye forming couplers represented by formula (Y) will be explained in detail below.

In formula (Y), A represents a tertiary alkyl group having from 4 to 20 carbon atoms (such as an acyclic tertiary alkyl group, e.g., t-butyl, 1,1-dimethylpropyl, 1,1-dimethylhexyl, 1,1-dimethyl-2-methoxyethyl, 1,1-dimethyl-2-phenylethyl, and a cycloalkyl group, e.g., 1-methylcyclopropyl, 1-ethylcyclopropyl, 1-benzylcyclopropyl, 1-methylcyclobutyl, 1-methylcyclopentyl, 1-ethylcyclopentyl, 1-methylcyclohexyl, 5-methyl-1,3-dioxan-5-yl, 2,2,5-trimethyl-1,3-dioxan-5-yl, 1-adamantyl), an aryl group having from 6 to 24 carbon atoms (e.g., phenyl, 2-methylphenyl, 4-methoxyphenyl, 4-hexadecyloxyphenyl, 3-chlorophenyl, 3,5-dimethylphenyl, 2-naphthyl), or an indolinyl group (e.g., indolinyl, 2-methylindolinyl, 5-chloroindolinyl, 5-cyanoindolinyl). The tertiary acyclic alkyl group, tertiary cycloalkyl group, aryl group and indolinyl group may have a substituent as indicated in the above examples of substituents.

Examples of such substituents which may be substituted on the group A include a halogen atom, an alkyl group, an alkenyl group, an alkynyl group, an aryl group, a heterocyclic group, an alkoxyl group, an aryloxy group, an acyloxy group, a hydroxy group, an amino group, an acyalmino group, a sulfonamido group, a ureido group, a urethane group, an acyl group, a carboxyl group, an alkoxycarbonyl group, a carbamoyl group, an alkylthio group, an arylthio group, a sulfoxide group, a sulfonyl group, a sulfonyloxy group, a sulfamoyl group, a nitro group, a cyano group, a silyl group, and a phosphoryl group. The substituent including an aliphatic group, an aromatic group or at least one of them generally has from 1 to 35 carbon atoms.

W represents a halogen atom (e.g., fluorine, bromine, chlorine), an alkoxyl group having from 1 to 24 carbon atoms (e.g., methoxy, ethoxy, butoxy, octyloxy, cyclohexyloxy, n-dodecyloxy, n-hexadecyloxy, methoxyethoxy), an aryloxy group (e.g., phenoxy, 4-methylphenoxy, 4-methoxyphenoxy, 2-chlorophenoxy, 1-naphthyloxy), or an alkyl group (e.g., methyl, butyl, i-propyl, t-butyl). When W represents an alkoxy group, an aryloxy group or an alkyl group, these groups may be substituted with substitutable groups with A. X represents a hydrogen atom or a substituent, and examples of substituents are the same as those enumerated as the substituents for A.

Y represents an acylamino group having from 1 to 24 carbon atoms (e.g., acetylamino, benzoylamino, palmitoylamino, stearoylamino, N-methyl-stearoylamino, 2-(2,4-di-t-acylphenoxy)butyrylamino), a sulfonamido group having from 1 to 24 carbon atoms (e.g., methanesulfonamido, butanesulfonamido, dodecanesulfonamido, hexadecanesulfonamido, benzenesulfonamido), a carbamoyl group having from 1 to 36 carbon atoms (e.g., N,N-diethylcarbamoyl, N,N-dioctylcarbamoyl, N-methyl-N-hexadecylcarbamoyl, N-phenyl-N-dodecylcarbamoyl), a sulfamoyl group having from 1 to 36 carbon atoms (e.g., diethylsulfamoyl, dibutylsulfamoyl, dioctylsulfamoyl, N-methyl-N-hexadecylsulfamoyl, N-phenyl-N-dodecylsulfamoyl), an alkoxycarbonyl group having from 1 to 24 carbon atoms (e.g., methoxycarbonyl, dodecyloxycarbonyl), or a sulfonyl group having from 1 to 24 carbon atoms (e.g., methanesulfonyl, dodecanesulfonyl, octadecanesulfonyl). These groups may have a substituent.

$R_1$ represents a hydrogen atom, an alkyl group (e.g., methyl, ethyl, propyl, i-propyl, butyl, i-butyl, sec-butyl, t-butyl), an acyl group (an aliphatic acyl group, e.g., acetyl, propionyl), or a sulfonyl group (methanesulfonyl, ethanesulfonyl, butanesulfonyl, benzenesulfonyl), and each of these groups has 6 or less carbon atoms. $R_2$ and $R_3$ each independently represents a hydrogen atom, an alkyl group (e.g., methyl, ethyl, methanesulfonylmethyl, methoxymethyl), an alkoxyl group (e.g., methoxy, ethoxy, butoxy, methoxyethoxy, i-propoxy, t-butoxy), a sulfonyl group (e.g., methanesulfonyl, butanesulfonyl, benzenesulfonyl), and each of these groups has 6 or less carbon atoms.

It is preferred that A, W, X or Y in formula (Y) has a group having high carbon atoms, generally up to 36 carbon atoms, sufficient to provide a property of a ballast group and/or an oil-soluble group. Of them, W or Y preferably has such a group.

More preferred constitutions of the dye forming couplers represented by formula (Y) will be explained below.

A preferably represents a t-butyl group, a 1-methylcyclopentyl group, a 1-methylcyclopropyl group, a 1-ethylcyclopropyl group, a 1-benzylcyclopropyl group, a 4-methoxyphenyl group, an indolinyl group, or a 2-methylindolinyl group. Particularly preferred of them are a t-butyl group, a 1-ethylcyclopropyl group, a 1-benzylcyclopropyl group and an indolinyl group.

W preferably represents a halogen atom (e.g., fluorine, bromine, chlorine) or an alkoxyl group, and particularly preferably a chlorine atom or a methoxy group. X preferably represents a hydrogen atom, a halogen atom (e.g., fluorine, bromine, chlorine) or an alkoxyl group. Y preferably represents an acylamino group or a sulfonamido group and more preferably an acylamino group. As an acylamino group, those having a straight chain or branched chain alkyl group are preferred, in particular, those having a straight chain alkyl group are preferred in view of color forming ability and economical point. Further, acylamino groups having substituents such as an alkoxycarbonyl group, an alkoxyl group, an aryloxy group, a sulfonyl group, a sulfamoyl group or a phosphoryl group are particularly preferred in view of the improvement of the solubility of couplers.

The total carbon atoms of $R_1$, $R_2$ and $R_3$ are 6 or less, preferably 5 or less, more preferably 4 or less, and still more preferably 3 or less.

$R_1$ preferably represents a hydrogen atom, a methyl group, an acetyl group or a methanesulfonyl group, more preferably a hydrogen atom or a methyl group. In particular, it is preferred in the point of color forming ability that $R_1$ represents a hydrogen atom.

Specific examples of the dye forming couplers represented by formula (Y) of the present invention are shown below but the present invention is not limited thereto.

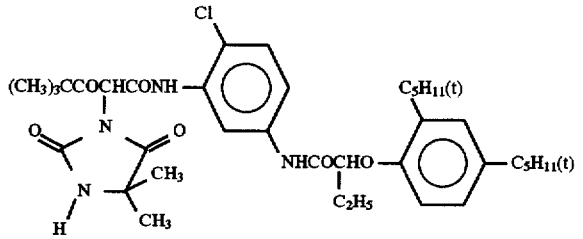

Y-1

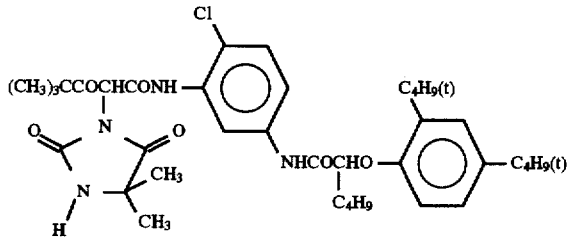

Y-2

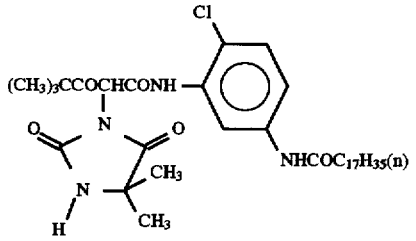

Y-3

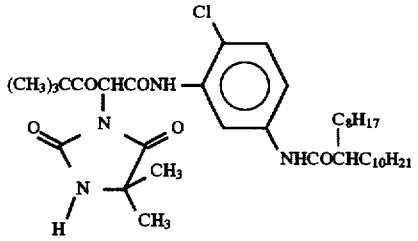

Y-4

-continued
Y-5
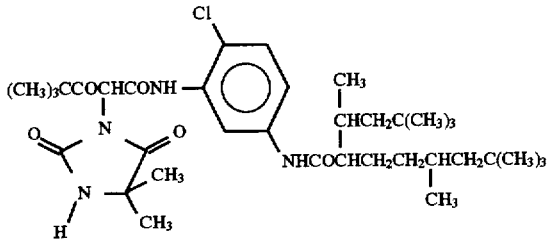
Y-6
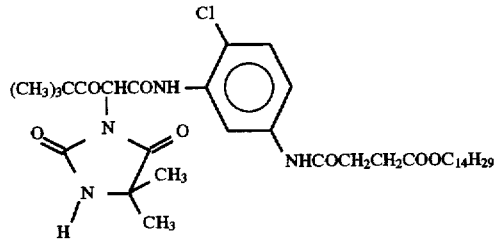
Y-7
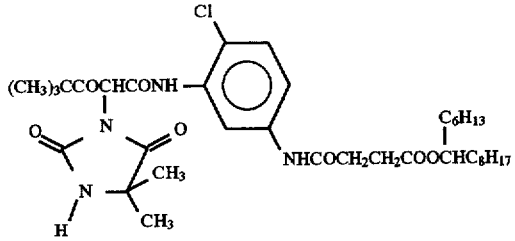
Y-8
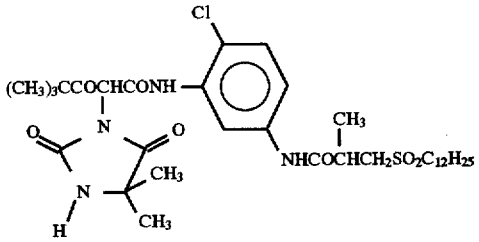
Y-9
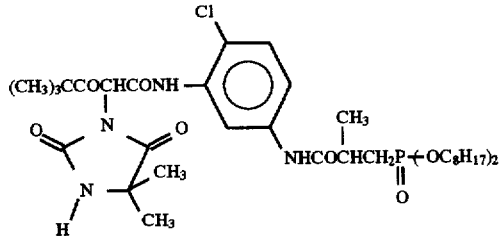
Y-10
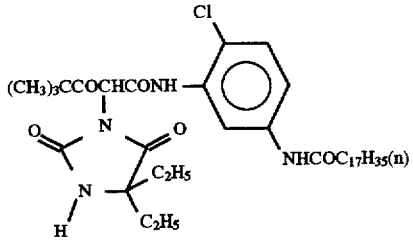

-continued
Y-11
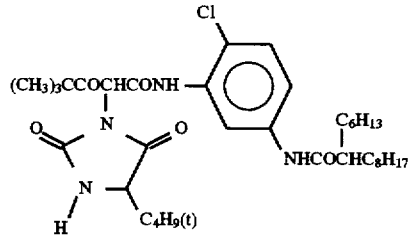
Y-12
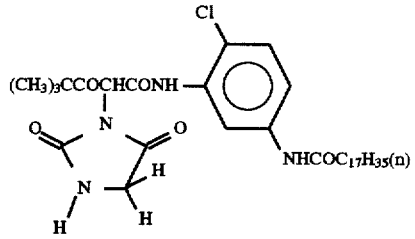
Y-13
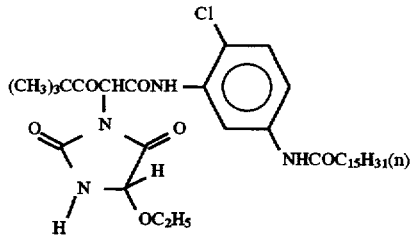
Y-14
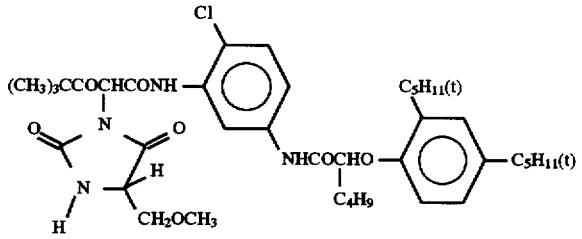
Y-15
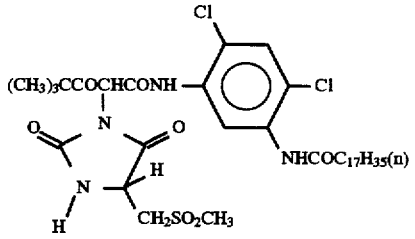
Y-16
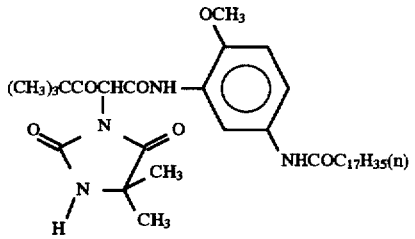

-continued
Y-17
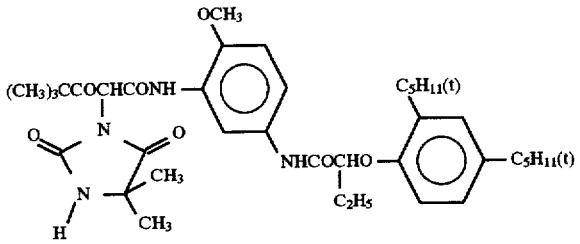
Y-18
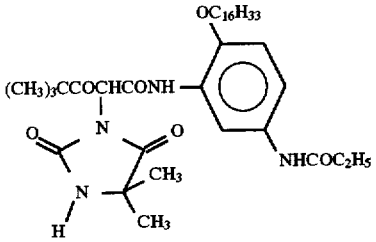
Y-19
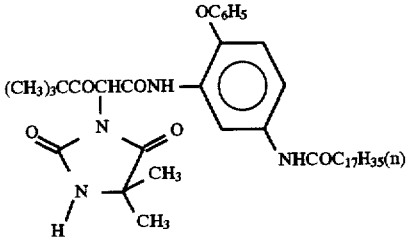
Y-20
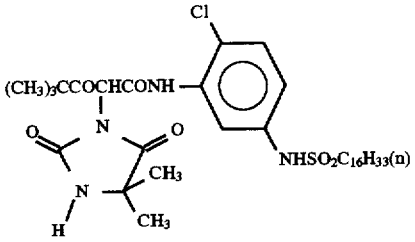
Y-21
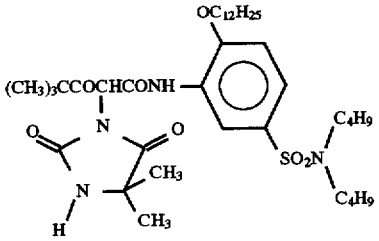
Y-22
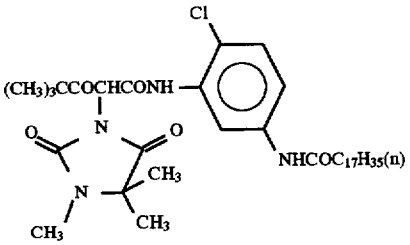

-continued
Y-23
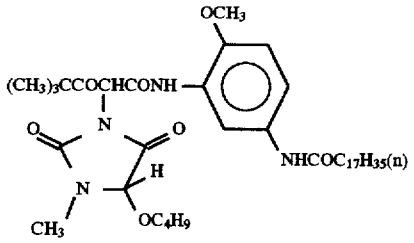
Y-24
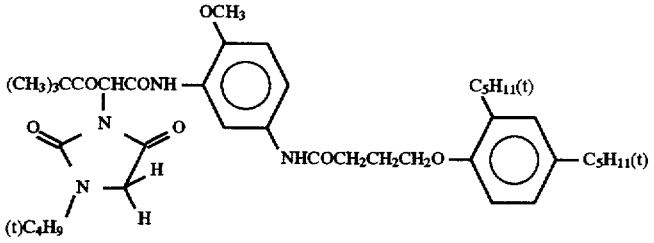
Y-25
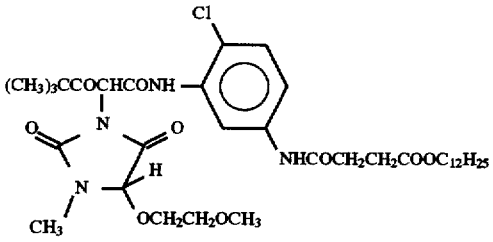
Y-26
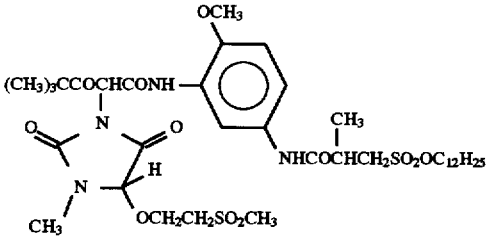
Y-27
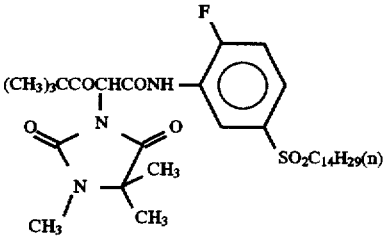
Y-28
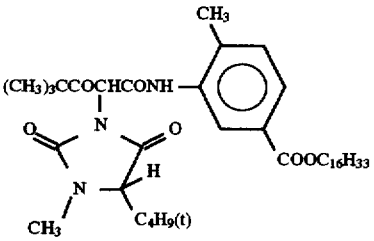

-continued
Y-29
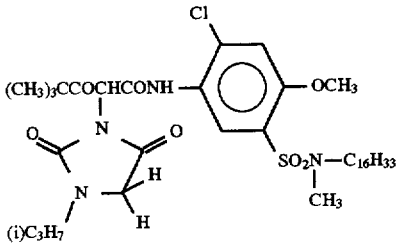
Y-30
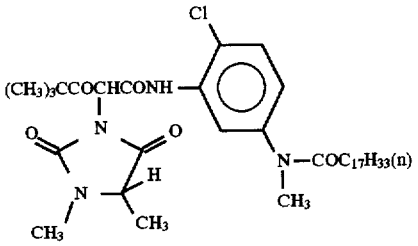
Y-31
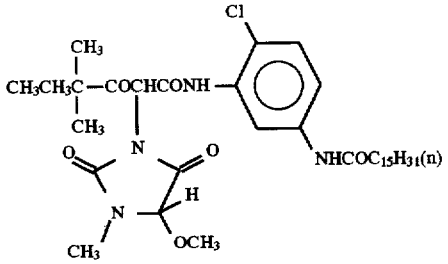
Y-32
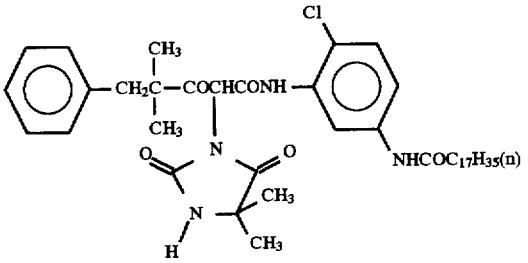
Y-33
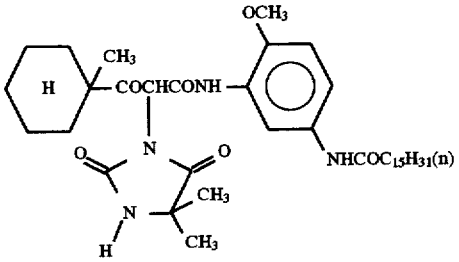
Y-34
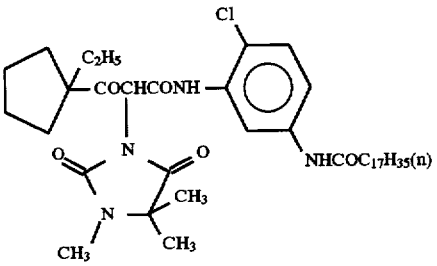

-continued
Y-35
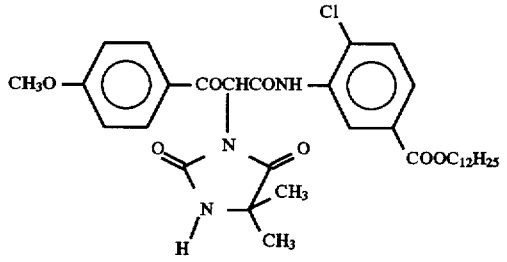
Y-36
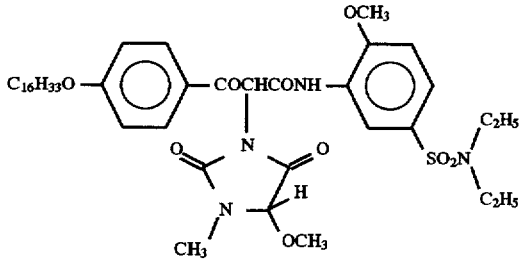
Y-37
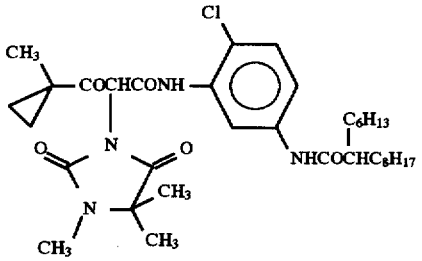
Y-38
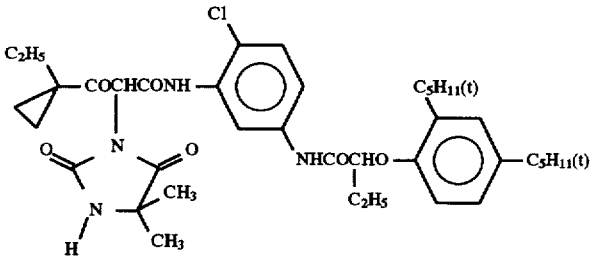
Y-39
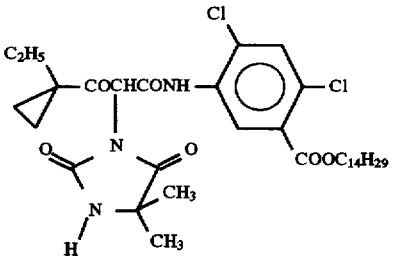
Y-40
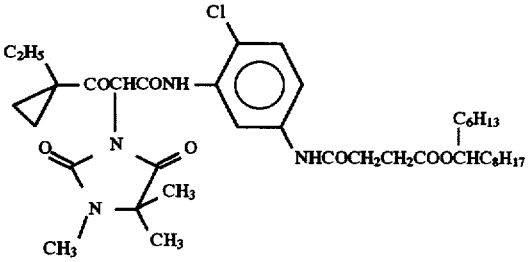

-continued
Y-41
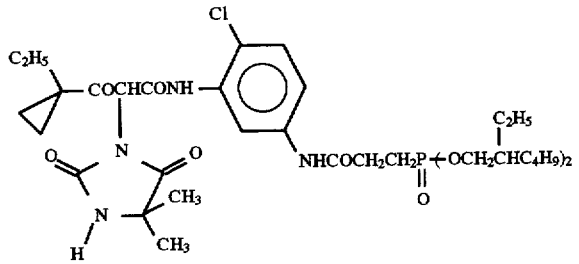
Y-42
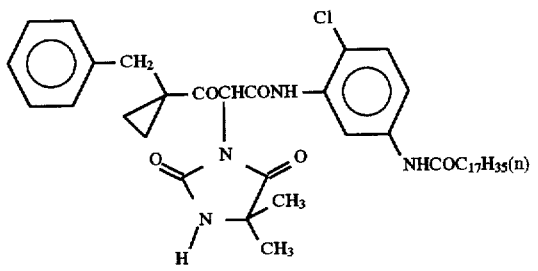
Y-43
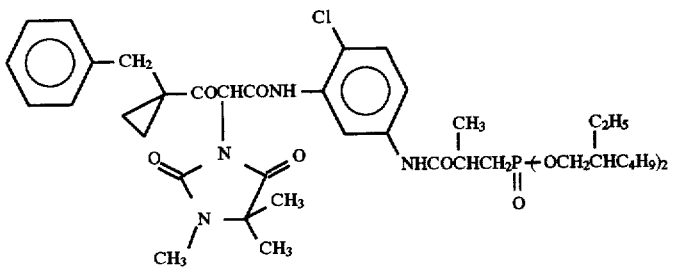
Y-44
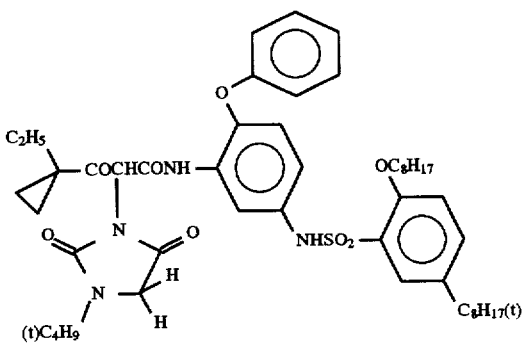
Y-45
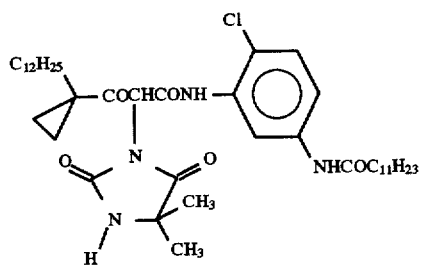
Y-46
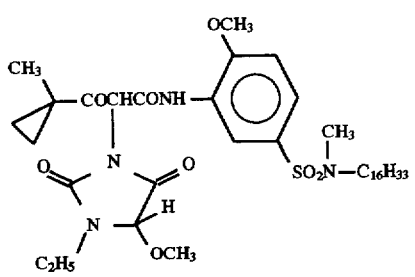

-continued
Y-47
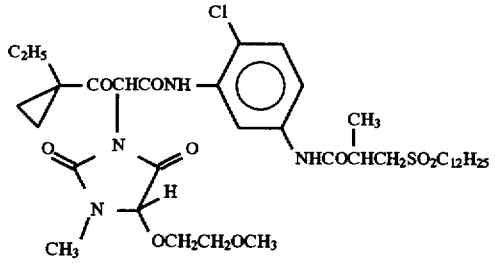
Y-48
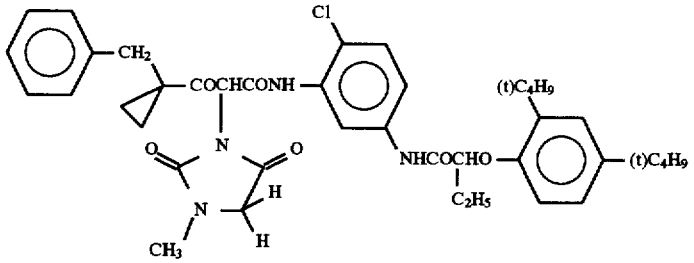
Y-49
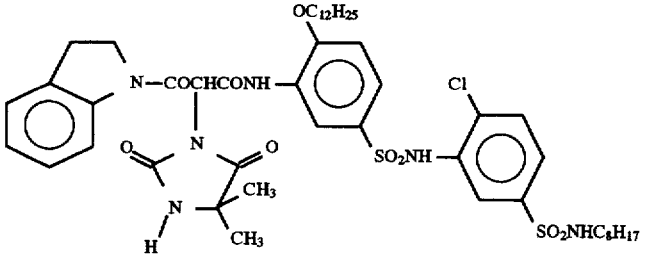
Y-50
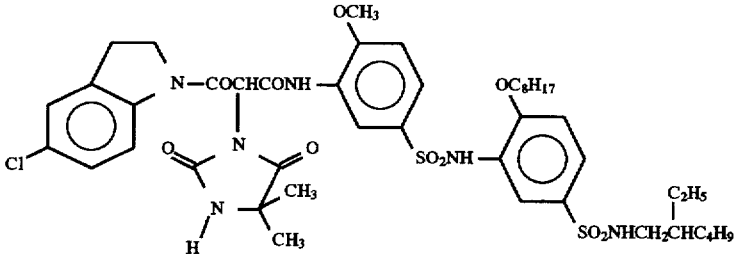
Y-51
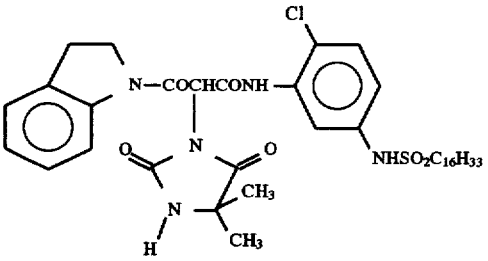
Y-52
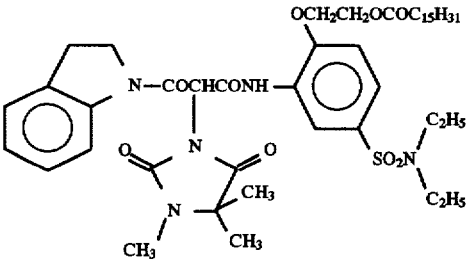

-continued
Y-53
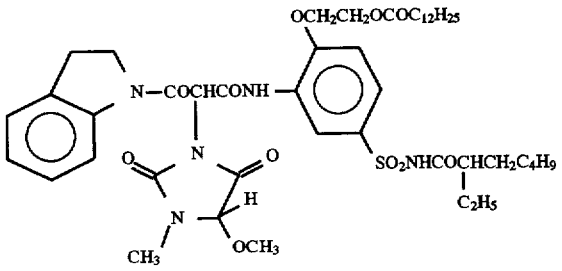
Y-54
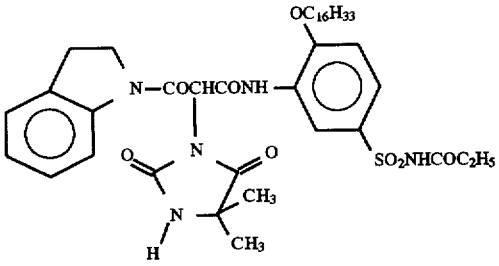
Y-55
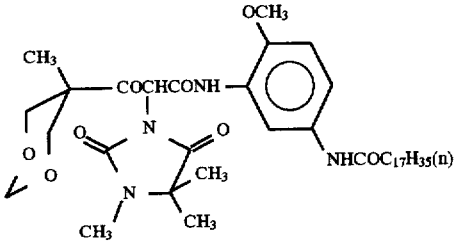
Y-56
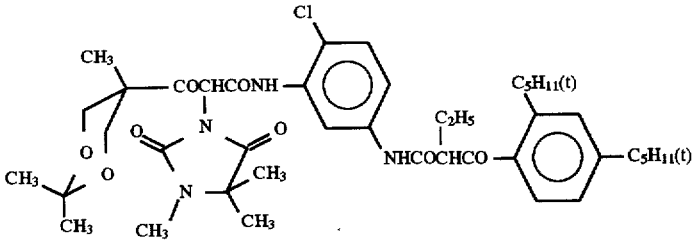
Y-57
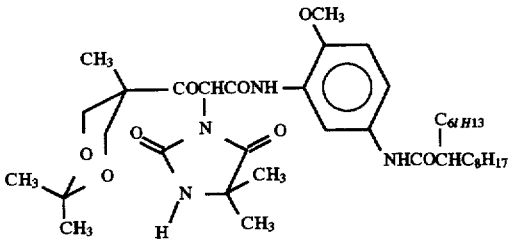
Y-58
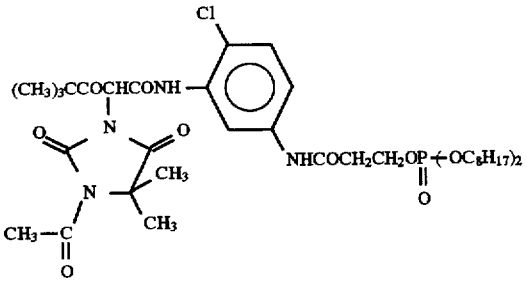

-continued
Y-59
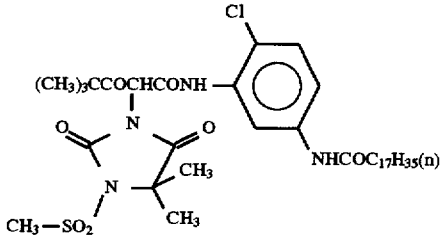
Y-60
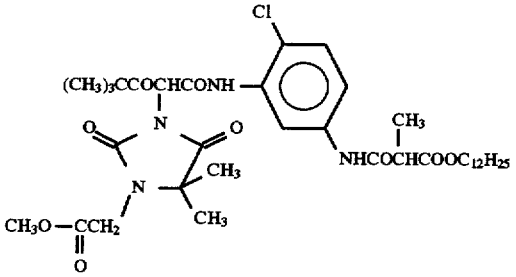
Y-61
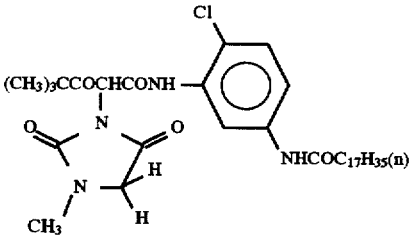
Y-62
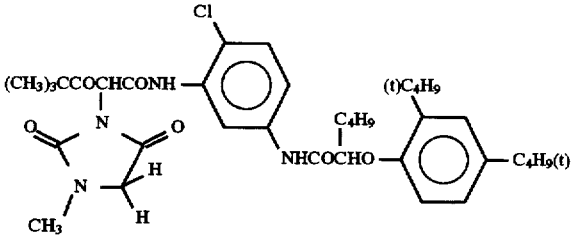
Y-63
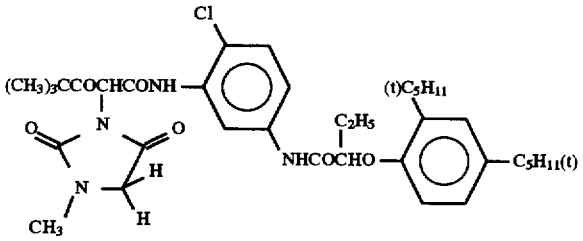
Y-64
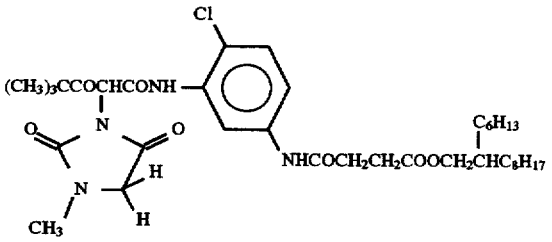

-continued
Y-65
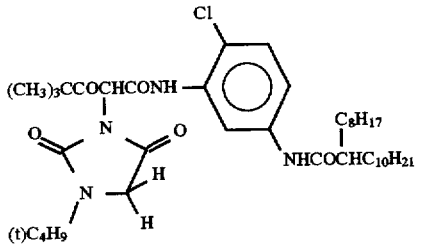
Y-66
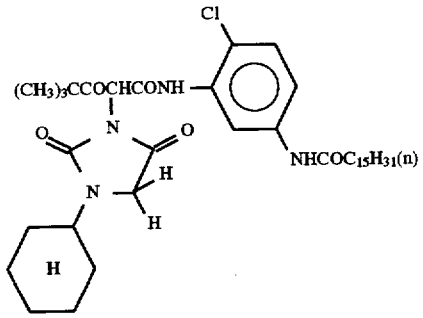
Y-67
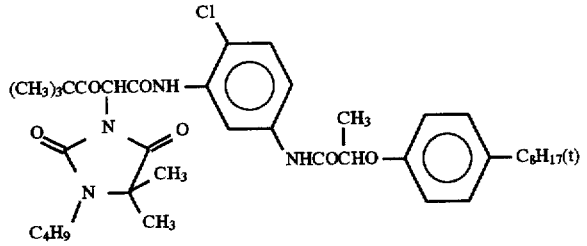
Y-68
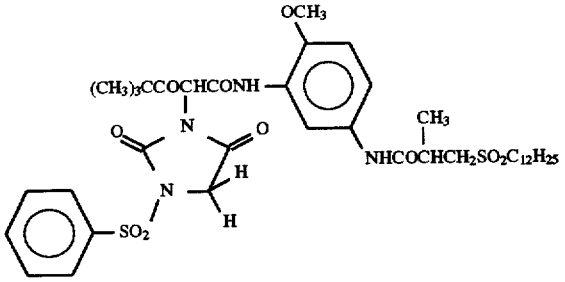
Y-69
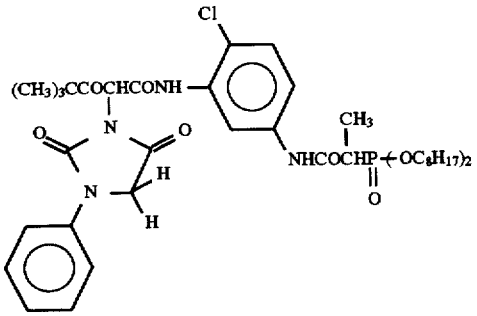
Y-70
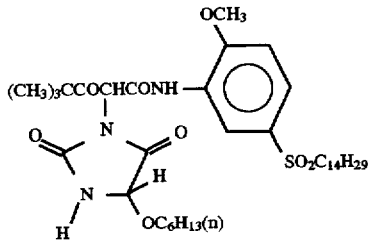

-continued

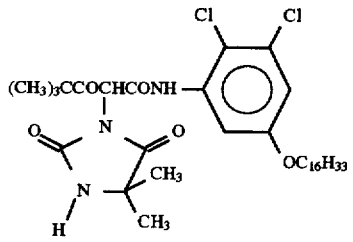

Y-71

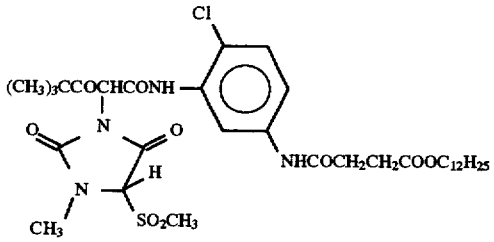

Y-72

The preferred range of the non-coloring compounds represented by formula (A) or (B) of the present invention will be explained in detail below.

In formula (A), Q represents a nonmetallic atomic group necessary for forming a 5- to 7-membered ring together with a nitrogen atom. Specifically, the ring is formed by any one or more of a carbon atom, an oxygen atom, a sulfur atom or a phosphorus atom, other than a nitrogen atom, e.g., piperidine, piperazine, morpholine, and thiomorpholine can be cited. Further, the ring formed by Q may be substituted. $R_{11}$ represents a substituted or unsubstituted alkyl group having from 1 to 30 carbon atoms, a substituted or unsubstituted aryl group having from 6 to 30 carbon atoms or a substituted or unsubstituted alkoxyl group having from 1 to 30 carbon atoms.

In formula (B), $R_{22}$ represents the same group as $R_{11}$ in formula (A). $R_{21}$ represents a hydrogen atom or an alkyl group having from 1 to 24 carbon atoms. $R_{23}$ represents a hydrogen atom, a hologen atom (eg., fluorine, bromine, chlorine), an alkyl group having from 1 to 24 carbon atoms, an alkoxyl group having from 1 to 24 carbon atoms, an acylamino group having from 2 to 36 carbon atoms or a sulfonamido group having from 2 to 36 carbon atoms. $X_1$ represens a hydrogen atom or a substituent, and examples of substituents are the same as those enumerated as the substituents for A in formula (Y).

In formula (A), Q preferably represents a nonmetallic atomic group necessary for forming a 6-membered ring together with a nitrogen atom, and $R_{11}$ preferably represents a substituted or unsubstituted alkyl group.

In formula (B), $R_{22}$ preferably represents a substituted or unsubstituted alkyl group, and $R_{23}$ preferably represents an alkoxyl group or an acylamino group.

The compound represented by formula (A) or (B) is more preferably represented by formula (A-1) or (B-1), respectively.

In formula (A-1), $R_{11}$ represents an alkyl group, an aryl group or an alkoxyl group, preferably a substituted or unsubstituted alkyl group having from 4 to 24 carbon atoms, and more preferably an unsubstituted alkyl group or a substituted alkyl group substituted with an aryloxy group, an ester group, an amido group, a sulfonyl group, phosphoryl group or an alkoxyl group. Above all, a branched alkyl group is most preferred. In particular, an α-branched alkyl group is preferred, and further a case in which a branched alkyl group is bonded is especially preferred.

In formula (B-1), $R_{21}$ and $R_{24}$ each represents a hydrogen atom or an alkyl group, and $R_{22}$ and $R_{25}$ each represents an alkyl group, an aryl group or an alkoxyl group. $R_{22}$ and $R_{24}$ each preferably represents a hydrogen atom or a methyl group, and $R_{22}$ and $R_{25}$ each preferably represents a substituted or unsubstituted alkyl group having from 4 to 24 carbon atoms, more preferably a branched alkyl group.

Specific examples of the compounds represented by formulae (A) and (B) are shown below, but the present invention is not limited thereto.

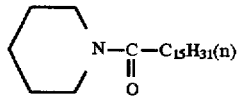

A-1

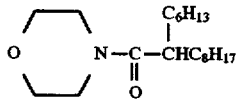

A-2

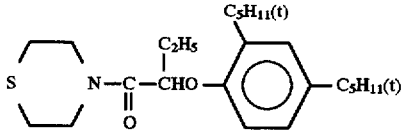

A-3

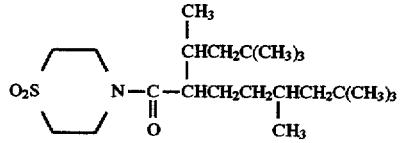

A-4

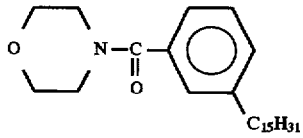

A-5

-continued
A-6
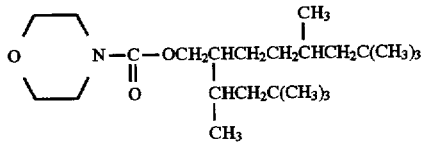
A-7
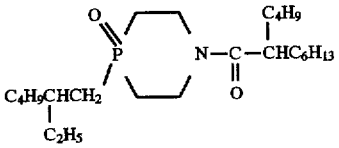
A-8
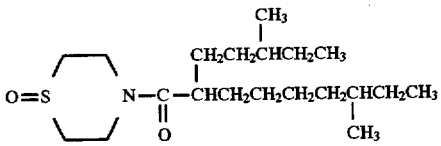
A-9
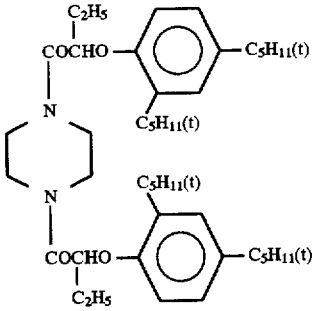
A-10
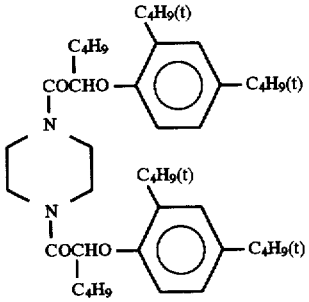
A-11
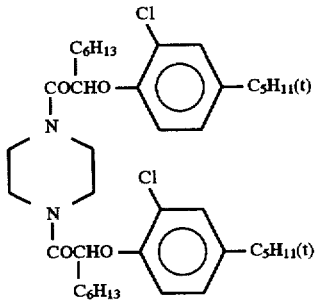
A-12
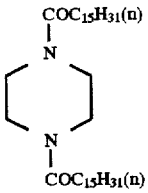
-continued
A-13
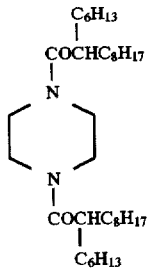
A-14
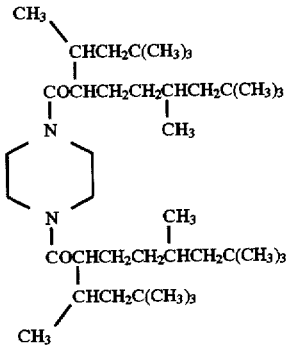
A-15
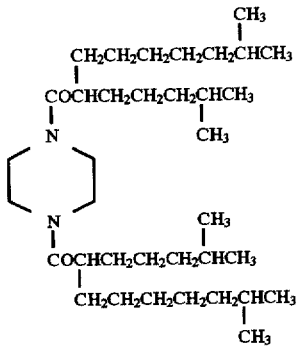
A-16
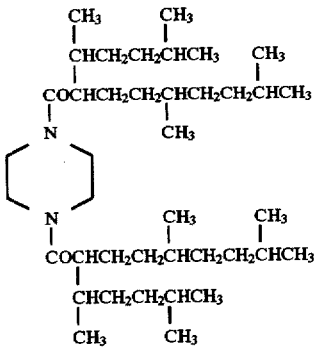
A-17
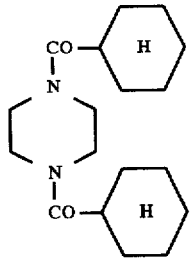

-continued
A-18
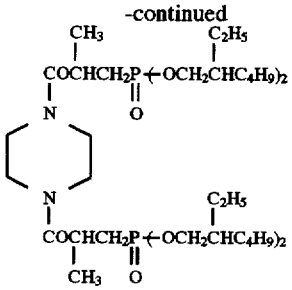
A-19
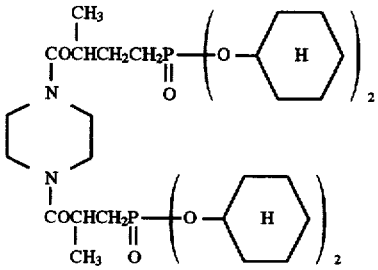
A-20
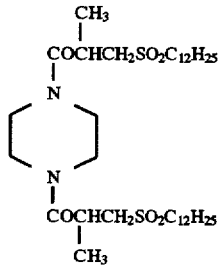
A-21
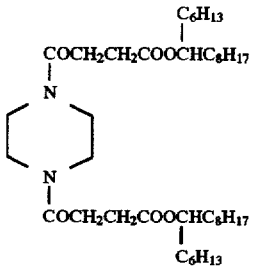
A-22
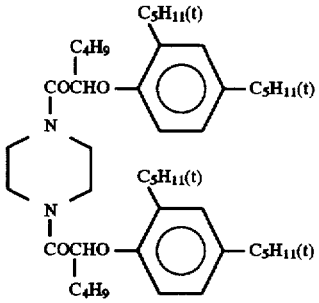
A-23
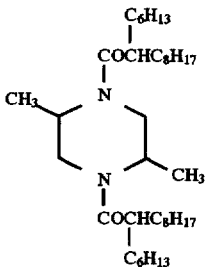
-continued
A-24
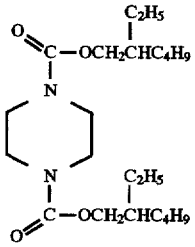
A-25
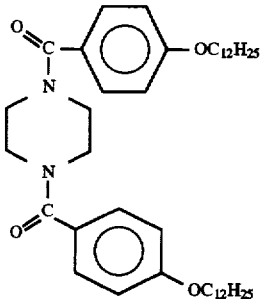
B-1
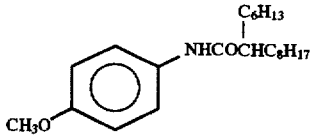
B-2
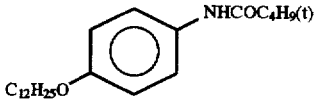
B-3
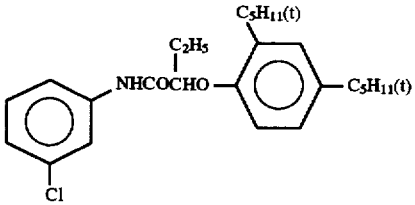
B-4
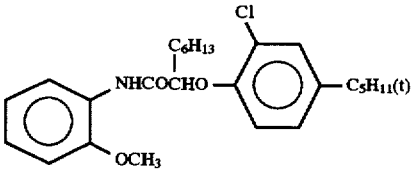
B-5
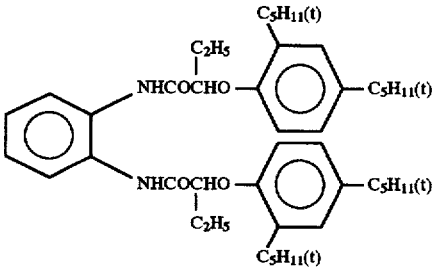

-continued
B-6
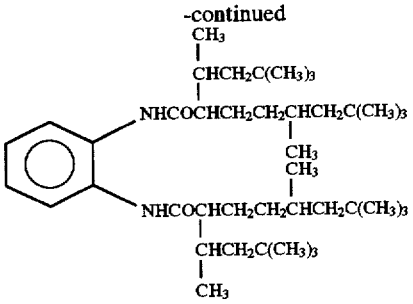
B-7
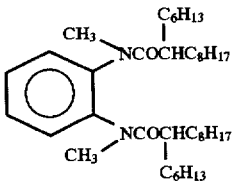
B-8
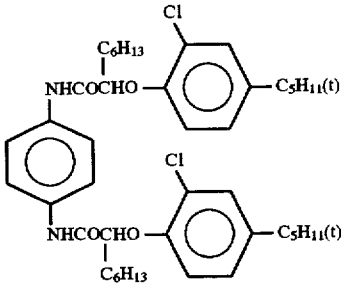
B-9
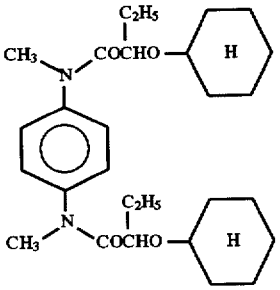
B-10
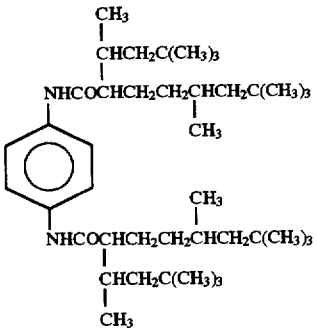
B-11
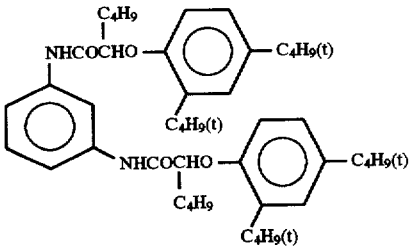
-continued
B-12
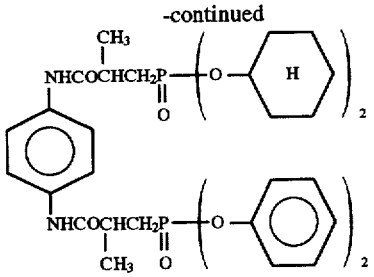
B-13
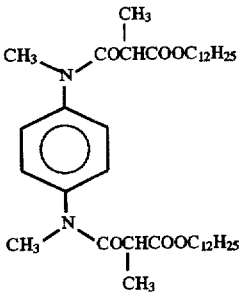
B-14
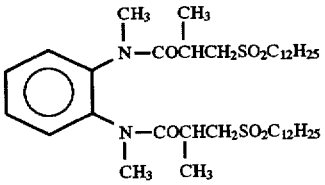
B-15
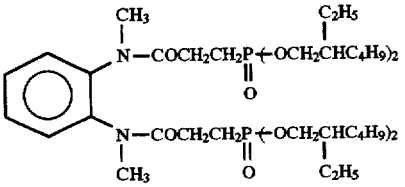
B-16
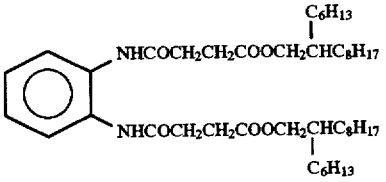
B-17
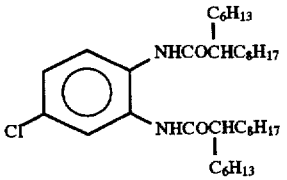
B-18
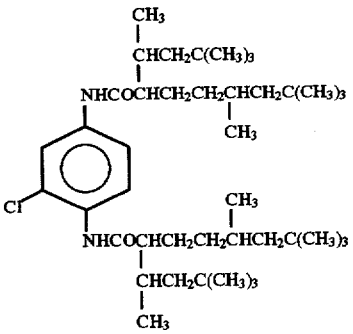

The preferred range of the compounds represented by formula (C) will be explained in detail below.

In formula (C), $R_{31}$ represents a hydrogen atom or an alkyl group having from 1 to 20 carbon atoms, and the alkyl group may be either straight chain (e.g., methyl, ethyl, propyl, butyl, octyl, dodecyl) or branched chain (e.g., i-propyl, sec-butyl, t-octyl), but a branched chain alkyl group is particularly preferred. Further, the alkyl group may further have a substituent on the alkyl chain, and an alkoxyl group, an alkoxycarbonyl group, a sulfonyl group or a phosphoryl group is preferred as such a substituent. $R_{32}$ and $R_{34}$ each represents an alkyl group having from 1 to 20 carbon atoms, but when $R_{31}$ represents a hydrogen atom, $R_{32}$ and $R_{34}$ each preferably represents a tertiary alkyl group (e.g., t-butyl, 1-methylcyclohexyl), and when $R_{31}$ represents an alkyl group, $R_{32}$ and $R_{34}$ each preferably represents a primary or secondary alkyl group (e.g., methyl, ethyl, i-propyl, cyclohexyl, sec-butyl).

$R_{33}$ and $R_{35}$ each represents an alkyl group having from 1 to 20 carbon atoms. The total carbon atoms of the alkyl groups represented by $R_{31}$, $R_{32}$, $R_{33}$, $R_{34}$ and $R_{35}$ are preferably 40 or less, more preferably 30 or less, still more preferably 24 or less.

A methyl group connecting two phenol rings is preferably bonded to either the ortho position or the para position of each phenol ring. When the methyl group is bonded to the phenol ring at the ortho position, $R_{33}$ or $R_{35}$ is preferably bonded to the para position, and when a methyl group is bonded at the para position of the phenol ring, $R_{33}$ or $R_{35}$ is preferably bonded to the meta position.

Specific examples of the compounds represented by formula (C) are shown below, but the present invention is not construed as being limited thereto.

C-1

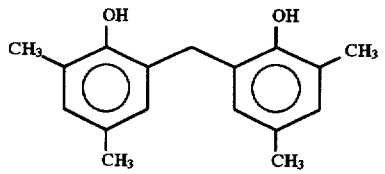

C-2

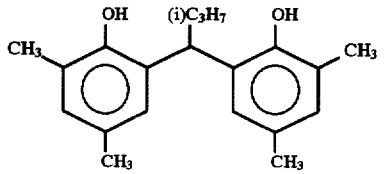

C-3

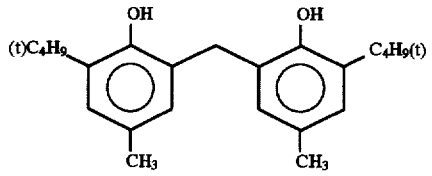

C-4

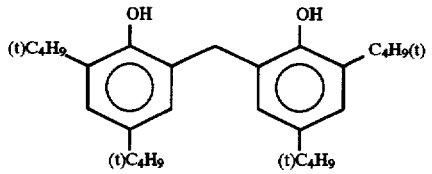

-continued

C-5

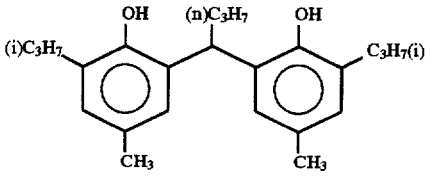

C-6

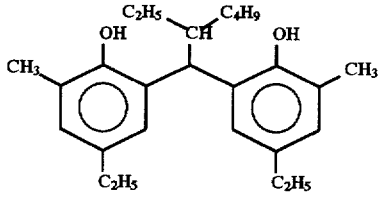

C-7

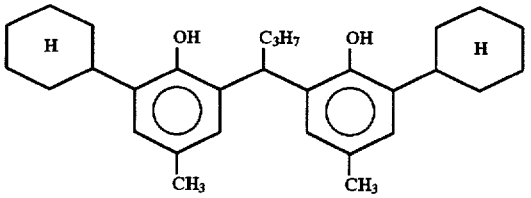

C-8

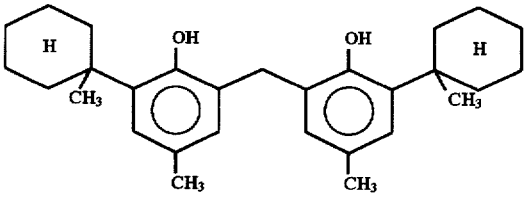

C-9

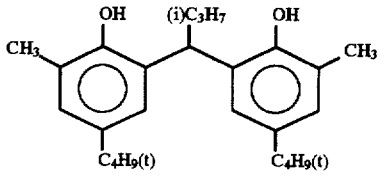

C-10

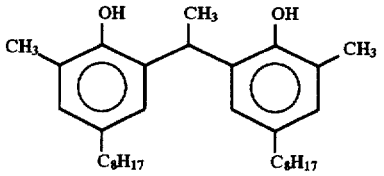

C-11

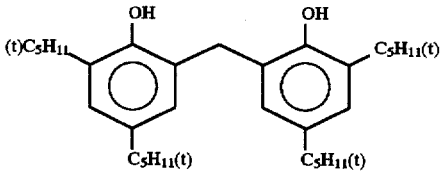

C-12

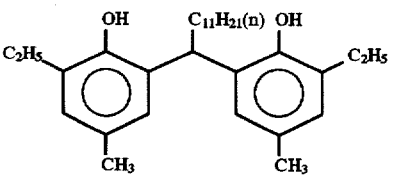

-continued

C-13

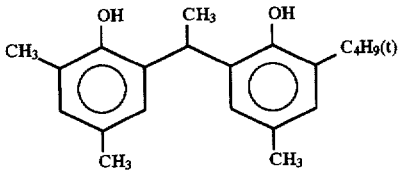

C-14

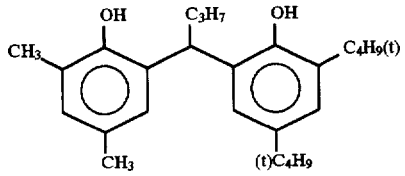

C-15

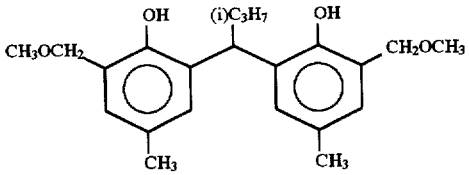

C-16

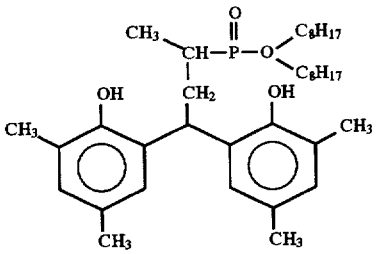

C-17

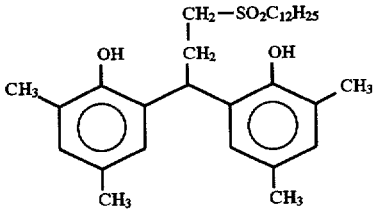

C-18

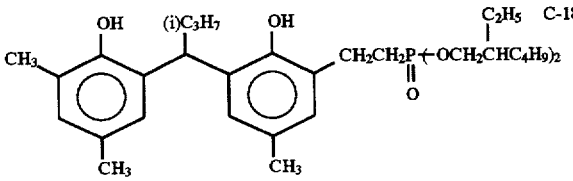

C-19

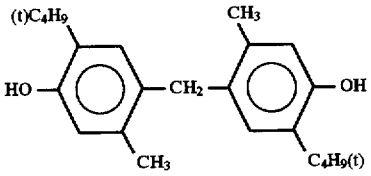

-continued

C-20

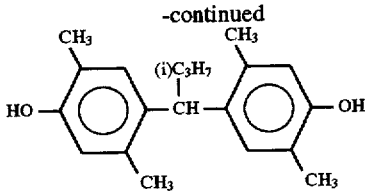

C-21

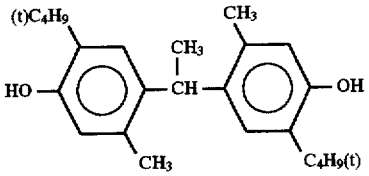

C-22

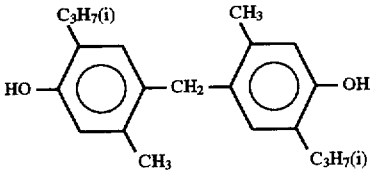

C-23

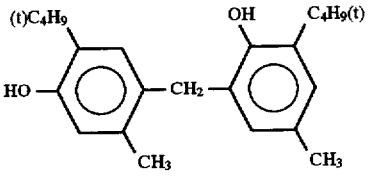

C-24

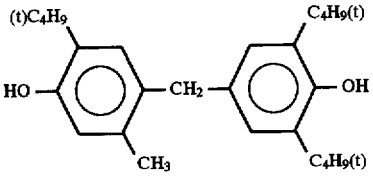

The preferred range of the compounds represented by formula (D) will be explained in detail below.

In formula (D), $R_{41}$ and $R_{42}$ each represents an alkyl group having from 1 to 24 carbon atoms or an aryl group, and $R_{43}$ and $R_{44}$ each represents an alkyl group having from 1 to 24 carbon atoms. These alkyl and aryl groups may further have substituents, and examples of substituents for these groups are the same as those enumerated as the substituents for A in formula (Y).

At least any two of $R_{41}$, $R_{42}$, $R_{43}$ and $R_{44}$ may be bonded to form a ring. The total carbon atoms of $R_{41}$, $R_{42}$, $R_{43}$ and $R_{44}$ are preferably from 10 to 60, more preferably from 16 to 40.

Specific examples of the compounds represented by formula (D) are shown below.

D-1

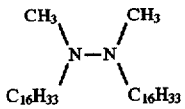

-continued
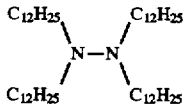
D-2
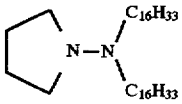
D-3
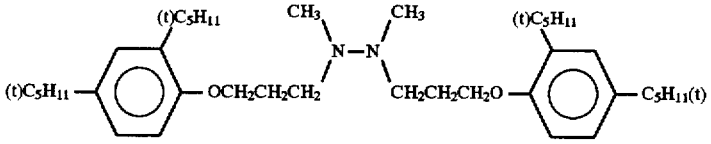
D-4
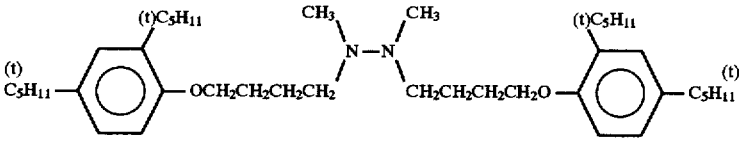
D-5
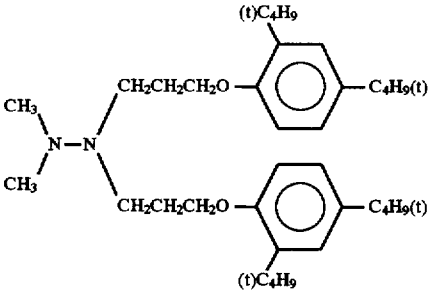
D-6
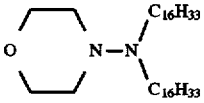
D-7
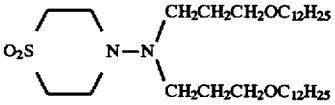
D-8
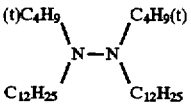
D-9
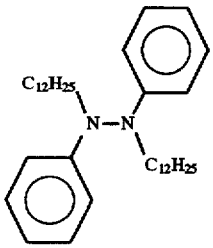
D-10

-continued

D-11

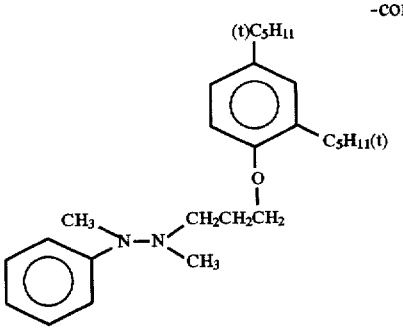

D-12

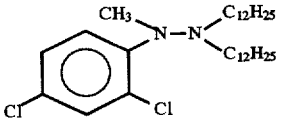

D-13

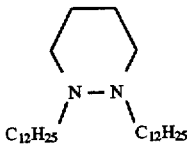

D-14

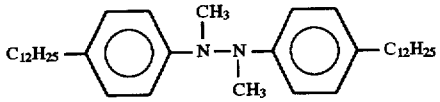

D-15

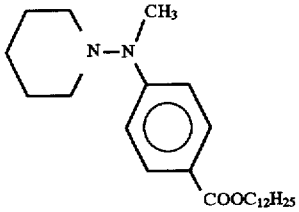

D-16

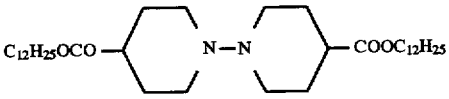

D-17

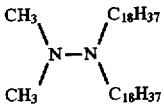

D-18

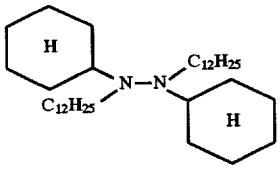

D-19

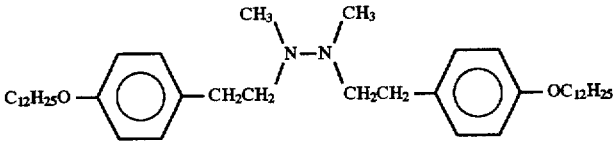

The preferred range of the compounds represented by formula (E) will be explained in detail below.

In formula (E), $R_{51}$ and $R_{52}$ each represents an alkyl group having from 1 to 24 carbon atoms or an alkoxyl group. $R_{51}$ and $R_{52}$ each preferably represents an alkyl group, more preferably at least one of $R_{51}$ and $R_{52}$ represents a tertiary alkyl group. Particularly preferred combination is the case in which both of them represent t-butyl groups, and the case in which one represents a t-butyl group and the other represents a methyl group. $R_{53}$ represents an alkyl group, an alkoxycarbonyl group, an aryloxycarbonyl group or a carbamoyl group and each group preferably has from 8 to 40 carbon atoms. Preferred of them is an alkyl group or an aryloxycarbonyl group. The polymer compound obtained by bonding two or more residues of formula (E) via an $R_{53}$ is also preferred constitution.
Specific examples of the compounds represented by formula (E) are shown below.
E-1
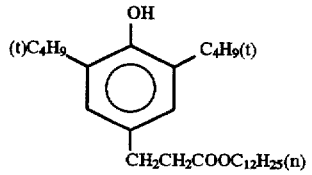
E-2
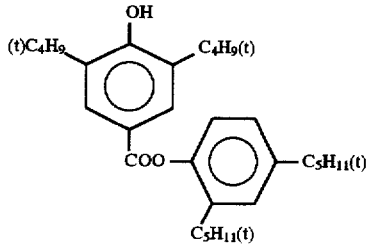
E-3
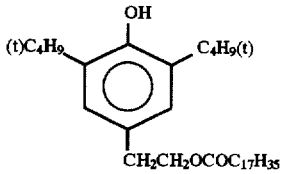
E-4
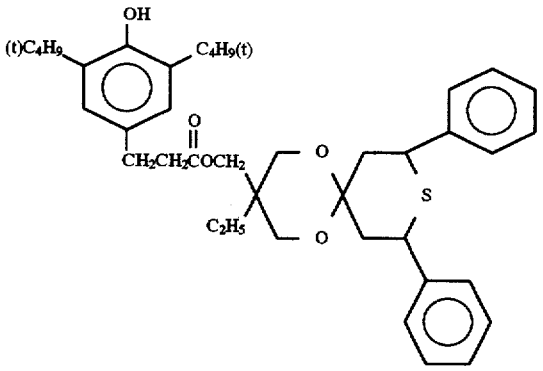
E-5
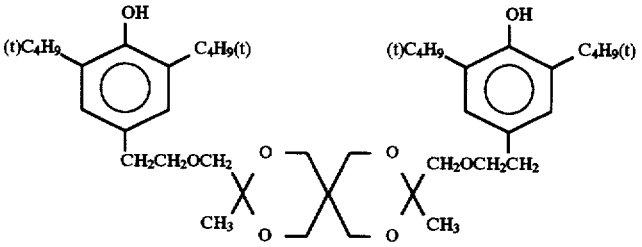
E-6
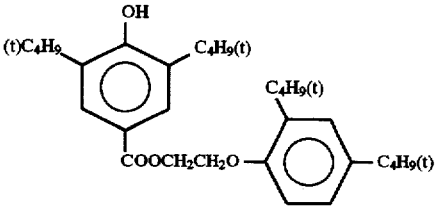

-continued
E-7
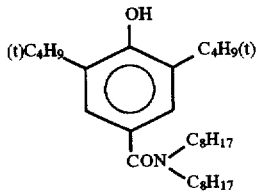
E-8
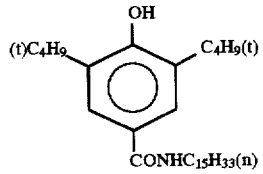
E-9
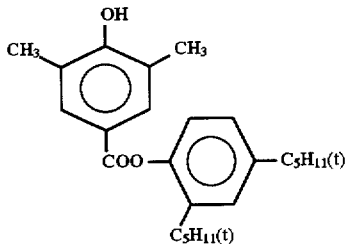
E-10
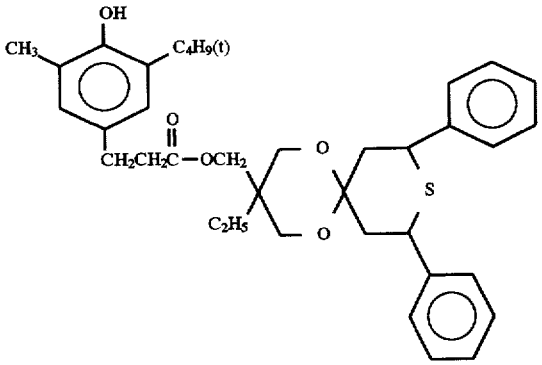
E-11
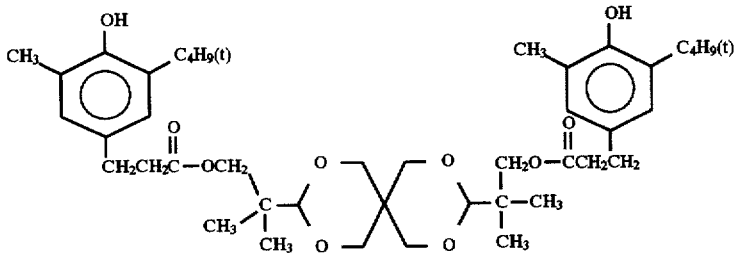
E-12
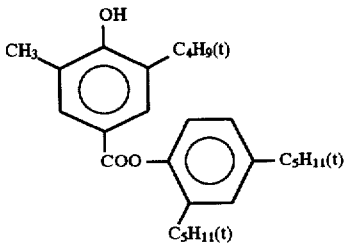

-continued

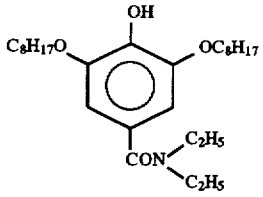

E-13

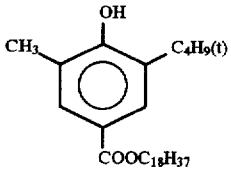

E-14

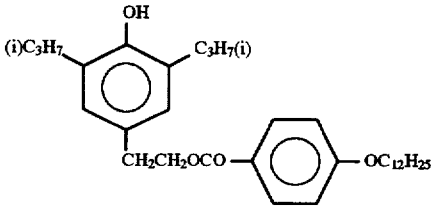

E-15

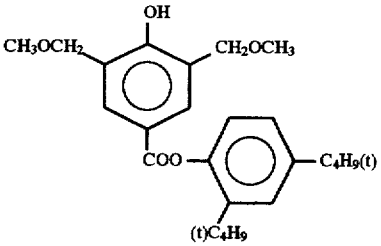

E-16

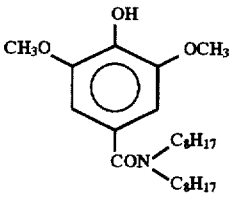

E-17

In formula (F), $R_{61}$, $R_{62}$, $R_{63}$ and $R_{64}$ each preferably represents an alkoxyl group having from 1 to 20 carbon atoms, a substituted or unsubstituted amino group defined as above, or an acyloxy group, more preferably an alkoxyl group having from 1 to 10 carbon atoms. $R_{65}$, $R_{66}$, $R_{67}$ and $R_{68}$ each preferably represents a hydrogen atom or an alkyl group having from 1 to 20 carbon atoms, more preferably a hydrogen atom or an alkyl group having from 1 to 4 carbon atoms, and still more preferably a methyl group. The total carbon atoms of $R_{61}$, $R_{62}$, $R_{63}$, $R_{64}$, $R_{65}$, $R_{66}$, $R_{67}$ and $R_{68}$ are preferably from 4 to 48, more preferably from 8 to 36.

Specific examples of the compounds represented by formula (F) are shown below.

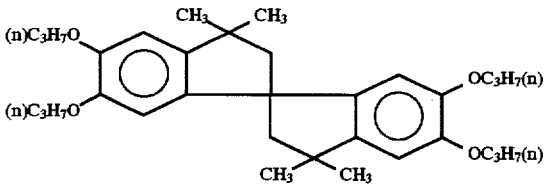

F-1

-continued
F-2
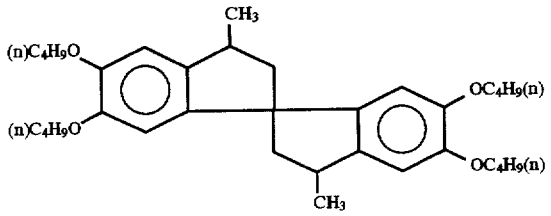
F-3
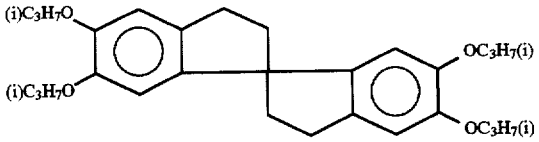
F-4
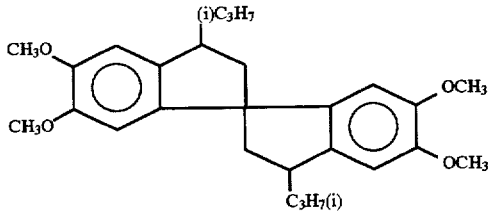
F-5
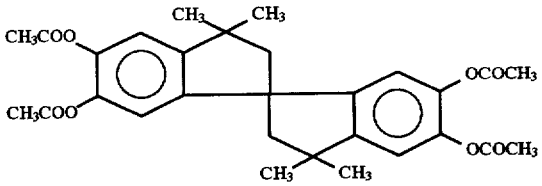
F-6
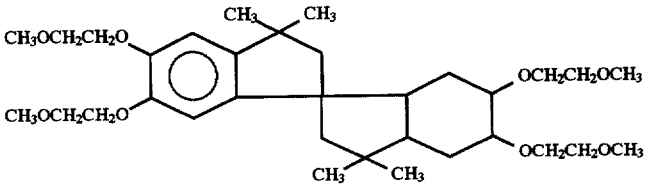
F-7
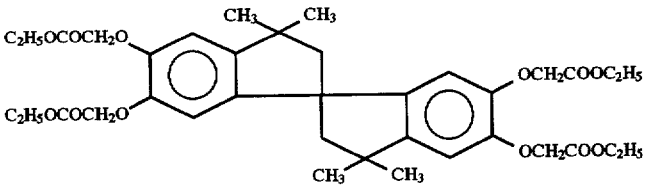
F-8
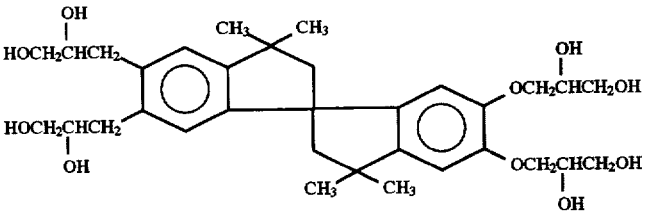
F-9
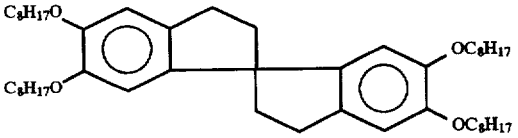

-continued
F-10
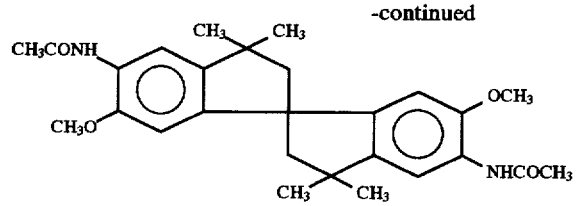
F-11
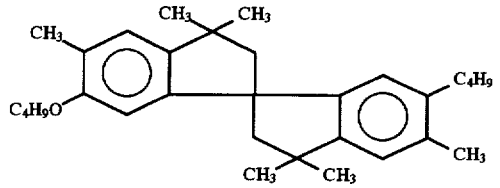
F-12
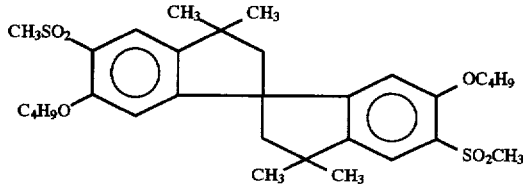
F-13
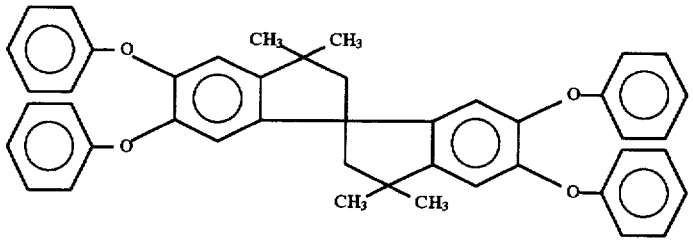
F-14
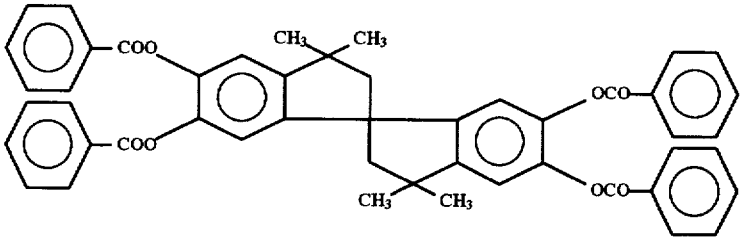
F-15
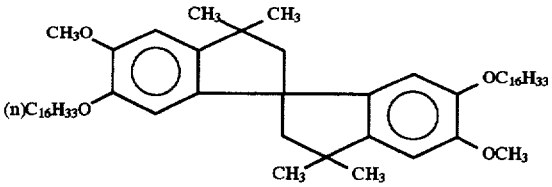
F-16
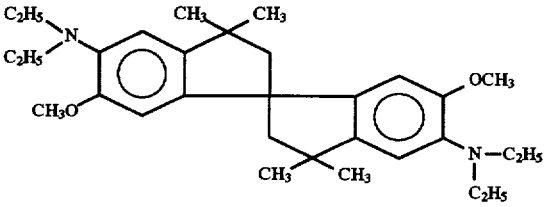
F-17
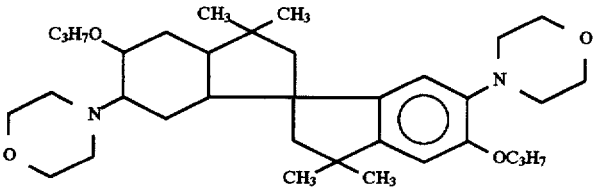

-continued

F-18

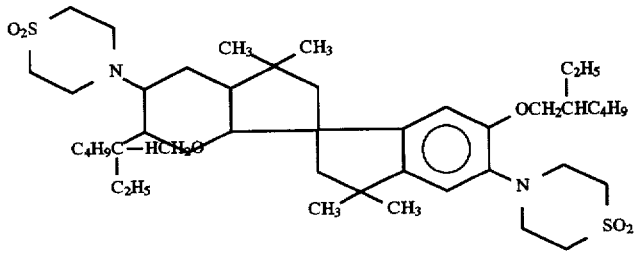

F-19

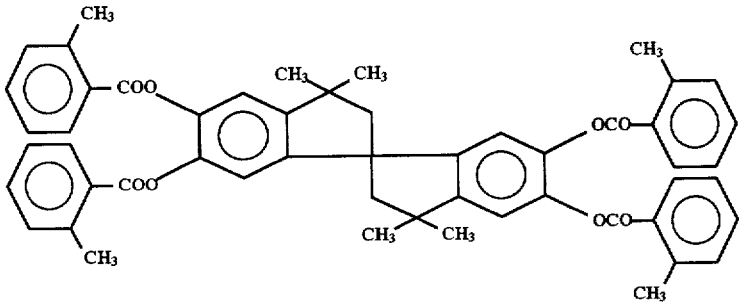

F-20

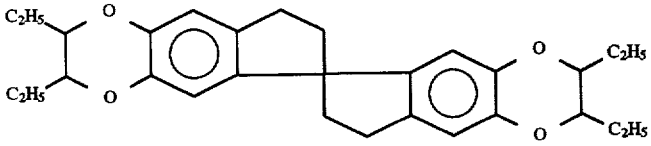

In formula (G), $R_{71}$ and $R_{72}$ each preferably represents an alkyl group having from 1 to 24 carbon atoms, an alkenyl group or an aryl group, more preferably an alkyl group having from 1 to 18 carbon atoms or an alkenyl group.

$R_{73}$ and $R_{74}$ each preferably represents a hydrogen atom, an alkyl group, a halogen atom (e.g., fluorine, bromine, chlorine), or a sulfonyl group, more preferably a hydrogen atom or an alkyl group having from 1 to 18 carbon atoms.

$R_{71}$ and $R_{73}$, or $R_{72}$ and $R_{74}$ may be bonded via a suitable group to form a ring. The ring is preferably a 5- to 7-membered ring, and may have a substituent on the ring. Compounds having such a ring structure are also preferably used in the present invention. The total carbon atoms of $R_{71}$, $R_{72}$, $R_{73}$ and $R_{74}$ are preferably from 4 to 48, more preferably from 8 to 36.

Specific examples of the compounds represented by formula (G) are shown below.

G-1

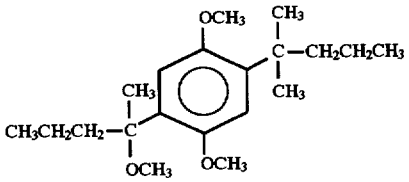

G-2

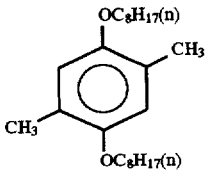

-continued

G-3

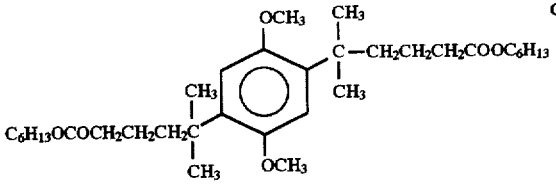

G-4

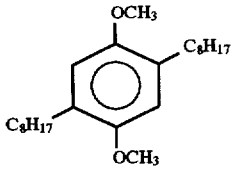

G-5

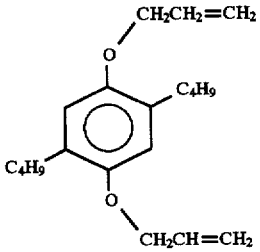

G-6

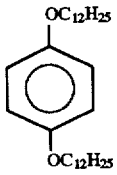

-continued

G-7

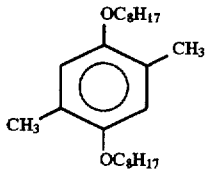

G-8

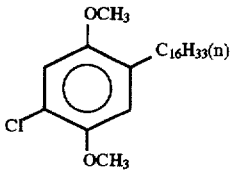

G-9

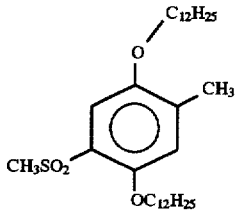

G-10

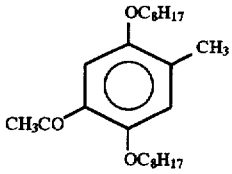

G-11

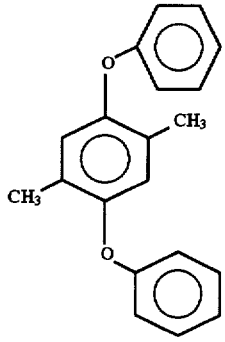

G-12

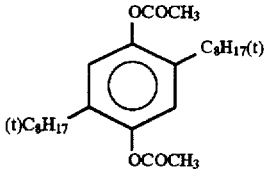

G-13

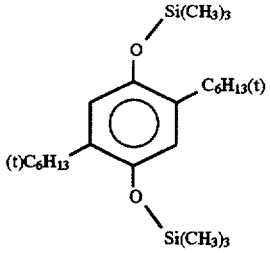

-continued

G-14

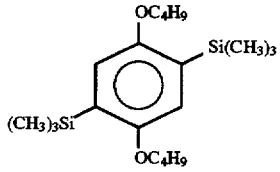

G-15

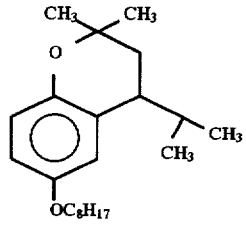

G-16

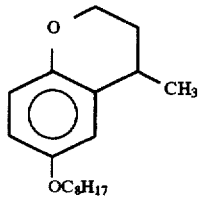

G-18

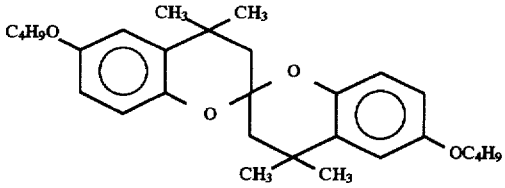

G-18

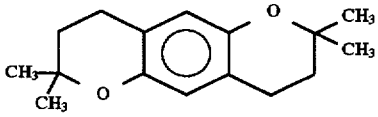

G-19

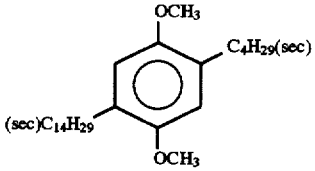

In formula (H), $R_{81}$ preferably represents an alkyl group having from 1 to 24 carbon atoms, an alkenyl group, an acyl group or an aryl group, more preferably an alkyl group having from 1 to 18 carbon atoms or an alkenyl group.

$R_{82}$ and $R_{83}$ each preferably represents an alkyl group having from 1 to 24 carbon atoms, an alkenyl group, an acyl group or an aryl group, more preferably an alkyl group having from 1 to 18 carbon atoms or an alkenyl group.

$R_{81}$ and $R_{84}$, $R_{82}$ and $R_{83}$, or $R_{82}$ and $R_{84}$ can be bonded each other to form a ring structure via a suitable group. The ring is preferably a 5- to 7-membered ring, and may have a substituent on the ring. Compounds having such a ring structure are also preferably used in the present invention.

When either of $R_{82}$ or $R_{83}$ represents an acyl group, $R_{84}$ represents an alkoxyl group. Excluding this case, $R_{84}$ preferably represents a hydrogen atom, a halogen atom (e.g., fluorine, bromine, chlorine), an alkyl group or an alkoxyl group, and preferred carbon atoms are from 1 to 24. The total carbon atoms of $R_{81}$, $R_{82}$, $R_{83}$ and $R_{84}$ are preferably from 3 to 48, more preferably from 6 to 36.

Specific examples of the compounds represented by formula (H) are shown below.

H-1
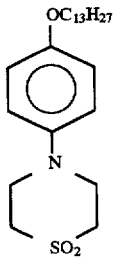
H-2
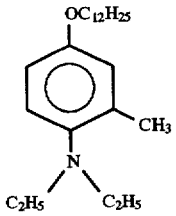
H-3
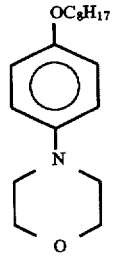
H-4
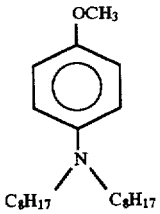
H-5
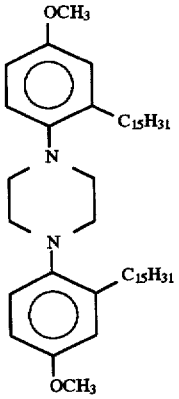
H-6
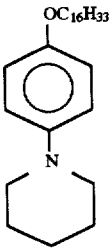
-continued
H-7
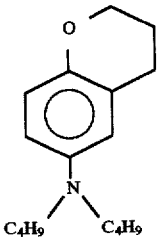
H-8
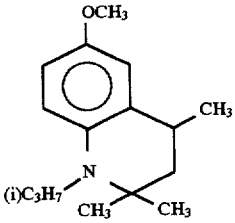
H-9
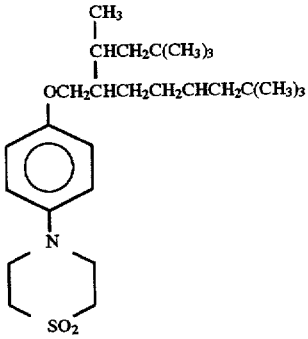
H-10
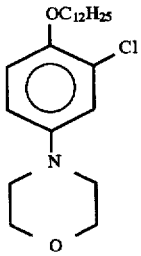
H-11
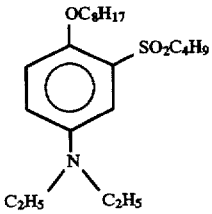
H-12
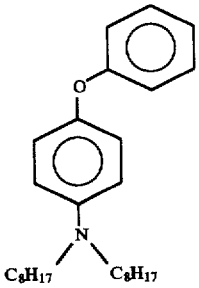

-continued

H-13

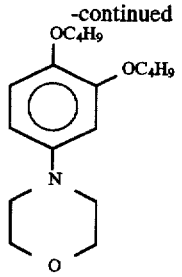

H-14

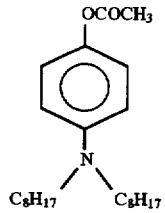

H-15

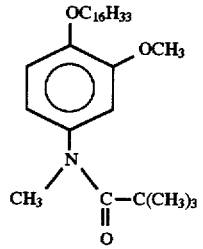

H-16

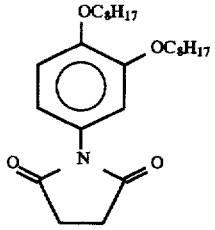

H-17

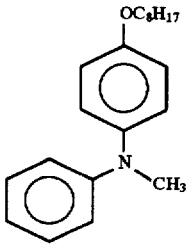

H-18

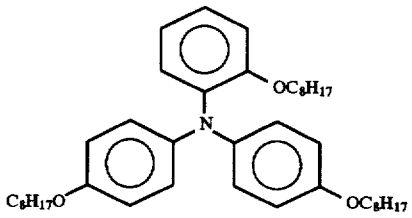

When the yellow coupler of the present invention is incorporated into a silver halide color photographic material, it is sufficient that at least one layer on a support contains the coupler of the present invention. Any hydrophilic colloid layer on a support may contain the coupler of the present invention, but it is preferably used in a light-sensitive silver halide emulsion layer, above all, a blue-sensitive silver halide emulsion layer is preferred.

In the present invention, various known methods can be used to incorporate the coupler into a hydrophilic colloid layer. In general, an oil-in-water dispersing method known as an oil-protect method is effectively used for the addition. That is, the coupler is dissolved in a high boiling point organic solvent and a low boiling point auxiliary solvent, then dispersed in an aqueous solution of gelatin containing a surfactant. The high boiling point organic solvent preferably has 160° C. or more of boiling point at normal pressure and includes those disclosed in U.S. Pat. No. 2,322,027, such as phthalates, phosphates, sulfonamides, alcohols, phenols, hydrocarbons, or chloroparafins.

The coupler of the present invention is used in an amount of from 0.01 to 5 mmol/$m^2$, preferably from 0.1 to 2 mmol/$m^2$. The coupler of the present invention can be used in combination with known yellow couplers. In such a case, it is preferred that the coupler of the present invention is used in proportion of 30 mol % or more.

Silver halide emulsion is used preferably in an amount of from 1 to 20 mol, more preferably from 2 to 10 mol, and still more preferably from 2.5 to 5 mol, per mol of the total yellow coupler.

The compound represented by formula (A) or (B) of the present invention can be preferably used in weight ratio of from 0.01 to 2.0, more preferably from 0.05 to 1.5, still more preferably from 0.1 to 1.0, based on the total yellow coupler.

The compound represented by formula (C), (D) or (E) of the present invention is used in proportion of from 1 to 500 mol %, preferably from 5 to 200 mol %, more preferably from 10 to 100 mol %, and still more preferably from 20 to 60 mol %, based on the total yellow coupler.

The compound represented by formula (F), (G) or (H) of the present invention is used in proportion of from 1 to 500 mol %, preferably from 5 to 200 mol %, and more preferably from 10 to 100 mol %, based on the total yellow coupler. The compound represented by formula (F), (G) or (H) can be used alone, but it is particularly preferred to use in combination with any compound represented by formula (C), (D) or (E).

The compounds represented by formula (A) to (H) can be dissolved and dispersed (co-emulsified) in an appropriate solvent together with the coupler at the time of emulsifying dispersion.

In the silver halide color photographic material of the present invention, a high boiling point organic solvent is used in weight ratio of from 0 to 5.0, preferably from 0 to 2.0, more preferably from 0 to 1.0, and still more preferably from 0.05 to 0.5, based on the yellow coupler.

In the silver halide color photographic material of the present invention, gelatin is preferably used as a hydrophilic binder and the amount used is from 3 to 20 g/$m^2$, preferably 7.5 g/$m^2$ or less, more preferably 7.0 g/$m^2$ or less, and still more preferably 6.5 g/$m^2$ or less.

When the addition amount of each of the coupler of the present invention, the compounds represented by formulae (A) to (H), a high boiling point organic solvent and a hydrophilic binder is less than each lower limit, the desired effect cannot be obtained (for example, the coupler cannot provide sufficient color density). On the contrary, if each amount exceeds its upper limit, not only satisfactory effect cannot be obtained, but also various problems arise such that the amount used of a high boiling point organic solvent for these compounds increases, as a result, the quality of a film is deteriorated, the thickness of a film increases and development is degraded, and the sharpness of images is deteriorated.

The color photographic material of the present invention comprises a support having coated thereon at least one yellow coloring silver halide emulsion layer, at least one magenta coloring silver halide emulsion layer, and at least one cyan coloring silver halide emulsion layer. In a color photographic paper for general use, color reproduction can be effected according to the subtractive color process by incorporating into silver halide emulsion layers color couplers capable of forming dyes having a complementary color relationship to light to which the corresponding silver halide emulsion is sensitized. In a typical color photographic paper, silver halide emulsion grains are spectrally sensitized in the above described order of the color forming layers by blue-sensitive, green-sensitive, and red-sensitive spectral sensitizing dyes and coated on a support in the above described order. However, the coating can be effected by different orders. That is, there are cases when the light-sensitive layer containing the silver halide grains having the largest average grain size is preferred to be uppermost layer from the viewpoint of rapid processing or when the magenta coloring light-sensitive layer is preferred to be undermost layer considering the storage stability under light irradiation.

Further, a constitution of a different correspondence of a light-sensitive layer to a hue of developed color from those described above may be employed, and at least one infrared-sensitive silver halide emulsion layer can be provided.

Any supports, e.g., glass, paper, and plastic films, can be used in the present invention as long as photographic emulsion layers can be coated thereon, but a reflective support is most preferred.

A reflective support for use in the present invention is a support having high reflectivity for clearly viewing color images formed in the silver halide emulsion layer, for example, a support coated with a hydrophobic resin having dispersed therein a light reflective material such as titanium oxide, zinc oxide, calcium carbonate, calcium sulfate, and a support comprised a hydrophobic resin per se having dispersed therein a light reflective material. Examples of such supports include polyethylene coated papers, polyethylene terephthalate coated papers, polypropylene based synthetic papers, transparent supports provided with a reflective layer or using in combination with a reflective material, e.g., a glass plate, polyester films such as polyethylene terephthalate, cellulose triacetate or cellulose nitrate, polyamide films, polycarbonate films, polystyrene films and vinyl chloride resins. The reflective support for use in the present invention is a paper support both surfaces of which are coated with waterproof resin layers, and it is preferred that at least one of the waterproof resin layers contain fine grains of a white pigment.

The waterproof resin for the reflective support of the present invention is a resin having a water absorption rate (wt %) of 0.5, preferably 0.1 or less, e.g., polyolefin such as polyethylene, polypropylene, polyethylene based polymers, vinyl polymer and copolymers thereof (polystyrene, polyacrylate and copolymers thereof), polyester (polyethylene terephthalate, polyethylene isophthalate) and copolymers thereof. Polyethylene and polyester are particularly preferred.

High density polyethylene, low density polyethylene, linear low density polyethylene and mixtures of these polyethylene resins can be used as polyethylene. Melt flow rate (hereinafter abbreviated to MFR) of these polyethylene resins before processing is preferably 1.2 g/10 min. to 12 g/10 min. measured according to JIS K7210, Table 1, Condition 4. MFR of a polyethylene resin before processing used herein means MFR of a resin before kneading a blueing agent or white pigment.

The polyesters synthesized by condensation polymerization of dicarboxylic acid and diol are preferred as polyesters, and preferred examples of dicarboxylic acids include terephthalic acid, isophthalic acid, naphthalene-dicarboxylic acid, etc. Preferred examples of diols include ethylene glycol, butylene glycol, neopentyl glycol, triethylene glycol, butanediol, hexylene glycol, ethylene oxide addition product of bisphenol A (2,2-bis[4-(2-hydroxyethyloxy)phenyl] propane), 1,4-dihydroxymethylcyclohexane, etc.

Various polyesters obtained by condensation polymerization of alone or mixtures of the above dicarboxylic acids and alone or mixtures of the above diols can be used. It is preferred that at least one of dicarboxylic acids is terephthalic acid. A mixture of terephthalic acid and isophthalic acid (mixing ratio: 9/1 to 2/8) or a mixture of terephthalic acid and naphthalenedicarboxylic acid (mixing ratio: 9/1 to 2/8) is also preferably used as a dicarboxylic acid component. Ethylene glycol or mixed diol containing ethylene glycol is preferably used as diol. Molecular weight of these polymers is preferably from 30,000 to 50,000.

Mixtures of a plurality of polyesters having different compositions are also preferably used. Further, mixtures of these polyesters and other resins are also preferably used. Other resins to be used can be selected widely from resins capable of being extruded at 270° to 350° C., for example, polyolefins such as polyethylene and polypropylene, polyethers such as polyethylene glycol, polyoxy methylene and polyoxy propylene, polyester based polyurethane, polyether polyurethane, polycarbonate, polystyrene, etc. These resins to be mixed may be one kind or may be two or more kinds. For example, it is possible to mix 90 wt % of polyethylene terephthalate with 6 wt % of polyethylene and 4 wt % of polypropylene. The mixing ratio of polyester with other resins varies depending on the kinds of resins to be mixed, but in the case of polyolefins, polyester/polyolefins in weight ratio of 100/0 to 80/20 is appropriate. If the mixing ratio exceeds this range, the physical properties of the mixed resin suddenly lowers. In the case of resins other than polyolefins, mixture of polyester/other resins in weight ratio of 100/0 to 50/50 is available.

The mixing ratio of the above waterproof resins with a white pigment is in weight ratio of from 98/2 to 30/70 (waterproof resin/white pigment), preferably from 95/5 to 50/50, and particularly preferably from 90/10 to 60/40. If the amount of a white pigment is less than 2 wt %, sufficient whiteness cannot be obtained, whereas when it exceeds 70 wt %, the surface smoothness as a photographic support is not sufficient, accordingly, a photographic support having excellent glossiness cannot be obtained.

These waterproof resins are preferably coated on a support in a thickness of from 2 to 200 μm, more preferably from 5 to 80 μm. If the thickness exceeds 200 μm, a physical problem arises such that the resin becomes fragile and liable to crack, whereas when it is thinner than 2 μm, not only the waterproof ability which is the original function of the coating is impaired, but also whiteness and surface smoothness cannot be satisfied at the same time, and is not desired also physically as the resin becomes too soft.

The thickness of the resin or resin composition coated on the side opposite to the light-sensitive layer side of the support is preferably from 5 to 100 μm, more preferably from 10 to 50 μm. If the thickness exceeds 100 μm, a physical problem arises such that a resin becomes fragile and liable to crack, whereas when it is thinner than 5 μm, a waterproof ability which is the original function of the coating is impaired, and is not desired also physically as the resin becomes too soft.

In the reflective support of the present invention, it is in some case preferred from the economical viewpoint and the productivity of the support that the waterproof resin-coated layer on the light-sensitive layer-coated side of the reflective support comprises two or more layers having different contents of a white pigment. In such a case, it is preferred that, of the waterproof resin-coated layers having different contents of a white pigment, the content of the white pigment of the waterproof resin-coated layer nearest to the support is smaller than that of at least one waterproof resin-coated upper layer. As further preferred examples, there can be cited a reflective support which comprises waterproof resin-coated layers having different content of a white pigment and the content of the white pigment of the waterproof resin-coated layer nearest to the light-sensitive layer is highest, and a reflective support which comprises at least three waterproof resin-coated layers and the content of the white pigment of the waterproof resin-coated layer of any of intermediate layers, other than the waterproof resin-coated layer nearest to the light-sensitive layer and the waterproof resin-coated layer nearest to the support of the multilayer waterproof resin layers, is highest.

The content of the white pigment of each layer in the multilayer waterproof resin layers is from 0 to 70 wt %, preferably from 0 to 50 wt %, and more preferably from 0 to 40 wt %. Further, of the multilayer waterproof resin layers, the content of the white pigment of the layer having the highest content is from 9 to 70 wt %, preferably from 15 to 50 wt %, and more preferably from 20 to 40 wt %. If the content of the white pigment of this layer is less than 9 wt %, the sharpness of images is low, and if it exceeds 70 wt %, a melt extruded film generates film crack.

The thickness of each layer in the multilayer waterproof resin layers is preferably from 0.5 to 50 μm. For example, in the case of the multilayer waterproof resin layers of two-layer structure, the thickness of each layer is preferably from 0.5 to 50 μm, and the total film thickness preferably falls within the above range (2 to 200 μm). In the case of three-layer structure, it is preferred that the thickness of the uppermost layer is from 0.5 to 10 μm, the interlayer from 5 to 50 μm, and the lowermost layer (the layer nearest to the support) from 0.5 to 10 μm. When the thickness of the uppermost and lowermost layers is 0.5 μm or less, die lip streaks are liable to be generated due to the action of the white pigment filled in the interlayer in high rate. On the other hand, the thickness of the uppermost and lowermost layers, in particular, the uppermost layer, is 10 μm or more, the sharpness of images are reduced.

The fine grains of the white pigment are preferred to be dispersed uniformly in the reflective layer not to be agglomerated. The size of the distribution can be obtained by measuring the proportion Ri (%) of the area occupied by the fine grains projected in each unit area. The variation coefficient of the proportions of the occupied areas (%) can be determined as a ratio of the standard deviation (s) of Ri to the mean value of Ri (R), that is, s/R. In the present invention, the variation coefficient of the proportions of the occupied areas (%) of the fine grains of the pigment is preferably 0.15 or less, more preferably 0.12 or less, and particularly preferably 0.08 or less.

In the present invention, a support having a surface of diffuse reflectivity of the second class is preferably used. Diffuse reflectivity of the second class means the diffuse reflectivity obtained by giving concave and convex to the mirror surface to divide it to fine mirror surfaces facing different directions, and dispersing the directions of the fine mirrors divided. The concave and convex of the surface of diffuse reflectivity of the second class have three dimensional average roughness to the center plane of from 0.1 to 2 μm, preferably from 0.1 to 1.2 μm. The frequency of the concave and convex of the surface, with respect to the concave and convex having a roughness of 0.1 μm or more, is preferably from 0.1 to 2,000 cycle/mm, and more preferably from 50 to 600 cycle/mm. Such a support is described in detail in JP-A-2-239244.

In the present invention, silver chloride, silver chlorobromide, or silver chloroiodobromide grains having a silver chloride content of 95 mol % or more is preferably used as silver halide grains. In particular, in order to expedite the development processing time, grains comprising silver chlorobromide or silver chloride substantially free of silver iodide are preferably used in the present invention. The terminology "substantially free of silver iodide" as used herein means that the silver iodide content is 1 mol % or less, preferably 0.2 mol % or less. On the other hand, for purposes of raising high illumination intensity sensitivity, enhancing spectral sensitization sensitivity, or increasing aging stability of photographic materials, high silver chloride grains containing from 0.01 to 3 mol % of silver iodide on the surface of the emulsion are preferably used in some cases as disclosed in JP-A-3-84545. The halide composition of the emulsion may be the same or different among grains, however, when emulsions having the same halide composition among grains are used, it is easy to homogenize the properties of grains. Also, with respect to the distribution of the halide composition inside of the silver halide emulsion grains, the grains may have a so-called uniform type structure where any portion of the silver halide grains has the same composition, the grains may have a so-called laminate type structure where the halide composition is different between the inside of the grains (core) and the shell (single layer or a plurality of layers) surrounding the core, or the grains may have such a structure that non-layered portions different in the halide composition are present inside the grains or on the surface of the grains (when present at the surface of the grains, the portions are conjugated at edges, corners or on planes), and these grains can be arbitrarily selected depending on the purposes. For attaining high sensitivity, either of the latter two cases is advantageously used rather than the grains of the uniform type structure and is also preferred in view of When the silver halide grains have either of the above described structures, the boundary between portions different in the halide compositions may be clear, or may be unclear because of mixed crystals formed due to difference in the halide composition. Further, the boundary may have sequential structural change provided positively.

The high silver chloride emulsion for use in the present invention preferably has such a structure that a silver bromide localized phase of layer or non-layer form is present inside and/or on the surface of the silver halide grains as described above. The halide composition of the above described localized phases is preferably such that the silver bromide content is at least 10 mol %, more preferably exceeding 20 mol %. The silver bromide content of the silver bromide localized phases can be analyzed according to the X-ray diffraction method (for example, *Shin-Jikken Kagaku Koza* 6, *Kozo Kaiseki* (*New Experimental Chemistry Course* 6, *Analysis of Structure*), edited by Nippon Kagaku Kai, published by Maruzen) or the like. These localized phases can be present inside the grains, at edges, corners or on planes of the grain surface. One preferred example of the localized phase is that formed by epitaxial growth at the corners of the grains.

Also, it is effective to further increase the silver chloride content of a silver halide emulsion to reduce the replenishing amount of the development processing solution. In such a case, substantially a pure silver chloride emulsion having a silver chloride content of from 98 mol % to 100 mol % is also preferably used.

The silver halide grains contained in the silver halide emulsion for use in the present invention have an average grain size (the grain size herein refers to the diameter of the circle corresponding to the projected area of the grains, and the number average is taken as the average grain size) of preferably from 0.1 μm to 2 μm.

With respect to the distribution of sizes of these grains, a so-called monodisperse emulsion having a variation coefficient (the value obtained by dividing the standard deviation of the grain size distribution by the average grain size) of 20% or less, preferably 15% or less, and more preferably 10% or less, is preferred. For obtaining a wide latitude, it is also preferred to blend the above described monodisperse emulsions in the same layer or superimpose the monodisperse emulsion.

The silver halide grains contained in the photographic emulsion may have a regular crystal form, such as cubic, tetradecahedral, or octahedral, an irregular crystal form, such as spherical, plate-like, or a composite form of these forms. A mixture of grains having various crystal forms may also be used. In the present invention, the grains having the above described regular crystal forms preferably account for 50% or more, preferably 70% or more, more preferably 90% or more. Further, an emulsion in which the proportion of tabular grains having an average aspect ratio (circle corresponding diameter/thickness) of 5 or more, preferably 8 or more, to the entire grains exceeds 50% as a projected area can also be preferably used.

The silver chloride (chlorobromide) emulsion used in the present invention can be prepared according to the methods disclosed, for example, in P. Glafkides, *Chimie et Physique Photographique*, Paul Montel (1967), G. F. Duffin, *Photographic Emulsion Chemistry*, Focal Press (1966), V. L. Zelikman, et al., *Making and Coating Photographic Emulsion*, Focal Press (1964), and so on. That is, any process, such as an acid process, a neutral process, and an ammoniacal process, can be used. A single jet method, a double jet method, and a combination of them are known as methods for reacting a soluble silver salt with a soluble halide, and any of these methods can be used. A method in which silver halide grains are formed in the atmosphere of excessive silver ions (a so-called reverse mixing method) can also be used. Further, a so-called controlled double jet method, which is one form of a double jet method, in which the pAg of the liquid phase in which the silver halide is formed is maintained constant, can also be used. According to this method, a silver halide emulsion having a regular crystal form and substantially a uniform grain size distribution can be obtained.

It is preferred to include different kinds of metal ions or complex ions thereof to the localized phase and its substrate of the silver halide grains of the present invention. Preferred metals are selected from ions or complexes of metals belonging to Group VIII and Group IIb of the Periodic Table, a lead ion and a thallium ion. Ions or complex ions thereof selected from iridium, rhodium, and iron or a combination of these can be mainly used in the localized phase, and metal ions or complex ions thereof selected from osmium, iridium, rhodium, platinum, ruthenium, palladium, cobalt, nickel, and iron or a combination of these can be mainly used in the substrate. The kind and concentration of the metal ions can be varied between the localized phase and the substrate. A plurality of these metals may be used. In particular, it is preferred that iron and iridium compounds are preferred in a silver bromide localized phase.

These metal ion donating compounds are added to a dispersion medium such as an aqueous gelatin solution, an aqueous halide solution, an aqueous silver salt solution or other aqueous solutions during formation of silver halide grains, or silver halide fine grains having incorporated therein metal ions in advance are added and then the fine grains are dissolved, whereby the metal ions are incorporated into the localized phase and/or other portions of the grains (substrate) of the silver halide grains of the present invention.

The metal ions for use in the present invention can be incorporated into the emulsion grains before grain formation, during grain formation, or immediately after grain formation. The time of the incorporation can be varied according to the portion of the grains to which the metal ions are incorporated.

The silver halide emulsions for use in the present invention are generally subjected to chemical sensitization and spectral sensitization.

Chemical sensitization can be performed by effecting chemical sensitization using a chalcogen sensitizer (specifically, sulfur sensitization represented by the addition of an unstable sulfur compound, selenium sensitization using a selenium compound, and tellurium sensitization using a tellurium compound), noble metal sensitization represented by gold sensitization, or reduction sensitization, alone or in combination. Compounds preferably used in chemical sensitization are disclosed in JP-A-62-215272, from page 18, right lower column to page 22, right upper column.

The effect of the constitution of the photographic material of the present invention is more conspicuous when a gold sensitized high silver chloride emulsion is used. The emulsion for use in the present invention is a so-called surface latent image type emulsion in which the latent image is mainly formed on the surface of the grain.

The silver halide emulsion for use in the present invention can contain various compounds or precursors thereof for the purpose of preventing fog or stabilizing photographic performances during manufacture, storage or photographic processing of the photographic material. Specific examples of the compounds preferably used in the present invention are disclosed in JP-A-62-215272, pages 39 to 72. In addition, 5-arylamino-1,2,3,4-thiatriazole compounds (the aryl residue has at least one electron attractive group) disclosed in EP 447647 are also preferably used.

Spectral sensitization is carried out for the purpose of imparting spectral sensitivity in a desired light wavelength region to the emulsion of each layer of the photographic material of the present invention.

Spectral sensitizing dyes which are used in spectral sensitization of blue, green and red regions in the photogdraphic material of the present invention are disclosed in F. M. Harmer, *Heterocyclic Compounds—Cyanine Dyes and Related Compounds*, John Wiley & Sons, New York, London (1964). Specific examples of compounds and spectral sensitizing methods preferably used in the present invention are disclosed in JP-A-62-215272, from page 22, right upper column to page 38. In addition, red-sensitive spectral sensitizing dyes for silver halide emulsion grains having a high silver chloride content disclosed in JP-A-3-123340 are very preferred in view of stability, adsorption strength, and the temperature dependency of exposure, and so on.

In the photographic materials of the present invention, for the purpose of effecting spectral sensitization in infrared region, the sensitizing dyes disclosed in JP-A-3-15049, from page 12, left upper column to page 21, left lower column, JP-A-3-20730, from page 4, left lower column to page 15, left lower column, EP 420011, from page 4, line 21 to page 6, line 54, EP 420012, page 4, line 12 to page 10, line 33, EP 443466, and U.S. Pat. No. 4,975,362, are preferably used.

For the incorporation of these spectral sensitizing dyes into a silver halide emulsion, they may be directly dispersed in the emulsion, or they may be dissolved in a single or mixed solvent of water, methanol, ethanol, propanol, methyl cellosolve, 2,2,3,3-tetrafluoropropanol, etc., then added to the emulsion. Further, as described in JP-B-44-23389 (the term "JP-B" as used herein refers to an "examined Japanese patent publication"), JP-B-44-27555 and JP-B-57-22089, they may be added to an emulsion as an aqueous solution coexisting with acid or base, or may be added to an emulsion as an aqueous solution or colloidal dispersion coexisting with a surfactant as disclosed in U.S. Pat. Nos. 3,822,135 and 4,006,025. Moreover, they may be dissolved in a solvent substantially immiscible with water such as phenoxyethanol, etc., then dispersed in water or a hydrophilic colloid, and added to the emulsion. Alternatively, as disclosed in JP-A-53-102733 and JP-A-58-105141, they may be directly dispersed in a hydrophilic colloid and the dispersion may be added to the emulsion. The time of the addition to the emulsion may be at any stage of the preparation of the emulsion known as useful hitherto, that is, before grain formation of silver halide emulsion, during grain formation, immediately after grain formation and before washing step, before chemical sensitization, during chemical sensitization, immediately after chemical sensitization until solidifying the emulsion by cooling, or during preparation of a coating solution, and the time can be selected arbitrarily. In general, sensitizing dyes are added during the time after the completion of chemical sensitization and before coating, however, as disclosed in U.S. Pat. Nos. 3,628,969 and 4,225,666, spectral sensitizing dyes are added at the same time as the addition of chemical sensitizers and spectral sensitization is carried out simultaneously with chemical sensitization, further, as disclosed in JP-A-58-113928, spectral sensitization can be conducted prior to chemical sensitization, or spectral sensitizing dyes can be added and spectral sensitization can be started before completion of the precipitation formation of the silver halide grains. Still further, as disclosed in U.S. Pat. No. 4,225,666, spectral sensitizing dyes can be divided and added separately, that is, a part of them is added prior to chemical sensitization and the remaining can be added after chemical sensitization, therefore, any time during silver halide grain formation is feasible, as well as the method disclosed in U.S. Pat. No. 4,183,756. Above all, the addition of the sensitizing dyes before washing step of the emulsion, or before chemical sensitization is particularly preferred.

The amounts of addition of these spectral sensitizing dyes can be varied over a wide range depending on purposes, but are preferably within the range of from $0.5\times10^{-6}$ mol to $1.0\times10^{-2}$ mol, more preferably $1.0\times10^{-6}$ mol to $5.0\times10^{-3}$ mol, per mol of silver halide.

In the present invention, when a spectral sensitizing dye having spectral sensitizing sensitivity in the red region to the infrared region is used, the compounds disclosed in JP-A-2-157749, from page 13, right lower column to page 22, right lower column are preferably used in combination. The preservability of a photographic material, the stability of processing, and the effect of supersensitization can be extraordinarily increased with the use of these compounds. The use of the compounds represented by formulae (IV), (V) and (VI) in JP-A-2-157749 in combination is particularly preferred. These compounds are used generally in an amount of from $0.5\times10^{-5}$ mol to $5.0\times10^{-2}$ mol, preferably from $5.0\times10^{-5}$ mol to $5.0\times10^{-3}$ mol, per mol of silver halide, and the effective using amount exists within the range of from 0.1 to 10,000 moles, preferably 0.5 to 5,000 moles, per mol of sensitizing dye.

The photographic material of the present invention can preferably be used, in addition to the printing system using a general negative printer, in digital scanning exposure using monochromatic high density light, such as a gas laser, a light emitting diode, a semiconductor laser, a second harmonic generation light source (SHG) comprising a combination of nonlinear optical crystal with a semiconductor laser or a solid state laser using a semiconductor laser as an excitation light source. For obtaining a compact and inexpensive system, it is preferred to use a semiconductor laser, or a second harmonic generation light source (SHG) comprising a combination of nonlinear optical crystal with a semiconductor laser or a solid state laser. In particular, for designing a compact and inexpensive apparatus having a longer duration of life and high stability, it is preferred to use a semiconductor laser, at least one of exposure light sources should be a semiconductor laser.

When such a scanning exposure light source is used, the spectral sensitivity maximum of the photographic material of the present invention can be set arbitrarily according to the wavelength of the scanning exposure light source to be used. As oscillation wavelength of a laser can be made half using an SHG light source comprising a combination of nonlinear optical crystal with a solid state laser using a semiconductor laser as an excitation light source or a semiconductor laser, blue light and green light can be obtained. Accordingly, it is possible to have the spectral sensitivity maximum of a photographic material in normal three regions of blue, green and red. For making an apparatus inexpensive, high stable and compact using a semiconductor laser as a light source, it is preferred that at least two layers have spectral sensitivity maximum in the region of 670 nm or more. This is because emission wavelength region of III-V group system semiconductor laser, which is presently available, inexpensive and stable, is only in the red to infrared region. However, oscillation of II-VI group system semiconductor laser in the green and blue regions is confirmed in experimental level, and it is sufficiently expected that such a semiconductor laser shall be available inexpensively and stably according to the development of the manufacturing technology of the semiconductor laser. In such a case, the necessity that at least two layers should have spectral sensitivity maximum in the region of 670 nm or more becomes small.

In such a scanning exposure, the time of exposure of silver halide in a photographic material is the time necessary for exposure of a micro area. The minimum unit for controlling the quantity of light from each digital data is in general used as this micro area and which is called a pixel. Therefore, exposure time per pixel is varied according to the size of the pixel. The size of the pixel depends on the density of the pixel and the practical range of the density of the pixel is from 50 to 2,000 dpi. The exposure time is defined as the time necessary to expose the size of the pixel with the density of this pixel being 400 dip, and preferred exposure time is $10^{-4}$ sec or less and more preferably $10^{-6}$ sec or less. The more proper the above optical density value, the sharpness of images can be improved. Also, the shorter the scanning exposure time, the shorter is the exposure time, and suitable for rapid processing.

In the photographic material of the present invention, the dyes capable of decoloration by processing (oxonol dyes and cyanine dyes, of all) disclosed in EP-A-337490, pages 27 to 76, are preferably added to hydrophilic colloid layers for the purpose of preventing irradiation and halation and improving the stability of a safelight.

Some of these water-soluble dyes deteriorate color separation and the stability of a safelight when the using amount is increased. Examples of dyes which can be used without deteriorating color separation include the water-soluble dyes disclosed in EP 53997841, JP-A-5-127325 and JP-A-5-127324.

In the present invention, a colored layer capable of decoloration by processing may be used in place of or in combination with water-soluble dyes. A colored layer capable of decoloration by processing may be in contact with an emulsion layer directly or may be disposed to contact via an interlayer containing a processing color mixing preventive such as gelatin and hydroquinone. This colored layer is preferably provided under the emulsion layer (the support side) which colors the same elementary color as the colored layer. It is possible to provide all colored layers corresponding to each elementary color separately or to provide only a part of it by selecting optionally. Further, it is possible to provide a colored layer which is colored to correspond with a plurality of elementary color regions. With respect to the optical reflection density of a colored layer, the optical density value in the wavelength of the highest optical density in the wavelength region which is used for exposure (the visible light region of 400 nm to 700 nm in the case of the exposure by usual printer, and the wavelength of the scanning exposure light source in the case of scanning exposure) is preferably from 0.2 to 3.0, more preferably from 0.5 to 2.5, and most preferably from 0.8 to 2.0.

The conventionally known methods can be applied to form a colored layer, for example, a method in which the dyes disclosed in JP-A-2-282244, from page 3, right upper column to page 8, or the dyes disclosed in JP-A-3-7931, page 3, right upper column to page 11, left lower column, are incorporated into the hydrophilic colloid layer in the form of a solid fine grain dispersion, a method in which anionic dyes are mordanted to cationic polymers, a method in which dyes are adsorbed onto fine grains such as silver halide and fixed in the layer, or a method which uses colloidal silver as disclosed in JP-A-1-239544. With respect to a method of dispersing fine powders of a dye in a solid state, a method in which fine powder dye which is substantially water-insoluble at pH 6 or less but substantially water-soluble at pH 8 or more is incorporated is disclosed in JP-A-2-308244, pages 4 to 13. Also, a method in which anionic dyes are mordanted to cationic polymers is disclosed in JP-A-2-84637, from pages 18 to 26. Methods for preparing colloidal silver as a light absorbing agent are disclosed in U.S. Pat. Nos. 2,688,601 and 3,459,563. Of these methods, a method which incorporates fine powder dye and a method which uses colloidal silver are preferred.

Gelatin is preferably used as a binder or a protective colloid which can be used in the photographic material of the present invention, but hydrophilic colloid other than gelatin can be used alone or in combination with gelatin. Low calcium gelatin having a calcium content of 800 ppm or less, more preferably 200 ppm or less, is preferably used as such gelatin. The antifungal agents disclosed in JP-A-63-271247 is preferably added for preventing generation of various kinds of fungi and bacteria which proliferate in a hydrophilic colloid layer and deteriorate images.

When the photographic material of the present invention is subjected to an exposure by printer, a band stop filter as disclosed in U.S. Pat. No. 4,880,726 is preferably used. Using this filter, color mixing of light can be eliminated and color reproducibility is remarkably improved.

The exposed photographic material can be processed by ordinary color development processing, but the color photographic material of the present invention is preferably subjected to bleach-fixing processing after color development for the purpose of rapid processing. In particular, when the above described high silver chloride emulsion is used, the pH of the bleach-fixing solution is preferably 6.5 or less and more preferably 6 or less for the sake of acceleration of desilvering.

Preferred examples of silver halide emulsions and other substances (additives or the like) for use in the present invention, photographic constitutional layers (arrangement of the layers or the like), and processing methods for processing the photographic materials and additives for processing are disclosed in the patent publications described below, and those disclosed in EP-A-355660 (corresponding to JP-A-2-139544) are preferably used.

TABLE 1

| Photographic Constitutional Element | JP-A-62-215272 | JP-A-2-33144 | EP-A-355660 |
|---|---|---|---|
| Silver Halide Emulsion | p. 10, right upper column, l 6 to p. 12, left lower column, l. 5, p. 12, right lower column, 4 line up from the bottom to p. 13, left upper column, l. 17 | p. 28, right upper column, l. 16 to p. 29, right lower column, l. 11 p. 30, ll. 20 to 22 | p. 45, l 53 to p. 47, l. 3 p. 47, ll. 20 to 22 |
| Silver Halide Solvent | p. 12, left lower column, ll. 6 to 14 p. 13, left upper column, 3 line up from the bottom to p. 18, left lower column, last line | — | — |
| Chemical Sensitizer | p. 12, left lower column, | p. 29, right lower column, | p. 47, ll. 4 to 9 |

TABLE 1-continued

| Photographic Constitutional Element | JP-A-62-215272 | JP-A-2-33144 | EP-A-355660 |
|---|---|---|---|
| | 3 line up from the bottom to right lower column, 5 line up from the bottom p. 18, right lower column, l. 1 to p. 22, right upper column, 9 line up from the bottom | l. 12 to last line | |
| Spectral Sensitizer (spectral sensitizing method) | p. 22, right upper column, 8 line up from the bottom to p. 38, last line | p. 30, left upper column, ll. 1 to 13 | p 47, ll. 10 to 15 |
| Emulsion Stabilizer | p. 39, left upper column, l. 1 to p. 72, right upper column, last line | p. 30, left upper column, l. 14 to right upper column, l. 1 | p. 47, ll. 16 to 19 |
| Development Accelerator | p. 72, left lower column, l. 1 to p. 91, right upper column, l. 3 | — | — |

TABLE 2

| Photographic Constitutional Element | JP-A-62-215272 | JP-A-2-33144 | EP-A-355660 |
|---|---|---|---|
| Color Coupler (cyan, magenta, yellow) | p. 91, right upper column, l. 4 to p. 121, left upper column, l. 6 | p. 3, right upper column, l. 14 to p. 18, left upper column, last line<br>p. 30, right upper column, l. 6 to p. 35, right lower column, l. 11 | p. 4, ll. 15 to 27<br>p. 5, l. 30 to p. 28, last line<br>p. 45, ll. 29 to 31<br>p. 47, l. 23 to p. 63 l. 50 |
| Supersensitizer | p. 121, left upper column, l. 7 to p. 125, right upper column, l. 1 | — | — |
| UV Absorbing Agent | p. 125, right upper column, l. 2 to p. 127, left lower column, last line | p. 37, right lower column, l. 14 to p. 38, left upper column, l. 11 | p. 65, pp. 22 to 31 |
| Discoloration Inhibitor (image stabilizing agent) | p. 127, right lower column, l. 1 to p. 137, left lower column, l. 8 | p. 36, right upper column, l. 12 to p. 37, left upper column, l. 19 | p. 4, l. 30 to p. 5, l. 23<br>p. 29, l. 1 to p. 45, l. 25<br>p. 45, ll. 33 to 40<br>p. 65, ll. 2 to 21 |
| High Boiling Point and/or Low Boiling Point Organic Solvent | p. 137, left lower column, l. 9 to p. 144, right upper column, last line | p. 35, right lower column, l. 14 to p. 36, left upper column, 4 line up from the bottom | p. 64, ll. 1 to 51 |
| Discoloration Inhibitor (image stabilizing agent) | p. 127, right lower column, l. 1 to p. 137, left lower column, l. 8 | p. 36, right upper colurm, l. 12 to p. 37, left upper column, l. 19 | p. 4, l. 30 to p. 5, l. 23<br>p. 29, l. 1 to p. 45, l. 25<br>p. 45, ll. 33 to 40<br>p. 65, ll. 2 to 21 |
| High Boiling Point and/or Low Boiling Point Organic Solvent | p. 137, left lower column, l. 9 to p. 144, right upper column, last line | p. 35, right lower column, l. 14 to p. 36, left upper column, 4 line up from the bottom | p. 64, ll. 1 to 51 |
| Dispersing Method of Photographic Additives | p. 144, left lower column, l. 1 to p. 146, right upper column, l. 7 | p. 27, right lower column, l. 10 to p. 28, left upper column, last line<br>p. 35, right lower column, l. 12 to p. 36, right upper column, l. 7 | p. 63, l. 51 to p. 64, l. 56 |

TABLE 3

| Photographic Constitutional Element | JP-A-62-215272 | JP-A-2-33144 | EP-A-355660 |
|---|---|---|---|
| Hardening Agent | p. 146, right upper column, l. 8 to p. 155, left lower column, l. 4 | — | — |
| Developing Agent Precursor | p. 155, left lower column, l. 5 to p. 155, right lower column, l. 2 | — | — |
| DIR Compound | p. 155, right lower column, ll. 3 to 9 | — | — |
| Support | p. 155, right lower column, l. 19 to p. 156, left upper column, l. 14 | p. 38, right upper column, l. 18, to p. 39, left upper column, l. 3 | p. 66, l. 29 to p. 67, l. 13 |
| Layer Structure of Photographic Material | p. 156, left upper column, l. 15 to p. 156, right lower column, l. 14 | p. 28, right upper column, ll. 1 to 15 | p. 45, ll. 41 to 52 |
| Dye | p. 156, right lower column, l. 15 to p. 184, right lower column, last line | p. 38, left upper column, l. 12 to right upper column, l. 7 | p. 66, ll. 18 to 22 |
| Color Mixture Preventive | p. 185, left upper column, l. 1 to p. 188, right lower column, l. 3 | p. 36, right upper column, ll. 8 to 11 | p. 64, l. 57 to p. 65, l. 1 |
| Gradation Controlling Agent | p. 188, right lower column, ll. 4 to 8 | — | — |
| Antistaining Agent | p. 188, right lower column, l. 9 to p. 193, right lower column, l. 10 | p. 37, left upper column, last line to right lower column, l. 13 | p. 65, l. 32 to p. 66, l. 17 |

TABLE 4

| Photographic Constitutional Element | JP-A-62-215272 | JP-A-2-33144 | EP-A-355660 |
|---|---|---|---|
| Surfactant | p. 201, left lower column, l. 1 to p. 210, right upper column, last line | p. 18, right upper column, l. 1 to p. 24, right lower column, last line<br>p. 27, left lower column, 10 line up from the bottom to right lower column, l. 9 | — |
| Fluorine-Containing Compound (as anti-static agent, coating aid, lubricant, adhesion preventive agent) | p. 210, left lower column, l. 1 to p. 222, left lower column, l. 5 | p. 25, left upper column, l. 1 to p. 27, right lower column, l. 9 | — |
| Binder (hydrophilic colloid) | p. 222, left lower column, l. 6 to p. 225, left upper column, last line | p. 38, right upper column, ll. 8 to 18 | p. 66, ll. 23 to 28 |
| Thickener | p. 225, right upper column, l. 1 to p. 227, right upper column, l. 2 | — | — |
| Antistatic Agent | p. 227, right upper column, l. 3 to p. 230, left upper column, l. 1 | — | — |
| Polymer Latex | p. 230, left upper column, l. 2 to p. 239, last line | — | — |
| Matting Agent | p. 240, left upper column, l. 1 to p. 240, right upper column, last line | — | — |
| Photographic Processing Method (processing step and additives) | p. 3, right upper column, l. 7 to p. 10, right upper column, l. 5 | p. 39, left upper column, l. 4 to p. 42, left upper column, last line | p. 67, l. 14 to p. 69, l. 28 |

Note) References in column JP-A-62-215272 include contents amended by The Amendment dated March 16, 1987, which appears at the end of the Patent Publication.

TABLE 5

| Photographic Constitutional Element | JP-A-62-215272 | JP-A-2-33144 | EP-A-355660 |
|---|---|---|---|
| Photographic Processing Method (processing step and additives) | p. 3, right upper column, l. 7 to p. 10, right upper column, l. 5 | p. 39, left upper column, l. 4 to p. 42, left upper column, last line | p. 67, l. 14 ro p. 69, l. 28 |

Note)
References in column JP-A-62-215272 include contents amended by the Ammendment dated March 16, 1987, which appears at the end of the Patent Publication.

It is preferred that cyan, magenta or yellow couplers are impregnated with a loadable latex polymer (e.g., disclosed in U.S. Pat. No. 4,203,716) in the presence (or absence) of the high boiling point organic solvents disclosed in the above table, besides the amide compound of the present invention, or the couplers are dissolved in a polymer insoluble in water but soluble in an organic solvent and then dispersed in a hydrophilic colloidal aqueous solution in an emulsified state.

Examples of polymers insoluble in water but soluble in an organic solvent which can preferably be used in the present invention include homopolymers or copolymers disclosed in U.S. Pat. No. 4,857,449, from columns 7 to 15, and WO 88/00723, from pages 12 to 30. Methacrylate based or acrylamide based polymers are preferred, in particular, acrylamide based polymers are preferred as to color image stability.

In the photographic material of the present invention, it is preferred to use color image preservability improving compounds disclosed in EP-A-277589 in combination with the couplers. In particular, the use in combination with pyrazoloazole couplers, pyrrolotriazole couplers, and the yellow couplers for use in the present invention is preferred.

That is, the use of the compound disclosed in the above EP Patent which produces a chemically inactive and substantially colorless compound upon chemically bonding with the product of the aromatic amine based color developing agent remaining after color development processing and/or the compound disclosed in the above EP Patent which produces a chemically inactive and substantially colorless compound upon chemically bonding with the oxidized product of the aromatic amine based color developing agent remaining after color development processing, alone or in combination, is preferred for preventing the generation of stain due to the formation of a color dye caused by the coupling reaction of the coupler with the color developing agent or the oxidized product thereof remaining in the film, or preventing other side reactions, during preservation after processing.

Examples of preferred cyan couplers for use in the present invention include, in addition to the phenol type couplers and naphthol type couplers disclosed in the known literature in the above table, diphenylimidazole based cyan couplers disclosed in JP-A-2-33144, 3-hydroxypyridine based cyan couplers disclosed in EP-A-333185, cyclic active methylene based cyan couplers disclosed in JP-A-64-32260, pyrrolopyrazole type cyan couplers disclosed in EP-A-456226, pyrroloimidazole type cyan couplers disclosed in EP 484909, and pyrrolotriazole type cyan couplers disclosed in EP 488248 and EP-A-491197. The use of pyrrolotriazole type cyan couplers is particularly preferred.

Examples of magenta couplers which can be used in the present invention include 5-pyrazolone based magenta couplers and pyrazoloazole type couplers disclosed in the known literature in the above table. 5-Pyrazolone based magenta couplers, in which arylthio is released, disclosed in WO 92/18901, WO 92/18902 and WO 92/18903 are preferred as a 5-pyrazolone based magenta coupler in that image preservability is stable and fluctuation of the picture quality by processing is less.

As pyrazoloazole type couplers, in view of hue, image stability and color forming ability, the pyrazolotriazole couplers to which a secondary or tertiary alkyl group is directly bonded at the 2-, 3- or 6-position of the pyrazolotriazole ring disclosed in JP-A-61-65245, the pyrazoloazole couplers which contain a sulfonamide group in the molecule disclosed in JP-A-61-65246, the pyrazoloazole couplers which have an alkoxyphenylsulfonamide ballast group disclosed in JP-A-61-147254, and the pyrazoloazole couplers which have an alkoxy group or an aryloxy group at the 6-position disclosed in EP-A-226849 and EP-A-294785, are preferably used.

As the yellow couplers which can be used in combination with the yellow couplers of the present invention, known acylacetanilide type couplers which have separable groups different from the separable groups of the couplers of the present invention are preferably used, and above all, pivaloylacetanilide type couplers which have a halogen atom or an alkoxy group at the ortho-position of the anilide ring, the acylacetanilide type couplers the acyl group of which is substituted with a cycloalkanecarbonyl group at the 1-position disclosed in EP-A-447969, JP-A-5-107701 and JP-A-5-113642, and the malondianilide type coupler disclosed in EP-A-482552 and EP-A-524540, are preferably used.

With respect to the processing method of the color photographic material of the present invention, in addition to the methods disclosed in the above table, processing materials and processing methods disclosed in JP-A-2-207250, from page 26, right lower column, line 1 to page 34, right upper column, line 9, and JP-A-4-97355, from page 5, left upper column, line 17 to page 18, right lower column, line 20 are preferably used.

EXAMPLE

The present invention is described in detail with reference to the examples, however, it should not be construed as being limited thereto.

Example 1

The surface of a paper support laminated on both sides with polyethylene was corona discharged. The support was provided with an undercoat layer containing sodium dodecylbenzenesulfonate, and further, the various photographic constituting layers were multilayer coated to have the following composition and a multilayer color photographic paper Sample (101) was prepared. The coating solution was prepared as follows.

Preparation of Coating Solution for First Layer 122.0 g of a yellow coupler (ExY), 7.5 g of a color image stabilizer (Cpd-2), 16.7 g of a color image stabilizer (Cpd-3) were dissolved in 44 g of a solvent (Solv-1) and 180 ml of ethyl acetate, and this solution was mixed to 1,000 g of a 10% aqueous gelatin solution containing 86 ml of 10% sodium dodecylbenzenesulfonate and dispersed in an emulsified condition to obtain Emulsified Dispersion A. On the other hand, two kinds of silver chlorobromide emulsions A were prepared (cubic form, a mixture in a ratio of 3/7 (silver mol ratio) of a large grain size emulsion A having an average grain size of 0.88 μm, and a small grain size emulsion A having an average grain size of 0.70 μm; variation coefficients of the grain size distribution were 0.08 and 0.10, respectively, both of them contained 0.3 mol % of silver bromide localized at a part of the grain surface, and the remaining substrate being comprising silver chloride). The blue-sensitive Sensitizing Dyes A, B, and C shown below were added respectively in an amount of $8.0\times10^{-5}$ mol per mol of silver to the large grain size emulsion A, and $1.0\times10^{-4}$ mol per mol of silver to the small grain size emulsion A. Chemical ripening was conducted by addition of a sulfur sensitizer and a gold sensitizer. The foregoing Emulsified Dispersion A was mixed with this silver chlorobromide emulsion A and dissolved to obtain a coating solution for the first layer having the composition described below. The coating amount of the emulsion was calculated in terms of silver.

The coating solutions for from the second to seventh layers were prepared in the same manner as the coating solution for the first layer. 1-Oxy-3,5-dichloro-s-triazine sodium salt was used as a gelatin hardening agent in each layer.

Further, Cpd-12, Cpd-13, Cpd-14 and Cpd-15 were added to each layer so that the total coating amount became 15.0 mg/m², 60.0 mg/m², 5.0 mg/m² and 10.0 mg/m², respectively.

The spectral sensitizing dyes described below were used in the silver chlorobromide emulsion of each light-sensitive emulsion layer.

Blue-Sensitive Emulsion Layer

Sensitizing Dye A

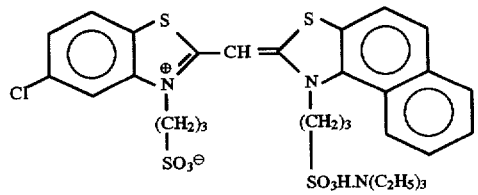

Sensitizing Dye B

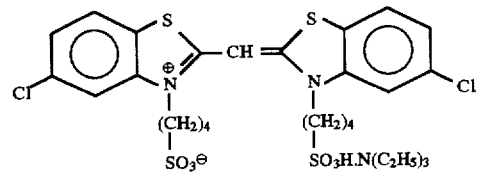

Sensitizing Dye C

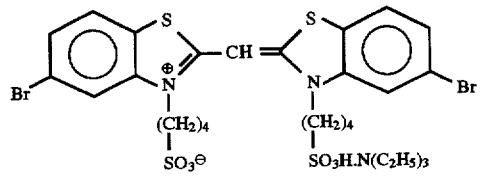

(each in an amount of $1.4\times10^{-4}$ mol/mol Agx to the large grain size emulsion, and each in an amount of $1.7\times10^{-4}$ mol/mol Agx to the small grain size emulsion)

Green-Sensitive Emulsion Layer

Sensitizing Dye D

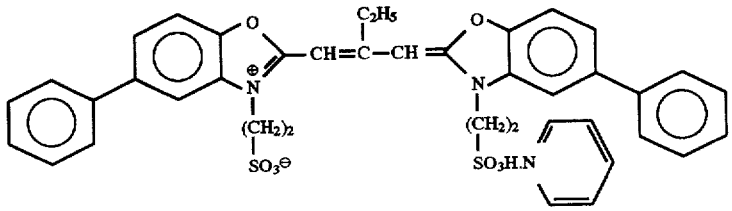

(in an amount of $3.0\times10^{-4}$ mol/mol Agx to the large grain size emulsion, and $3.6\times10^{-4}$ mol/mol Agx to the small grain size emulsion)

Sensitizing Dye E

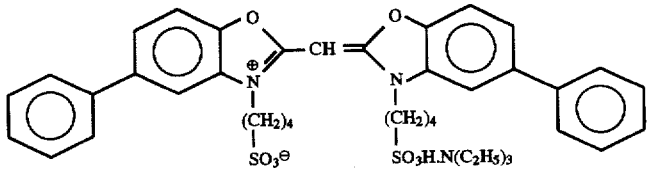

(in an amount of $4.0\times10^{-5}$ mol/mol Agx to the large grain size emulsion, and $7.0\times10^{-5}$ mol/mol Agx to the small grain size emulsion)

Sensitizing Dye F

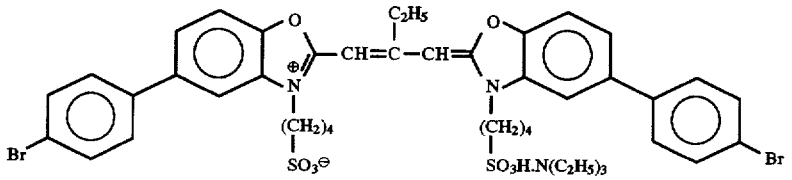

(in an amount of $2.0\times10^{-4}$ mol/mol Agx to the large grain size emulsion, and $2.8\times10^{-4}$ mol/mol Agx to the small grain size emulsion)

Red-Sensitive Emulsion Layer

Sensitizing Dye G

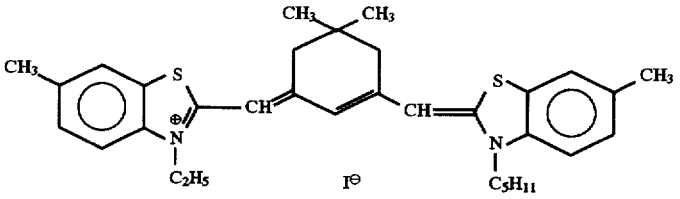

Sensitizing Dye H

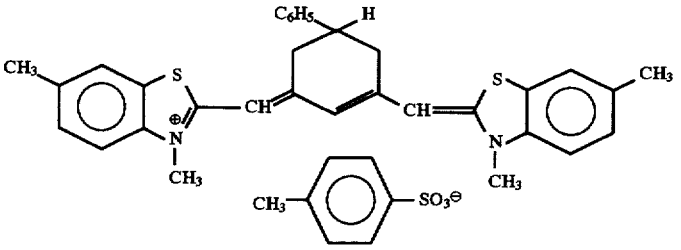

(each in an amount of $5.0\times10^{-5}$ mol/mol Agx to the large grain size emulsion, and each in an amount of $8.0\times10^{-5}$ mol/mol Agx to the small grain size emulsion)

The following compound was further added to the red-sensitive emulsion layer in an amount of $2.6\times10^{-3}$ mol per mol of silver halide.

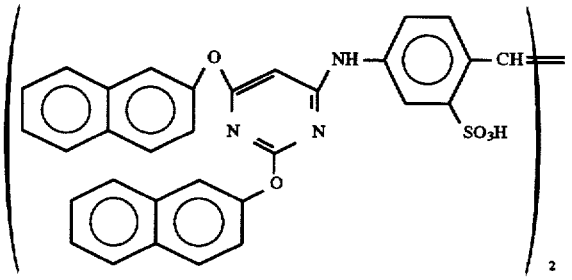

Further, 1-(5-methylureidophenyl)-5-mercaptotetrazole was added to the blue-sensitive emulsion layer, the green-sensitive emulsion layer and the red-sensitive emulsion layer in an amount of $3.3\times10^{-4}$ mol, $1.0\times10^{-3}$ mol and $5.9\times10^{-4}$ mol, respectively, per mol of silver halide.

Further, 1-(5-methylureidophenyl)-5-mercaptotetrazole was added to the second layer, the fourth layer, the sixth layer, and the seventh layer so that the coating amount becomes 0.2 mg/m$^2$, 0.2 mg/m$^2$, 0.6 mg/m$^2$, and 0.1 mg/m$^2$, respectively.

In addition, 4-hydroxy-6-methyl-1,3,3a,7-tetraazaindene was added to the blue-sensitive emulsion layer and the green-sensitive emulsion layer in an amount of $1\times10^{-4}$ mol and $2\times10^{-4}$ mol, respectively, per mol of silver halide.

Moreover, the following dyes were added to the emulsion layer for preventing irradiation (the numerals in parentheses represent the coating amount).

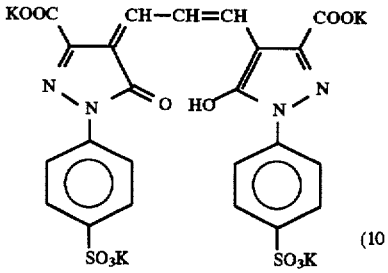

(10 mg/m$^2$)

and

-continued

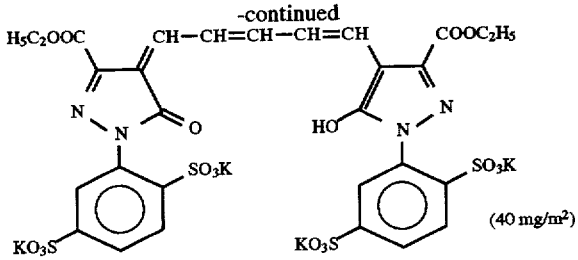

Layer Composition

The composition of each layer is described below. The numeral represents the coating amount (g/m$^2$). The numeral for the silver halide emulsion represents the coating amount in terms of silver.

Support

Polyethylene-laminated paper (a white pigment ($TiO_2$, content: 15 wt %) and a blue dye (ultramarine) were added to the polyethylene of the first layer side).

| | |
|---|---|
| First Layer (blue-sensitive emulsion layer) | |
| Silver Chlorobromide Emulsion A described above | 0.27 |
| Gelatin | 1.43 |
| Yellow Coupler (EXY) | 0.61 |
| Color Image Stabilizer (Cpd-2) | 0.04 |
| Color Image Stabilizer (Cpd-3) | 0.08 |
| Solvent (Solv-1) | 0.22 |
| Second Layer (color mixture inhibiting layer) | |
| Gelatin | 0.99 |
| Color Mixing Preventive (Cpd-4) | 0.10 |
| Solvent (Solv-1) | 0.07 |
| Solvent (Solv-2) | 0.20 |
| Solvent (Solv-3) | 0.15 |
| Solvent (Solv-7) | 0.12 |
| Third Layer (green-sensitive emulsion layer) | |

| | |
|---|---|
| Gelatin | 1.35 |
| Magenta Coupler (EXM) | 0.12 |
| UV Absorbing Agent (UV-1) | 0.12 |
| Color Image Stabilizer (Cpd-2) | 0.01 |
| Color Image Stabilizer (Cpd-5) | 0.01 |
| Color Image Stabilizer (Cpd-6) | 0.01 |
| Color Image Stabilizer (Cpd-7) | 0.08 |
| Color Image Stabilizer (Cpd-8) | 0.01 |
| Solvent (Solv-4) | 0.30 |
| Solvent (Solv-5) | 0.15 |
| Fourth Layer (color mixture inhibiting layer) | |
| Gelatin | 0.72 |
| Color Mixing Preventive (Cpd-4) | 0.07 |
| Solvent (Solv-1) | 0.05 |
| Solvent (Solv-2) | 0.15 |
| Solvent (Solv-3) | 0.12 |
| Solvent (Solv-7) | 0.09 |
| Fifth Layer (red-sensitive emulsion layer) | |

| | |
|---|---|
| Gelatin | 0.80 |
| Cyan Coupler (ExC) | 0.28 |
| UV Absorbing Agent (UV-3) | 0.19 |
| Color Image Stabilizer (Cpd-1) | 0.24 |
| Color Image Stabilizer (Cpd-6) | 0.01 |
| Color Image Stabilizer (Cpd-8) | 0.01 |
| Color Image Stabilizer (Cpd-9) | 0.04 |
| Color Image Stabilizer (Cpd-10) | 0.01 |
| Solvent (Solv-1) | 0.01 |

-continued

| | |
|---|---|
| Solvent (Solv-6) | 0.21 |
| Sixth Layer (UV absorbing layer) | |
| Gelatin | 0.64 |
| UV Absorbing Agent (UV-2) | 0.39 |
| Color Image Stabilizer (Cpd-7) | 0.05 |
| Solvent (Solv-8) | 0.05 |

Samples 102 to 130 were prepared in the same manner as the preparation of Sample 101 except that the yellow coupler in the first layer was changed so as to become equimolar amount and comparative color image stabilizer R-1 or R-2 or amide compound of the present invention was added. Yellow couplers and the kinds and amounts of the additives were shown in Table A. The addition amount was indicated in weight ratio to the coupler of Sample 101.

The above prepared photographic material Sample 101 was cut in 127 mm width and wound in a roll, and after imagewise exposure using a printer processor PP1820V manufactured by Fuji Photo Film Co., Ltd., continuously processed according to the processing step shown below until the replenisher reached two times of the tank capacity of the color development tank.

| Processing Step | Processing Temperature (°C.) | Processing Time (sec) | Replenishment Rate* (ml) |
|---|---|---|---|
| Color Development | 38.5 | 45 | 73 |
| Bleach-Fixing | 35 | 45 | 60** |
| Rinsing (1) | 35 | 30 | — |
| Rinsing (2) | 35 | 30 | — |
| Rinsing (3) | 35 | 30 | 360 |
| Drying | 80 | 60 | — |

*Replenishment rate per m$^2$ of the photographic material
**In addition to the above 60 ml, 120 ml per m$^2$ of the photographic material was poured into the tank from rinsing tank (1).

Rinsing was conducted in a 3-tank countercurrent system from rinsing (3) to (1).

The composition of each processing solution is as follows.

| | Tank Solution | Replenisher |
|---|---|---|
| Color Developing Solution | | |
| Water | 800 ml | 800 ml |
| Ethylenediaminetetraacetic Acid | 3.0 g | 3.0 g |
| Disodium 4,5-dihydroxybenzene-1,3-disulfonate | 0.5 g | 0.5 g |
| Triethanolamine | 12.5 g | 12.0 g |
| Potassium Chloride | 6.5 g | — |
| Potassium Bromide | 0.03 g | — |
| Potassium Carbonate | 27.0 g | 27.0 g |
| Brightening Agent (WHITEX 4, manufactured by Sumitomo Chemical Co., Ltd.) | 1.0 g | 3.0 g |
| Sodium Sulfite | 0.1 g | 0.1 g |
| Disodium-N,N-bis(sulfonato-ethyl)hydroxylamine | 5.0 g | 10.0 g |
| Sodium Triisopropyl-naphthalene(β)sulfonate | 0.1 g | 0.1 g |
| N-Ethyl-N-(β-methanesulfon-amidoethyl)-3-methyl-4-aminoaniline.3/2 Sulfate. Monohydrate | 5.0 g | 11.5 g |
| Water to make | 1,000 ml | 1,000 ml |
| pH (25° C., adjusted with | 10.00 | 10.00 |

-continued

| | Tank Solution | Replenisher |
|---|---|---|
| potassium hydroxide and sulfuric acid) | | |
| Bleach-Fixing Solution | | |
| Water | 600 ml | 150 ml |
| Ammonium Thiosulfate (750 g/liter) | 93 ml | 230 ml |
| Ammonium Sulfite | 40 g | 100 g |
| Ammonium Ethylenediamine-tetraacetato Ferrate | 55 g | 135 g |
| Ethylenediaminetetraacetic Acid | 5 g | 12.5 g |
| Nitric Acid (67%) | 30 g | 65 g |
| Water to make | 1,000 ml | 1,000 ml |
| pH (25° C., adjusted with acetic acid and aqueous ammonia) | 5.8 | 5.6 |

Samples 101 to 130 were wedge exposed using blue light and continuously processed using the previously continuously processed processing solutions. The color densities of samples after processing were measured with blue light and maximum color densities $D_{max}$ were read out from the sensitometry curve.

Samples after measurement were prepared differently. One group was stored under the conditions of Xe lamp irradiation (100,000 lux, intermittent irradiation of 5 hours bright/1 hour dark) for three weeks, and the other group was under high temperature and high humidity of 80° C., 70% RH for three weeks. Samples were measured for densities again and color image remaining rate at initial density 2.0 was determined. Further, unexposed samples were stored under the conditions of 40° C., 80% RH for 14 days, then exposed and processed in the same manner as the above samples. Fog density ($D_{min}$) of these samples were measured.

The results obtained are summarized in Table A.

TABLE A

| Sample No. | Coupler | Additive (addition amount) | Color Density Dmax | Color Image Remaining Rate: Xe 3 Weeks | Color Image Remaining Rate: 80° C., 70% 3 Weeks (D %) | Fog Dmin | Remarks |
|---|---|---|---|---|---|---|---|
| 101 | ExY | — | 2.14 | 64 | 73 | 0.12 | Comparison |
| 102 | " | R-1 (0.2) | 2.02 | 75 | 67 | 0.13 | " |
| 103 | " | R-2 (0.2) | 2.08 | 66 | 75 | 0.12 | " |
| 104 | " | A-1 (0.2) | 2.01 | 82 | 77 | 0.13 | " |
| 105 | " | A-14 (0.2) | 2.03 | 80 | 76 | 0.13 | " |
| 106 | " | B-6 (0.2) | 2.02 | 79 | 72 | 0.14 | " |
| 107 | Y-1 | — | 2.11 | 59 | 67 | 0.16 | Comparison |
| 108 | " | R-1 (0.2) | 2.01 | 68 | 54 | 0.15 | " |
| 109 | " | R-2 (0.2) | 2.07 | 63 | 69 | 0.14 | " |
| 110 | " | A-11 (0.2) | 2.14 | 85 | 82 | 0.12 | Invention |
| 111 | " | A-14 (0.2) | 2.17 | 87 | 83 | 0.11 | " |
| 112 | " | B-6 (0.2) | 2.15 | 83 | 81 | 0.12 | " |
| 113 | " | A-4 (0.2) | 2.19 | 84 | 80 | 0.11 | " |
| 114 | Y-1 | A-9 (0.2) | 2.13 | 82 | 83 | 0.11 | Invention |
| 115 | " | A-18 (0.2) | 2.21 | 83 | 82 | 0.11 | " |
| 116 | " | A-19 (0.2) | 2.18 | 85 | 81 | 0.11 | " |
| 117 | " | B-5 (0.2) | 2.14 | 82 | 79 | 0.12 | " |
| 118 | " | B-11 (0.2) | 2.16 | 81 | 78 | 0.12 | " |
| 119 | " | B-12 (0.2) | 2.18 | 83 | 80 | 0.12 | " |
| 120 | Y-3 | — | 2.15 | 51 | 58 | 0.18 | Comparison |
| 121 | " | R-1 (0.4) | 2.07 | 67 | 47 | 0.16 | " |
| 122 | " | A-14 (0.4) | 2.24 | 83 | 77 | 0.12 | Invention |
| 123 | " | A-16 (0.4) | 2.25 | 80 | 75 | 0.12 | " |
| 124 | Y-6 | — | 2.14 | 49 | 62 | 0.17 | Comparison |
| 125 | " | R-1 (0.4) | 2.05 | 63 | 52 | 0.15 | " |
| 126 | " | A-11 (0.4) | 2.27 | 80 | 79 | 0.12 | Invention |
| 127 | Y-6 | A-14 (0.4) | 2.29 | 84 | 81 | 0.12 | Invention |
| 128 | Y-11 | A-14 (0.3) | 2.25 | 85 | 83 | 0.12 | " |
| 129 | Y-16 | A-14 (0.3) | 2.27 | 78 | 78 | 0.11 | " |
| 130 | Y-22 | A-14 (0.3) | 2.23 | 82 | 80 | 0.12 | " |

-continued

| | Tank Solution | Replenisher |
|---|---|---|
| Rinsing Solution (the tank solution and the replenisher are the same) | | |
| Sodium Chlorinated Isocyanurate | | 0.02 g |
| Deionized Water (electric conductivity: 5 μs/cm or less) | | 1,000 ml |
| pH | | 6.5 |

As can be seen from Table A, when comparative coupler ExY is used in combination with the amide compound of the present invention, reduction of color density is observed similarly when used in combination with polymer R-1 or comparative compound R-2, whereas when the coupler of the present invention is used in combination with the amide compound of the present invention, color density rather increases.

Further, when the coupler of the present invention is used, improving effect of light-fading is extremely large to polymer compound R-1 or amide compound R-2. When the coupler of the present invention is used in combination with comparative polymer compound, fadidng under high temperature high humidity conditions deteriorates (in particular, combined use with the coupler of the present invention), but when used in combination with the amide compound of the present invention, fading under high temperature high humidity conditions is conspicuously improved.

On the other hand, increase of fog during processing by the coupler of the present invention is observed in samples stored under high humidity condition, but the fog can be improved by using the amide compound of the present invention in combination.

As described above, by using the coupler of the present invention and the amide compound of the present invention in combination, the photographic material having a high color forming ability can be produced without deteriorating image stability and processing fog.

Example 2

Sample 201 was prepared in the same manner as in Example 1 except for changing the composition of the first layer of Sample 101 as follows.

| First Layer (blue-sensitive emulsion layer) | |
|---|---|
| Silver Chlorobromide Emulsion A described above | 0.27 |
| Gelatin | 1.60 |
| Yellow Coupler (EXY) | 0.60 |
| Color Image Stabilizer (Cpd-2) | 0.04 |
| Color Image Stabilizer (Cpd-3) | 0.08 |
| Color Image Stabilizer (Cpd-5) | 0.04 |
| Solvent (Solv-3) | 0.12 |
| Solvent (Solv-9) | 0.12 |

Next, Samples 202 to 220 were prepared by replacing the yellow coupler of Sample 201 with the couplers indicated in Table B in specified mol % and further the amide compounds of the present invention were added in amounts indicated in Table B.

Samples 201 to 220 were exposed and processed in the same manner as in Example 1 and color density ($D_{max}$), fastness against heat and humidity (initial density 1.5, 80° C., 70% RH, three weeks) were evaluated.

Further, unexposed samples were stored under the conditions of 50° C., 80% RH for 5 days, then exposed and processed in the same manner as above. Samples different from these were stored at 5° C. and the fluctuation of sensitivity (storage stability) as to the same samples was measured. The results obtained are shown in Table B.

TABLE B

| Sample No. | Coupler | Additive (amount) | Color Forming Ability Dmax | Heat and Humidity Fastness 80° C., 70% 3 Weeks | Storage Stability 50° C., 80% 5 Days | Remarks |
|---|---|---|---|---|---|---|
| 201 | ExY (100 mol %) | — | 2.12 | 78 | −0.04 | Comparison |
| 202 | | A-14 (0.1) | 2.03 | 79 | −0.05 | " |
| 203 | | (0.2) | 1.95 | 80 | −0.05 | " |
| 204 | | (0.4) | 1.78 | 80 | −0.06 | " |
| 205 | | (0.8) | 1.51 | 81 | −0.08 | " |
| 206 | Y-7 (85 mol %) | — | 2.17 | 69 | −0.11 | Comparison |
| 207 | | A-14 (0.1) | 2.16 | 77 | −0.06 | Invention |
| 208 | | (0.2) | 2.14 | 81 | −0.04 | " |
| 209 | | (0.4) | 2.12 | 83 | −0.04 | " |
| 210 | | (0.8) | 2.11 | 86 | −0.03 | " |
| 211 | Y-43 (80 mol %) | — | 2.23 | 88 | −0.08 | Comparison |
| 212 | | A-14 (0.1) | 2.23 | 90 | −0.06 | Invention |
| 213 | | (0.2) | 2.22 | 93 | −0.05 | " |
| 214 | | (0.4) | 2.21 | 95 | −0.04 | " |
| 215 | | (0.8) | 2.19 | 97 | −0.04 | " |
| 216 | Y-54 (80 mol %) | — | 2.26 | 94 | −0.09 | Comparison |
| 217 | | A-14 (0.1) | 2.26 | 96 | −0.06 | Invention |
| 218 | | (0.2) | 2.25 | 98 | −0.04 | " |
| 219 | | (0.4) | 2.25 | 99 | −0.03 | " |
| 220 | | (0.8) | 2.23 | 100 | −0.03 | " |

As is apparently seen from Table B, by the combination of the couplers of the present invention with the amide compounds of the present invention, heat humidity fastness can be improved without largely deteriorating color forming ability.

Also, by the combined use of the amide compounds of the present invention with the couplers of the present invention, it becomes possible to improve the reduction of sensitivity which occurs when the unexposed samples using the couplers of the present invention are stored under high humidity condition.

On the other hand, when the amide compounds of the present invention are used in combination with comparative couplers, color forming ability and storage stability are deteriorated.

Example 3

Sample 301 was prepared in the same manner as in Example 1 except for changing the composition of the first layer of Sample 101 as follows.

| First Layer (blue-sensitive emulsion layer) | |
|---|---|
| Silver Chlorobromide Emulsion A described above | 0.26 |
| Gelatin | 1.50 |

-continued

| First Layer (blue-sensitive emulsion layer) | |
|---|---|
| Yellow Coupler (ExY) | 0.60 |
| Color Image Stabilizer (Cpd-3) | 0.10 |
| Solvent (Solv-10) | 0.15 |
| Solvent (Solv-3) | 0.05 |

Next, Samples 302 to 327 were prepared in the same manner as in Example 1 except for changing the yellow coupler, amide compound and discoloration inhibitor of Sample 301 as indicated in Table C.

In this case, couplers were replaced so as to become equimolar amount, the amount of the amide compound was 30 wt % based on the coupler and the discoloration inhibitor was added in an amount of 20 mol % to the coupler.

These samples were also evaluated for light fastness and heat and humidity fastness as in Example 1. Light fastness was evaluated at initial density 0.5 and 1.5, and heat and humidity fastness was evaluated at initial density 1.5. The results obtained are shown in Table C.

TABLE C

| Sample No. | Coupler | Amide Compound | Discoloration Inhibitor | Remaining Rate of Light Fastness (Canon, 3 weeks) D = 0.5 | D = 1.5 | Remaining Rate of Heat and Humidity Fastness (70° C., 70%, 2 months) D = 1.5 | Remarks |
|---|---|---|---|---|---|---|---|
| 301 | ExY | — | — | 75 | 65 | 80 | Comparison |
| 302 | | R-1 | — | 82 | 77 | 73 | " |
| 303 | | " | C-2 | 85 | 81 | 72 | " |
| 304 | | " | F-1 | 83 | 78 | 75 | " |
| 305 | | " | C-2, F-1 | 88 | 85 | 74 | " |
| 306 | | A-14 | — | 78 | 72 | 82 | " |
| 307 | | " | C-2 | 80 | 77 | 81 | " |
| 308 | | " | F-1 | 79 | 72 | 85 | " |
| 309 | | " | C-2, F-1 | 82 | 78 | 84 | " |
| 310 | Y-2 | — | — | 68 | 63 | 75 | " |
| 311 | | R-1 | — | 75 | 71 | 62 | " |
| 312 | | " | C-2 | 78 | 74 | 61 | " |
| 313 | | " | F-1 | 76 | 71 | 64 | " |
| 314 | | R-1 | C-2, F-1 | 82 | 79 | 64 | Comparison |
| 315 | | A-14 | — | 77 | 75 | 81 | Invention |
| 316 | | " | C-2 | 86 | 81 | 80 | " |
| 317 | | " | F-1 | 79 | 76 | 84 | " |
| 318 | | " | C-2, F-1 | 91 | 88 | 83 | " |
| 319 | Y-7 | — | — | 35 | 45 | 65 | Comparison |
| 320 | | R-1 | — | 61 | 55 | 48 | " |
| 321 | | " | C-2 | 69 | 66 | 46 | " |
| 322 | | " | F-1 | 63 | 57 | 51 | " |
| 323 | | " | C-2, F-1 | 76 | 72 | 50 | " |
| 324 | | A-14 | — | 72 | 74 | 78 | Invention |
| 325 | | " | C-2 | 79 | 81 | 76 | " |
| 326 | | " | F-1 | 75 | 76 | 81 | " |
| 327 | | " | C-2, F-1 | 90 | 87 | 80 | " |

As is understood from Table C, by using the coupler of the present invention in combination with the amide compound of the present invention, light fastness and heat and humidity fastness can be improved at the same time.

Also, by using the discoloration inhibitor of the present invention, light fastness can further be improved. It can be seen that by using two kinds of discoloration inhibitors in combination, astonishing improvement effect can be obtained.

Example 4

Samples 401 and 420 were prepared in the same manner as the preparation of Sample 301 in Example 3 except that the support was changed to a paper support laminated with polyethylene terephthalate containing 20 wt % of titanium oxide, and the coupler and additives in the first layer were replaced with the compounds indicated in Table D (amide compounds and discoloration inhibitors were respectively added in amounts of 30 wt % and 20 mol %, based on the coupler).

These samples were also evaluated for light fastness in the same manner as in Example 3.

TABLE D

| Sample No. | Coupler | Additive | Discoloration Inhibitor 1 | Discoloration Inhibitor 2 | Light Fastness, Remaining Rate of Color Image D = 0.5 | D = 1.5 | Remarks |
|---|---|---|---|---|---|---|---|
| 401 | Y-16 | — | — | — | 31 | 42 | Comparison |
| 402 | " | — | C-2 | — | 47 | 52 | " |

TABLE D-continued

| Sample No. | Coupler | Additive | Discoloration Inhibitor 1 | Discoloration Inhibitor 2 | Light Fastness, Remaining Rate of Color Image D = 0.5 | D = 1.5 | Remarks |
|---|---|---|---|---|---|---|---|
| 403 | " | — | — | F-1 | 36 | 45 | " |
| 404 | " | — | C-2 | F-1 | 59 | 65 | " |
| 405 | " | A-14 | — | — | 65 | 68 | Invention |
| 406 | " | " | C-2 | — | 74 | 77 | " |
| 407 | " | " | — | F-1 | 69 | 69 | " |
| 408 | " | " | C-2 | F-1 | 86 | 86 | " |
| 409 | " | " | C-2 | G-1 | 85 | 84 | " |
| 410 | " | " | C-2 | H-1 | 84 | 84 | " |
| 411 | " | " | C-19 | F-1 | 82 | 81 | " |
| 412 | " | " | D-5 | F-1 | 83 | 82 | " |
| 413 | " | " | " | G-1 | 81 | 81 | " |
| 414 | Y-16 | A-14 | D-5 | H-1 | 82 | 85 | Invention |
| 415 | " | " | E-2 | F-1 | 81 | 83 | " |
| 416 | " | " | " | G-1 | 82 | 81 | " |
| 417 | " | " | " | H-1 | 80 | 81 | " |
| 418 | " | " | E-4 | F-1 | 81 | 80 | " |
| 419 | " | " | E-11 | F-1 | 80 | 80 | " |
| 420 | " | " | E-12 | H-1 | 82 | 83 | " |

In this case, also, by using the couplers, amide compounds and discoloration inhibitors of the present invention in combination, same as in Example 3, light fastness can be improved in all the range of low density to high density.

Example 5

Sample 501 was prepared in the same manner as the preparation of Sample 101 in Example 1 except for changing the structures of the first layer and the third layer as follows.

| | |
|---|---|
| First Layer (blue-sensitive emulsion layer) | |
| Silver Chlorobromide Emulsion A described above | 0.25 |
| Gelatin | 1.35 |
| Yellow Coupler (ExY) | 0.58 |
| Color Image Stabilizer (Cpd-2) | 0.03 |
| Color Image Stabilizer (Cpd-3) | 0.08 |
| Solvent (Solv-3) | 0.18 |
| Third Layer (green-sensitive emulsion layer) | |
| Silver Chlorobromide Emulsion B described above | 0.13 |
| Gelatin | 1.15 |
| Magenta Coupler (ExM) | 0.12 |
| Color Image Stabilizer (Cpd-2) | 0.01 |
| Color Image Stabilizer (Cpd-5) | 0.01 |
| Color Image Stabilizer (Cpd-6) | 0.01 |
| Color Image Stabilizer (Cpd-7) | 0.05 |
| Color Image Stabilizer (Cpd-8) | 0.01 |
| Solvent (Solv-4) | 0.24 |

Samples 502 to 520 were prepared by replacing the yellow coupler of Sample 501 with couplers indicated in Table E in equimolar amount and further adding the amide compounds and/or discoloration inhibitors of the present invention, but Samples 510 to 512 were only the coating amounts were changed to 80% of Sample 501 and the compositions were not changed.

Each sample was wedge exposed same as in Example 1 and processed according to the following step.

First of all, the above prepared Sample 501 was cut and exposed through a photographed negative film using a color printer FAP3500H manufactured by Fuji Photo Film Co., Ltd. The exposed film was subjected to continuous processing (running test) according to the following step and the color developing solution having the composition shown below until the equivalent amount to the capacity of the color developing tank was replenished. The color developing time at this time was 30 seconds.

| Step | Processing Temperature (°C.) | Processing Time (sec) | Replenishment Rate* (ml) | Tank Capacity (liter) |
|---|---|---|---|---|
| Color Development | 45 | shown in Table E | 35 | 1 |
| Bleach-Fixing | 40 | 15 | 35 | 1 |
| Rinsing (1) | 40 | 3 | — | 0.5 |
| Rinsing (2) | 40 | 3 | — | 0.5 |
| Rinsing (3) | 40 | 3 | — | 0.5 |
| Rinsing (4) | 40 | 3 | — | 0.5 |
| Rinsing (5) | 40 | 8 | — | 0.5 |
| Drying | 60–80 | 10 | 90 | |

*Replenishment rate per $m^2$ of the photographic material Rinsing was conducted in a 5-tank countercurrent system from rinsing (5) to (1).

In the above processing, water of rinsing (4) was force fed to a reverse osmosis membrane, the penetrated water was charged to rinsing (5), and concentrated water not passed the reverse osmosis membrane was fed back to rinsing (4) and and processed. For saving the crossover time, blades were installed connecting each rinsing tank and samples were passed therebetween.

Each processing solution used for this processing was as follows.

| Color Developing Solution | Tank Solution | Replenisher |
|---|---|---|
| Water | 700 ml | 700 ml |
| Ethylenediaminetetraacetic Acid | 1.5 g | 3.75 g |
| Disodium 1,2-dihydroxybenzene-4,6-disulfonate | 0.25 g | 0.7 g |
| Triethanolamine | 9.0 g | 18.0 g |
| Potassium Chloride | 10.0 g | — |
| Potassium Bromide | 0.03 g | — |
| Potassium Carbonate | 30.0 g | 39.0 g |
| Brightening Agent (UVX) | 2.5 g | 5.0 g |
| Sodium Sulfite | 0.05 g | 0.1 g |
| Disodium-N,N-bis(sulfonatoethyl)hydroxylamine | 14.8 g | 29.6 g |
| N-Ethyl-N-(β-methanesulfonamidoethyl)-3-methyl-4-aminoaniline.3/2 Sulfate. Monohydrate | 6.0 g | 22.0 g |
| Water to make | 1,000 ml | 1,000 ml |
| pH (25° C.) | 10.35 | 12.60 |

UVX

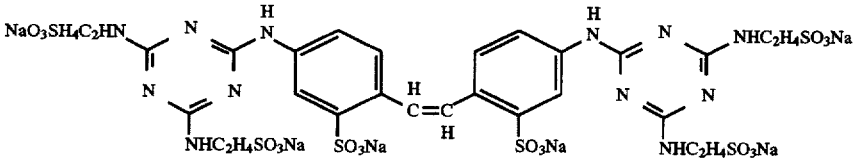

Bleach-Fixing Solution

The replenisher was prepared by separating component to two solutions.

| First Replenisher | |
|---|---|
| Water | 150 ml |
| Ethylenebisguanidine Nitrate | 30 g |
| Ammonium Sulfite Monohydrate | 190 g |
| Ethylenediaminetetraacetic Acid | 7.5 g |
| Ammonium Bromide | 30 g |
| Ammonium Thiosulfate (700 g/liter) | 340 ml |
| Acetic Acid (50%) | 215 ml |
| Water to make | 1,000 ml |
| pH (25° C.) | 4.8 |

| Second Replenisher | |
|---|---|
| Water | 140 ml |
| Ethylenediaminetetraacetic Acid | 11.0 g |
| Ammonium Ethylenediamine-tetraacetato Ferrate | 715 g |
| Acetic Acid (50%) | 105 ml |
| Water to make | 1,000 ml |
| pH (25° C.) | 2.5 |

-continued

| Tank Solution of Bleach-Fixing Solution | |
|---|---|
| First Replenisher | 300 ml |
| Second Replenisher | 200 ml |
| Water to make | 1,000 ml |
| pH (25° C.) | 5.5 |

Replenisher of Bleach-Fixing Solution

The following amount, total 35 ml per $m^2$ of the photographic material

| | |
|---|---|
| First Replenisher | 21 ml |
| Second Replenisher | 14 ml |

Samples 501 to 512 were processed using the above running solutions. In this case, color developing time was sec, 30 sec or 45 sec. After exposure, yellow color density ($D_{max}$) was measured. Samples which were processed for sec were measured for fog density ($D_{min}$), also.

The results obtained are shown in Table E.

TABLE E

| Sample No. | Coupler | Amide Compound (wt. %) | Color Density (Dmax) Processing Time 45 sec | 30 sec | 20 sec | Fog (Dmin) 30 sec | Remarks |
|---|---|---|---|---|---|---|---|
| 501 | ExY | — | 2.10 | 1.95 | 1.36 | 0.15 | Comparison |
| 502 | | A-14 (10) | 2.02 | 1.87 | 1.21 | 0.14 | " |
| 503 | | A-14 (25) | 1.87 | 1.72 | 1.03 | 0.13 | " |
| 504 | Y-3 | — | 2.14 | 2.11 | 1.93 | 0.16 | Comparison |
| 505 | | A-14 (10) | 2.13 | 2.09 | 1.96 | 0.13 | Invention |
| 506 | | A-14 (25) | 2.11 | 2.07 | 1.95 | 0.12 | " |
| 507 | Y-6 | — | 2.21 | 2.20 | 2.12 | 0.16 | Comparison |
| 508 | | A-14 (10) | 2.21 | 2.20 | 2.09 | 0.14 | Invention |

TABLE E-continued

| Sample No. | Coupler | Amide Compound (wt. %) | Color Density (Dmax) Processing Time 45 sec | 30 sec | 20 sec | Fog (Dmin) 30 sec | Remarks |
|---|---|---|---|---|---|---|---|
| 509 | | A-14 (25) | 2.20 | 2.18 | 2.06 | 0.12 | " |
| 510 | Y-40 | — | 2.19 | 2.18 | 2.13 | 0.18 | Comparison |
| 511 | | A-14 (20) | 2.18 | 2.17 | 2.11 | 0.14 | Invention |
| 512 | | A-14 (50) | 2.19 | 2.16 | 2.10 | 0.13 | " |

*wt % is the ratio to the coupler

As is understood from Table D, by using the coupler of the present invention in combination with the amide compound of the present invention, fog density can be reduced without causing the reduction of color density. Thus, the combination of the present invention exhibits excellent effect also in rapid processing.

When the same discoloration test as in Example 1 using Xe lamp and under 80° C., 70% conditions, it was confirmed that light fastness and heat and humidity fastness can be improved at the same time by the combination of the present invention.

Example 6

Scanning Exposure

Each of the samples prepared in Examples 1 to 5 were evaluated in the same manner except for subjecting to the following exposure. The results obtained were the same as in Examples 1 to 5.

Exposure

Three types of laser beams were used, that is, the wavelength of YAG solid state laser (oscillation wavelength: 946 nm) using a semiconductor laser GaAlAs (oscillation wavelength: 808.5 nm) as an excitation light source converted with SHG crystal of $KNbO_3$ to 473 nm, the wavelength of $YVO_4$ solid state laser (oscillation wavelength: 1,064 nm) using a semiconductor laser GaAlAs (oscillation wavelength: 808.7 nm) as an excitation light source converted with SHG crystal of KTP to 532 nm, and AlGaInP (oscillation wavelength: about 670 nm, manufactured by Toshiba Co., Ltd., Type No. TOLD9211). Laser beam can successively scanning expose a color photographic paper transferring vertically to scanning direction by rotating polyhedron. Using this device, by changing the light amount, the relation (D–log E) between density (D) of a photographic material and light amount (E) was searched. Light amounts of laser beams of three wavelengths were modulated using an external modulator and exposure amount was controlled. In this time, scanning exposure was conducted at 400 dpi, and an average exposure time per pixel was $5\times10^{-8}$ sec. For restraining the fluctuation of light amount due to changes of temperature, the temperature of semiconductor laser was maintained constant using Peltier element.

The present invention can provide a silver halide color photographic material which is excellent in color forming ability, color reproducibility and image stability, and is improved in raw stock storability and processing stability, and a method for forming a color image.

Further, using the coupler of the present invention, color forming ability is excellent compared with conventional couplers, a comparatively small amount may be sufficient to obtain the same density. After all, the amount of a high boiling point organic solvent for coupler can be reduced, as a result, as the amount of gelatin can also be reduced, film thickness can be decreased, accordingly, sharpness can be improved.

While the invention has been described in detail and with reference to specific examples thereof, it will be apparent to one skilled in the art that various changes and modifications can be made therein without departing from the spirit and scope thereof.

What is claimed is:

1. A silver halide color photographic material comprising a support having thereon at least one yellow coloring light-sensitive silver halide emulsion layer, at least one magenta coloring light-sensitive silver halide emulsion layer, and at least one cyan coloring light-sensitive silver halide emulsion layer, wherein at least one of said yellow coloring light-sensitive silver halide emulsion layer contains at least one dye-forming coupler represented by formula (Y) and at least one non-coloring compound represented by formula (A) or (B):

(Y)

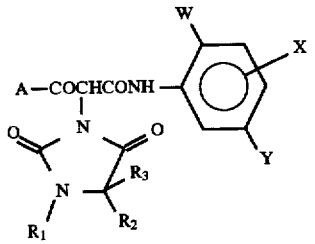

wherein A represents a tertiary alkyl group, an aryl group or an indolinyl group; W represents a halogen atom, an alkoxyl group, an aryloxy group or an alkyl group; X represents a hydrogen atom or a substituent; Y represents an acylamino group, an alkoxyl group, a sulfonamido group, a carbamoyl group, a sulfamoyl group, an alkoxycarbonyl group or a sulfonyl group; $R_1$ represents a hydrogen atom; $R_2$ and $R_3$ each independently represents a hydrogen atom, an alkyl group, an alkoxyl group or a sulfonyl group; and the total carbon atoms of $R_1$, $R_2$ and $R_3$ are 6 or less, provided that the compound represented by the following formula (I) is excluded from the compound represented by formula (A);

(A)

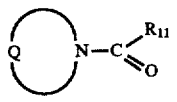

wherein Q represents a nonmetallic atomic group necessary for forming a 5- to 7-membered ring together with a nitrogen atom; and $R_{11}$ represents an alkyl group, an aryl group or an alkoxyl group;

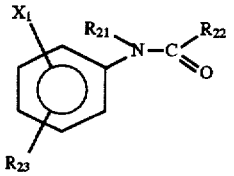

(B)

wherein $R_{21}$ represents a hydrogen atom or an alkyl group; $R_{22}$ represents an alkyl group, an aryl group or an alkoxyl group; $R_{23}$ represents a hydrogen atom, a halogen atom, an alkyl group, an alkoxyl group, an acylamino group or a sulfonamido group; and $X_1$ represents a hydrogen atom or a substituent;

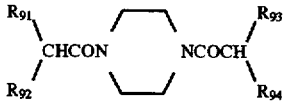

(I)

wherein $R_{91}$, $R_{92}$, $R_{93}$ and $R_{94}$ independently represents a branched and unsubstituted alkyl group having from 3 to 20 carbon atoms with the proviso that the total carbon number of and $R_{94}$ is from 16 to 60.

2. A silver halide color photographic material as claimed in claim 1, wherein the compound represented by formula (A) or (B) is represented by formula (A-1) or (B-1):

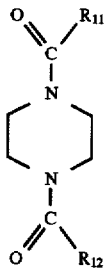

(A-1)

wherein $R_{11}$ and $R_{12}$ each independently represents the same groups as represented by $R_{11}$ in formula (A);

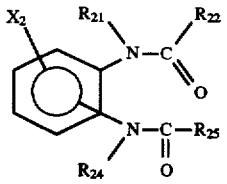

(B-1)

wherein $R_{21}$ and $R_{24}$, and $R_{22}$ and $R_{25}$ each independently represents the same groups as represented by $R_{21}$ and $R_{22}$ in formula (B); and $X_2$ represents the same groups as represented by $X_1$ in formula (B).

3. A silver halide color photographic material as claimed in claim 1, which contains gelatin as a hydrophilic binder in an amount of from 3 to 20 g/m$^2$.

4. A silver halide color photographic material as claimed in claim 1, wherein the support is a reflective support comprising polyester resin synthesized by condensation polymerization of dicarboxylic acid and diol.

5. A silver halide color photographic material as claimed in claim 1, wherein at least silver halide emulsion of said yellow coloring light-sensitive silver halide emulsion layer comprises silver chloride, silver chlorobromide or silver chloroiodobromide having a silver chloride content of 95 mol % or more.

6. A silver halide color photographic material as claimed in claim 1, wherein the coupler represented by formula (Y) is dispersed in at least one of said yellow coloring light-sensitive silver halide emulsion layer together with at least one compound represented by formula (C), (D) or (E):

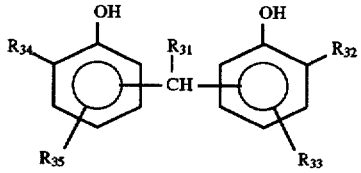

(C)

wherein $R_{31}$ represents a hydrogen atom or an alkyl group; and $R_{32}$, $R_{33}$, $R_{34}$ and $R_{35}$ each independently represents an alkyl group;

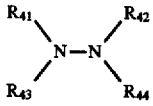

(D)

wherein $R_{41}$ and $R_{42}$ each independently represents an alkyl group or an aryl group; and $R_{43}$ and $R_{44}$ each independently represents an alkyl group; and at least any two of $R_{41}$ to $R_{44}$ may be bonded with each other to form a ring;

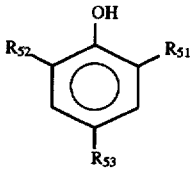

(E)

wherein $R_{51}$ and $R_{52}$ each independently represents an alkyl group or an alkoxyl group; and $R_{53}$ represents an alkyl group, an alkoxycarbonyl group, an aryloxycarbonyl group or a carbamoyl group.

7. A silver halide color photographic material as claimed in claim 6, which contains gelatin as a hydrophilic binder in an amount of from 3 to 20 g/m$^2$.

8. A silver halide color photographic material as claimed in claim 6, wherein the support is a reflective support comprising polyester resin synthesized by condensation polymerization of dicarboxylic acid and diol.

9. A silver halide color photographic material as claimed in claim 6, wherein at least silver halide emulsion of said yellow coloring light-sensitive silver halide emulsion layer comprises silver chloride, silver chlorobromide or silver chloroiodobromide having a silver chloride content of 95 mol % or more.

10. A silver halide color photographic material as claimed in claim 1, wherein the coupler represented by formula (Y) is dispersed in at least one of said yellow coloring light-sensitive silver halide emulsion layer together with further at least one compound represented by formula (F), (G) or (H):

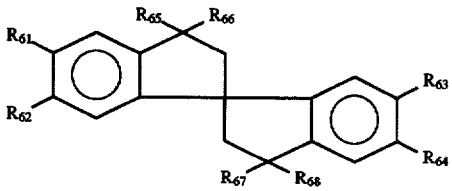

(F)

wherein $R_{61}$, $R_{62}$, $R_{63}$ and $R_{64}$ each independently represents an alkyl group, an alkoxyl group, a substituted or unsubstituted amino group, an aryloxy group, a sulfonyl group or an acyloxy group; and $R_{65}$, $R_{66}$, $R_{67}$ and $R_{68}$ each independently represents a hydrogen atom or an alkyl group; $R_{61}$ and $R_{62}$, and $R_{63}$ and $R_{64}$ may be bonded with each other to form a ring;

(G)

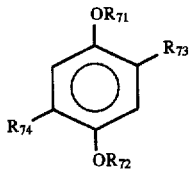

wherein $R_{71}$ and $R_{72}$ each independently represents an alkyl group, an alkenyl group, an acyl group, an aryl group or a silyl group; and $R_{73}$ and $R_{74}$ each independently represents a hydrogen atom, a halogen atom, an alkyl group, a silyl group, an acyl group or a sulfonyl group; $R_{71}$ and $R_{73}$, and $R_{72}$ and $R_{74}$ may be bonded with each other to form a ring;

(H)

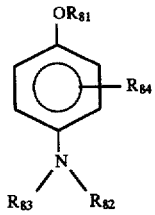

wherein $R_{81}$ represents an alkyl group, an alkenyl group, an aryl group or an acyl group; $R_{82}$ and $R_{83}$ each independently represents an alkyl group, an acyl group, an alkenyl group or an aryl group; and $R_{84}$ represents a hydrogen atom, an alkyl group, an alkoxyl group, a halogen atom or a sulfonyl group; when either of $R_{82}$ or $R_{83}$ represents an acyl group, $R_{84}$ represents an alkoxyl group, and $R_{81}$ and $R_{84}$, $R_{82}$ and $R_{83}$, or $R_{82}$ and $R_{84}$ may be bonded with each other to form a ring.

11. A silver halide color photographic material comprising a support having thereon at least one yellow coloring light-sensitive silver halide emulsion layer, at least one magenta coloring light-sensitive silver halide emulsion layer, and at least one cyan coloring light-sensitive silver halide emulsion layer, wherein at least one of said yellow coloring light-sensitive silver halide emulsion layer contains at least one dye-forming coupler represented by formula (Y) and at least one non-coloring compound represented by formula (A) or (B):

(Y)

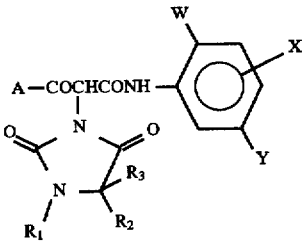

wherein A represents a tertiary alkyl group, an aryl group or an indolinyl group; W represents a halogen atom, an alkoxyl group, an aryloxy group or an alkyl group; X represents a hydrogen atom or a substituent; Y represents an acylamino group, an alkoxyl group, a sulfonamido group, a carbamoyl group, a sulfamoyl group, an alkoxycarbonyl group or a sulfonyl group; $R_1$ represents a hydrogen atom; $R_2$ and $R_3$ each independently represents a hydrogen atom, an alkyl group, an alkoxyl group or a sulfonyl group; and the total carbon atoms of $R_1$, $R_2$ and $R_3$ are 6 or less, provided that the compound represented by the following formula (I) is excluded from the compound represented by formula (A);

(A)

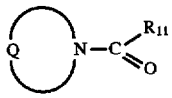

wherein Q represents a nonmetallic atomic group necessary for forming a 5- to 7-membered ring together with a nitrogen atom; and $R_{11}$ represents an alkyl group, an aryl group or an alkoxyl group;

(B)

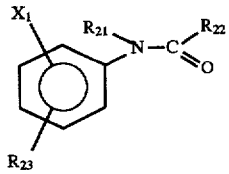

wherein $R_{21}$ represents a hydrogen atom or an alkyl group; $R_{22}$ represents an alkyl group, an aryl group or an alkoxyl group; $R_{23}$ represents a hydrogen atom, a halogen atom, an alkyl group, an alkoxyl group, an acylamino group or a sulfonamido group; and $X_1$ represents a hydrogen atom or a substituent;

(I)

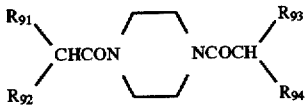

wherein $R_{91}$, $R_{92}$, $R_{93}$ and $R_{94}$ independently represents a branched and unsubstituted alkyl group having from 3 to 20 carbon atoms with the proviso that the total carbon number of $R_{91}$, $R_{92}$, $R_{93}$ and $R_{94}$ is from 16 to 60;

wherein the coupler represented by formula (Y) is dispersed in at least one of said yellow coloring light-sensitive silver halide emulsion layer together with at least one compound represented by formula (C), (D) or (E), and with at least one compound represented by formula (F), (G) or (H):

(C)

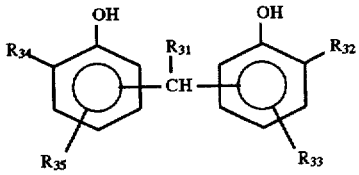

wherein $R_{31}$ represents a hydrogen atom or an alkyl group; and $R_{32}$, $R_{33}$, $R_{34}$ and $R_{35}$ each independently represents an alkyl group;

(D)

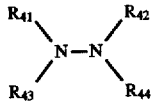

wherein $R_{41}$ and $R_{42}$ each independently represents an alkyl group or an aryl group; and $R_{43}$ and $R_{44}$ each independently represents an alkyl group; and at least any two of $R_{41}$ to $R_{44}$ may be bonded with each other to form a ring;

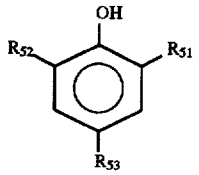

(E)

wherein $R_{51}$ and $R_{52}$ each independently represents an alkyl group or an alkoxyl group; and $R_{53}$ represents an alkyl group, an alkoxycarbonyl group, an aryloxycarbonyl group or a carbamoyl group;

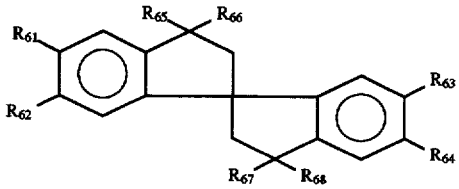

wherein $R_{61}$, $R_{62}$, $R_{63}$ and $R_{64}$ each independently represents an alkyl group, an alkoxyl group, a substituted or unsubstituted amino group, an aryloxy group, a sulfonyl group or an acyloxy group; and $R_{65}$, $R_{66}$, $R_{67}$ and $R_{68}$ each independently represents a hydrogen atom or an alkyl group; $R_{61}$ and $R_{62}$, and $R_{63}$ and $R_{64}$ may be bonded with each other to form a ring;

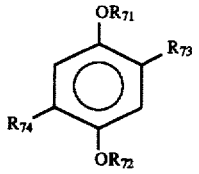

(G)

wherein $R_{71}$ and $R_{72}$ each independently represents an alkyl group, an alkenyl group, an acyl group, an aryl group or a silyl group; and $R_{73}$ and $R_{74}$ each independently represents a hydrogen atom, a halogen atom, an alkyl group, a silyl group, an acyl group or a sulfonyl group; $R_{71}$ and $R_{73}$, and $R_{72}$ and $R_{74}$ may be bonded with each other to form a ring;

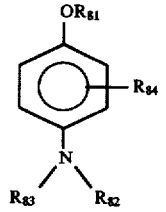

(H)

wherein $R_{81}$ represents an alkyl group, an alkenyl group, an aryl group or an acyl group; $R_{82}$ and $R_{83}$ each independently represents an alkyl group, an acyl group, an alkenyl group or an aryl group; and $R_{84}$ represents a hydrogen atom, an alkyl group, an alkoxyl group, a halogen atom or a sulfonyl group; when either of $R_{82}$ or $R_{83}$ represents an acyl group, represents an alkoxyl group, and $R_{81}$ and $R_{84}$, $R_{82}$ and $R_{83}$, or $R_{82}$ and $R_{84}$ may be bonded with each other to form a ring.

12. A silver halide color photographic material as claimed in claim 11, wherein the compound represented by formula (A) or (B) is represented by formula (A-1) or (B-1):

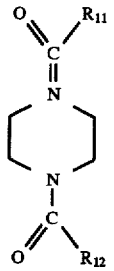

(A-1)

wherein $R_{11}$ and $R_{12}$ each independently represents the same groups as represented by $R_{11}$ in formula (A);

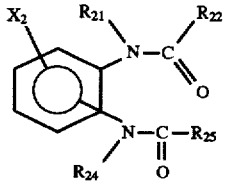

(B-1)

wherein $R_{21}$ and $R_{24}$, and $R_{22}$ and $R_{25}$ each independently represents the same groups as represented by $R_{21}$ and $R_{22}$ in formula (B); and $X_2$ represents the same groups as represented by $X_1$ in formula (B).

13. A silver halide color photographic material as claimed in claim 11, wherein $R_1$ in formula (Y) represents a hydrogen atom.

14. A silver halide color photographic material as claimed in claim 11, which contains gelatin as a hydrophilic binder in an amount of from 3 to 20 g/m$^2$.

15. A silver halide color photographic material as claimed in claim 11, wherein the support is a reflective support comprising polyester resin synthesized by condensation polymerization of dicarboxylic acid and diol.

16. A silver halide color photographic material as claimed in claim 11, wherein at least silver halide emulsion of said yellow coloring light-sensitive silver halide emulsion layer comprises silver chloride, silver chlorobromide or silver chloroiodobromide having a silver chloride content of 95 mol % or more.

17. A method for forming a color image comprises exposing a silver halide color photographic material by a scanning exposure system in which the exposure time per pixel is less than $10^{-4}$ sec, and then color development processing, wherein the silver halide color photographic material comprises a support having thereon at least one yellow coloring light-sensitive silver halide emulsion layer, at least one magenta coloring light-sensitive silver halide emulsion layer, and at least one cyan coloring light-sensitive silver halide emulsion layer, wherein at least one of said yellow coloring light-sensitive silver halide emulsion layer contains at least one dye-forming coupler represented by formula (Y) and at least one non-coloring compound represented by formula (A) or (B):

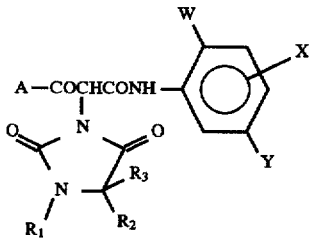

(Y)

wherein A represents a tertiary alkyl group, an aryl group or an indolinyl group; W represents a halogen atom, an alkoxyl group, an aryloxy group or an alkyl group; X represents a hydrogen atom or a substituent; Y represents an acylamino group, an alkoxyl group, a sulfonamido group, a carbamoyl group, a sulfamoyl group, an alkoxycarbonyl group or a sulfonyl group; $R_1$ represents a hydrogen atom; $R_2$ and $R_3$ each independently represents a hydrogen atom, an alkyl group, an alkoxyl group or a sulfonyl group; and the total carbon atoms of $R_1$, $R_2$ and $R_3$ are 6 or less, provided that the compound represented by the following formula (I) is excluded from the compound represented by formula (A);

(A)

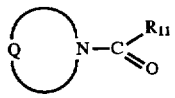

wherein Q represents a nonmetallic atomic group necessary for forming a 5- to 7-membered ring together with a nitrogen atom; and $R_{11}$ represents an alkyl group, an aryl group or an alkoxyl group;

(B)

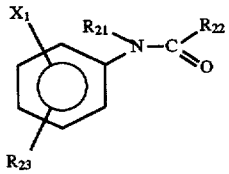

wherein $R_{21}$ represents a hydrogen atom or an alkyl group; $R_{22}$ represents an alkyl group, an aryl group or an alkoxyl group; $R_{23}$ represents a hydrogen atom, a halogen atom, an alkyl group, an alkoxyl group, an acylamino group or a sulfonamido group; and $X_1$ represents a hydrogen atom or a substituent;

(I)

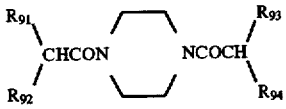

wherein $R_{91}$, $R_{92}$, $R_{93}$ and $R_{94}$ independently represents a branched and unsubstituted alkyl group having from 3 to 20 carbon atoms with the proviso that the total carbon number of $R_{91}$, $R_{92}$, $R_{93}$ and $R_{94}$ is from 16 to 60.

18. A method for forming a color image comprises exposing a silver halide color photographic material by a scanning exposure system in which the exposure time per pixel is less than $10^{-4}$ sec. and then color development processing, wherein the silver halide color photographic material comprises a support having thereon at least one yellow coloring light-sensitive silver halide emulsion layer, at least one magenta coloring light-sensitive silver halide emulsion layer, and at least one cyan coloring light-sensitive silver halide emulsion layer, wherein at least one of said yellow coloring light-sensitive silver halide emulsion layer contains at least one dye-forming coupler represented by formula (Y) and at least one non-coloring compound represented by formula (A) or (B):

(Y)

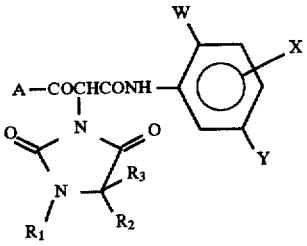

wherein A represents a tertiary alkyl group, an aryl group or an indolinyl group; W represents a halogen atom, an alkoxyl group, an aryloxy group or an alkyl group; X represents a hydrogen atom or a substituent; Y represents an acylamino group, an alkoxyl group, a sulfonamido group, a carbamoyl group, a sulfamoyl group, an alkoxycarbonyl group or a sulfonyl group; $R_1$ represents a hydrogen atom; $R_2$ and $R_3$ each independently represents a hydrogen atom, an alkyl group, an alkoxyl group or a sulfonyl group; and the total carbon atoms of $R_1$, $R_2$ and $R_3$ are 6 or less, provided that the compound represented by the following formula (I) is excluded from the compound represented by formula (A);

(A)

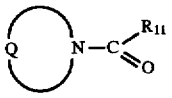

wherein Q represents a nonmetallic atomic group necessary for forming a 5- to 7-membered ring together with a nitrogen atom; and $R_{11}$ represents an alkyl group, an aryl group or an alkoxyl group;

(B)

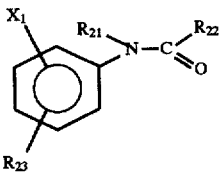

wherein $R_{21}$ represents a hydrogen atom or an alkyl group; $R_{22}$ represents an alkyl group, an aryl group or an alkoxyl group; $R_{23}$ represents a hydrogen atom, a halogen atom, an alkyl group, an alkoxyl group, an acylamino group or a sulfonamido group; and $X_1$ represents a hydrogen atom or a substituent;

(I)

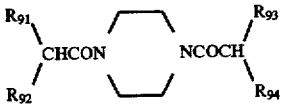

wherein $R_{91}$, $R_{92}$, $R_{93}$ and $R_{94}$ independently represents a branched and unsubstituted alkyl group having from 3 to 20 carbon atoms with the proviso that the total carbon number of $R_{91}$, $R_{92}$, $R_{93}$ and $R_{94}$ is from 16 to 60;

wherein the coupler represented by formula (Y) is dispersed in at least one of said yellow coloring light-sensitive silver halide emulsion layer together with at least one compound represented by formula (C), (D) or (E), and with at least one compound represented by formula (F), (G) or (H):

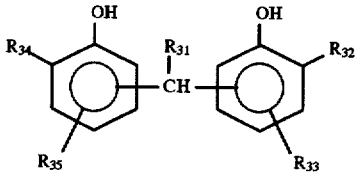

(C)

wherein $R_{31}$ represents a hydrogen atom or an alkyl group; and $R_{32}$, $R_{33}$, $R_{34}$ and $R_{35}$ each independently represents an alkyl group;

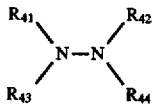

(D)

wherein $R_{41}$ and $R_{42}$ each independently represents an alkyl group or an aryl group; and $R_{43}$ and $R_{44}$ each independently represents an alkyl group; and at least any two of $R_{41}$ to $R_{44}$ may be bonded with each other to form a ring;

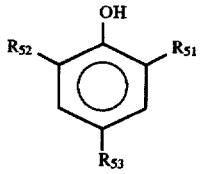

(E)

wherein $R_{51}$ and $R_{52}$ each independently represents an alkyl group or an alkoxyl group; and $R_{53}$ represents an alkyl group, an alkoxycarbonyl group, an aryloxycarbonyl group or a carbamoyl group;

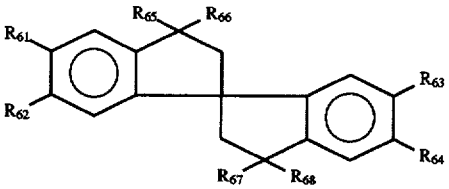

(F)

wherein $R_{61}$, $R_{62}$, $R_{63}$ and $R_{64}$ each independently represents an alkyl group, an alkoxyl group, a substituted or unsubstituted amino group, an aryloxy group, a sulfonyl group or an acyloxy group; and $R_{65}$, $R_{66}$, $R_{67}$ and $R_{68}$ each independently represents a hydrogen atom or an alkyl group; $R_{61}$ and $R_{62}$, and $R_{63}$ and $R_{64}$ may be bonded with each other to form a ring;

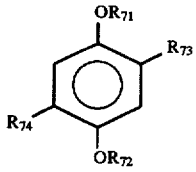

(G)

wherein $R_{71}$ and $R_{72}$ each independently represents an alkyl group, an alkenyl group, an acyl group, an aryl group or a silyl group; and $R_{73}$ and $R_{74}$ each independently represents a hydrogen atom, a halogen atom, an alkyl group, a silyl group, an acyl group or a sulfonyl group; $R_{71}$ and $R_{73}$, and $R_{72}$ and $R_{74}$ may be bonded with each other to form a ring;

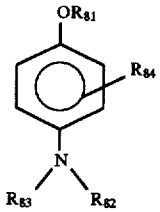

(H)

wherein $R_{81}$ represents an alkyl group, an alkenyl group, an aryl group or an acyl group; $R_{82}$ and $R_{83}$ each independently represents an alkyl group, an acyl group, an alkenyl group or an aryl group; and $R_{84}$ represents a hydrogen atom, an alkyl group, an alkoxyl group, a halogen atom or a sulfonyl group; when either of $R_{82}$ or $R_{83}$ represents an acyl group, $R_{84}$ represents an alkoxyl group, and $R_{81}$ and $R_{84}$, $R_{82}$ and $R_{83}$, or $R_{82}$ and $R_{84}$ may be bonded with each other to form a ring.

* * * * *